US008884993B2

(12) United States Patent
Yamashita et al.

(10) Patent No.: US 8,884,993 B2
(45) Date of Patent: Nov. 11, 2014

(54) SIGNAL PROCESSING APPARATUS, DISPLAY APPARATUS, ELECTRONIC APPARATUS, SIGNAL PROCESSING METHOD AND PROGRAM

(75) Inventors: Junichi Yamashita, Tokyo (JP); Hiroshi Hasegawa, Kanagawa (JP); Kazuo Nakamura, Kanagawa (JP); Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 893 days.

(21) Appl. No.: 13/064,340

(22) Filed: Mar. 21, 2011

(65) Prior Publication Data

US 2011/0242143 A1 Oct. 6, 2011

(30) Foreign Application Priority Data

Mar. 30, 2010 (JP) ..... P2010-076649

(51) Int. Cl.
*G09G 5/10* (2006.01)
*G09G 3/32* (2006.01)

(52) U.S. Cl.
CPC ..... *G09G 3/3233* (2013.01); *G09G 2320/043* (2013.01); *G09G 2300/0866* (2013.01); *G09G 2320/041* (2013.01); *G09G 2320/029* (2013.01); *G09G 2360/145* (2013.01); *G09G 2300/0819* (2013.01); *G09G 3/3291* (2013.01)
USPC ..... 345/690; 345/76; 345/77; 315/169.3

(58) Field of Classification Search
USPC ..... 345/76, 77, 690; 315/169.3
See application file for complete search history.

(56) References Cited

U.S. PATENT DOCUMENTS

2005/0280766 A1* 12/2005 Johnson et al. ..... 349/167
2007/0001940 A1* 1/2007 Jo ..... 345/77
2008/0150839 A1 6/2008 Kawabe
2009/0184901 A1* 7/2009 Kwon ..... 345/77
2010/0045709 A1* 2/2010 Nakamura et al. ..... 345/690

FOREIGN PATENT DOCUMENTS

JP 2008-176274 7/2008

* cited by examiner

*Primary Examiner* — Koosha Sharifi-Tafreshi
(74) *Attorney, Agent, or Firm* — Rader, Fishman & Grauer PLLC

(57) ABSTRACT

Disclosed herein is a signal processing apparatus, including: a luminance degradation information production section adapted to produce luminance degradation information regarding degradation of a luminance in accordance with a temperature condition upon emission; a luminance degradation value calculation section adapted to calculate a luminance degradation value regarding degradation of the luminance for each pixel circuit; and a correction section adapted to correct the gradation value of an image signal to be inputted to the pixel circuit based on the luminance degradation value.

17 Claims, 40 Drawing Sheets

FIG.13A

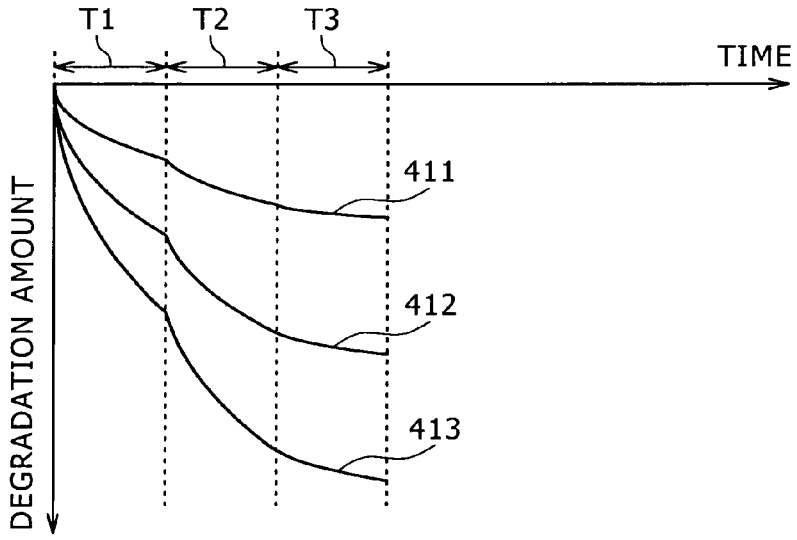

FIG.13B

| | 421 DEGRADATION AMOUNT (%) WITHIN MEASUREMENT PERIOD (1) | 422 DEGRADATION AMOUNT (%) WITHIN MEASUREMENT PERIOD (2) | 423 DEGRADATION AMOUNT (%) WITHIN MEASUREMENT PERIOD (3) |
|---|---|---|---|
| 424 DUMMY PIXEL (GRADATION VALUE 100) | 95 | 92 | 90 |
| 425 DUMMY PIXEL (GRADATION VALUE 150) | 89 | 82 | 80 |
| 426 DUMMY PIXEL (GRADATION VALUE 200) | 83 | 73 | 70 |

FIG.13C

| | 431 TEMPERATURE (℃) WITHIN MEASUREMENT PERIOD (1) | 432 TEMPERATURE (℃) WITHIN MEASUREMENT PERIOD (2) | 433 TEMPERATURE (℃) WITHIN MEASUREMENT PERIOD (3) |
|---|---|---|---|
| 434 TEMPERATURE | 20 | 40 | 30 |

FIG.28

| | 571 DEGRADATION AMOUNT (%) WITHIN FIRST LIGHT EMISSION PERIOD | 572 DEGRADATION AMOUNT (%) WITHIN SECOND LIGHT EMISSION PERIOD |
|---|---|---|
| DUMMY PIXEL CIRCUIT(#3) (20℃,GRADATION VALUE 100) | 98 | – |
| DUMMY PIXEL CIRCUIT(#2) (20℃,GRADATION VALUE 150) | 95 | – |
| DUMMY PIXEL CIRCUIT(#1) (20℃,GRADATION VALUE 200) | 90 | – |
| DUMMY PIXEL CIRCUIT(#6) (30℃,GRADATION VALUE 100) | 93 | 87 |
| DUMMY PIXEL CIRCUIT(#5) (30℃,GRADATION VALUE 150) | 87 | 80 |
| DUMMY PIXEL CIRCUIT(#4) (30℃,GRADATION VALUE 200) | 81 | 74 |
| DUMMY PIXEL CIRCUIT(#9) (40℃,GRADATION VALUE 100) | 90 | – |
| DUMMY PIXEL CIRCUIT(#8) (40℃,GRADATION VALUE 150) | 84 | – |
| DUMMY PIXEL CIRCUIT(#7) (40℃,GRADATION VALUE 200) | 78 | – |

FIG.35

| | 771 DEGRADATION AMOUNT (%) WITHIN FIRST LIGHT EMISSION PERIOD | 772 DEGRADATION AMOUNT (%) WITHIN SECOND LIGHT EMISSION PERIOD | 773 DEGRADATION AMOUNT (%) WITHIN THIRD LIGHT EMISSION PERIOD |
|---|---|---|---|
| DUMMY PIXEL(#3) (20℃,GRADATION VALUE 100) | 98 | 95 | 92 |
| DUMMY PIXEL(#2) (20℃,GRADATION VALUE 150) | 95 | 91 | 88 |
| DUMMY PIXEL(#1) (20℃,GRADATION VALUE 200) | 90 | 85 | 81 |
| DUMMY PIXEL(#6) (30℃,GRADATION VALUE 100) | 93 | 87 | 82 |
| DUMMY PIXEL(#5) (30℃,GRADATION VALUE 150) | 87 | 80 | 75 |
| DUMMY PIXEL(#4) (30℃,GRADATION VALUE 200) | 81 | 74 | 68 |
| DUMMY PIXEL(#9) (40℃,GRADATION VALUE 100) | 90 | 82 | 75 |
| DUMMY PIXEL(#8) (40℃,GRADATION VALUE 150) | 84 | 75 | 70 |
| DUMMY PIXEL(#7) (40℃,GRADATION VALUE 200) | 78 | 71 | 64 |

SIGNAL PROCESSING APPARATUS, DISPLAY APPARATUS, ELECTRONIC APPARATUS, SIGNAL PROCESSING METHOD AND PROGRAM

BACKGROUND OF THE INVENTION

1. Field of the Invention

This invention relates to a signal processing apparatus, and more particularly to a signal processing apparatus, a display apparatus, an electronic apparatus and a signal processing method as well as a program for causing a computer to execute the method, by which ghosting is corrected.

2. Description of the Related Art

In recent years, display apparatus of the planar self-luminous type wherein an organic EL (Electroluminescence) element is used as a light emitting element have been increasingly under development. The organic EL element represents a degradation by changing the light emission amount in response to image data of a display object. Therefore, the degree of degradation of the organic EL element differs among different pixel circuits which configure the display screen of a display apparatus. Since the degradation degree differs among different pixel circuits in this manner, as time passes, those pixels which suffer comparatively much from degradation and those pixels which suffer comparatively little from degradation come into mixed coexistence on the display screen. If pixels which suffer comparatively much from degradation and pixels which suffer comparatively little from degradation exist in a mixed state in this manner, then the pixels which suffer comparatively much from degradation become darker than surrounding pixels, and a phenomenon called ghosting phenomenon that an image which has been displayed directly before then looks remaining appears.

A display apparatus having a function for preventing such ghosting has been proposed wherein, for example, within a period within which the display apparatus is not used, degradation of those light emitting elements which suffer comparatively little from degradation is promoted so that the degree of the degradation may be uniformized with the degree of degradation of those light emitting elements which suffer comparatively much from degradation. A display apparatus of the type just described is disclosed, for example, in Japanese Patent Laid-Open No. 2008-176274 (FIG. 1).

SUMMARY OF THE INVENTION

With the related art display apparatus described above, ghosting can be corrected by carrying out a process of uniformizing the degree of degradation within a period within which the display apparatus is not used. However, with the display apparatus, degradation of the light emitting elements whose degradation degree is low is promoted in conformity with the degradation degree of the light emitting elements whose degradation degree is high every time correction of ghosting is carried out. Therefore, there is the possibility that degradation of all of the light emitting elements may be promoted. Further, since ghosting correction is carried out within a period within which the display apparatus is not used, such correction cannot be carried out during use of the display apparatus. Thus, it seems a possible idea to use a method of correcting ghosting by changing the gradation value of an image signal taking degradation of each light emitting element itself into consideration during use of the display apparatus.

For example, a correction method seems promising wherein the gradation value of an image signal is changed in accordance with the degree of degradation of a pixel circuit by which the image signal is to be displayed and using the image signal of the changed gradation value to cause the light emitting element of the pixel circuit to emit light. However, since the degree of degradation of the luminance of a light emitting element differs among different pixel circuits, it is important to change the gradation value to correct ghosting with a high degree of accuracy.

Therefore, it is desirable to provide a signal processing apparatus, a display apparatus, an electronic apparatus, a signal processing method and a program by which ghosting arising from degradation of a light emitting element can be corrected with a high degree of accuracy.

According to the present invention, there is provided a signal processing apparatus including a luminance degradation information production section adapted to produce luminance degradation information regarding degradation of a luminance of light from a light emitting element in a pixel circuit in accordance with a temperature condition upon emission based on an ambient temperature of the pixel circuit and a luminance value, which degrades in response to elapsed time, of a particular light emitting element which is driven to emit light with a particular gradation value, a luminance degradation value calculation section adapted to calculate a luminance degradation value regarding degradation of the luminance for each pixel circuit based on a luminance characteristic indicative of a characteristic of a correlation between an image signal supplied to the pixel circuit which is in a predetermined state and the luminance of light emitted from the pixel circuit in response to the image signal and the luminance degradation information produced by the luminance degradation information production section, and a correction section adapted to correct the gradation value of the image signal to be inputted to the pixel circuit based on the luminance degradation value. According to the present invention, also a display apparatus and an electronic apparatus which incorporates the signal processing apparatus are provided, and also a signal processing method applied to the signal processing apparatus and a program for causing a computer to execute the method are provided. In the signal processing apparatus, display apparatus, electronic apparatus, signal processing method and program, luminance degradation information is produced with the ambient temperature of the pixel circuit taken into consideration, and the gradation value of an image signal to be inputted to the pixel circuit is corrected using the luminance degradation information.

The luminance degradation information production section may includes a luminance degradation characteristic production section adapted to produce a luminance degradation characteristic regarding degradation of the luminance of the pixel circuit at a particular temperature based on a measurement temperature at which the luminance value is measured and the luminance value, and an addition section adapted to successively add a new degradation amount regarding the degradation of the luminance of the pixel circuit to the luminance degradation information based on the ambient temperature, the luminance degradation characteristic, luminance degradation information produced with regard to the pixel circuit before the correction and the gradation value of the image signal inputted to the pixel circuit to produce new luminance degradation information. In the signal processing apparatus, a new degradation amount is successively added based on the luminance degradation characteristic, ambient temperature, luminance degradation information and gradation value of the image signal to produce new luminance degradation information. In this instance, the luminance degradation characteristic production section may produce the luminance degradation characteristic in a temperature condition different from the measurement temperature based on the measurement temperature when the luminance value is measured and the luminance value. In the signal processing apparatus, a luminance degradation characteristic in a temperature condition different from the measurement temperature is produced based on the measurement temperature and the luminance value. Or, the signal processing apparatus may further include an image signal supplying section adapted to supply an image signal to the particular light emitting element in response to the measurement temperature, the luminance degradation characteristic production section producing the luminance degradation characteristic of the pixel circuit at the particular temperature based on a luminance value, which degrades in response to the elapsed time, of the particular light emitting element when the measurement temperature becomes the particular temperature. In the signal processing apparatus, the luminance degradation characteristic is produced based on the luminance value of the particular light emitting element which emits light and is degraded in response to the measurement temperature. Or else, the luminance degradation characteristic production section may produce the luminance degradation characteristic of the pixel circuit at the particular temperature based on the luminance value, which degrades in response to the elapsed time, of the particular light emitting element in a state in which the ambient temperature of the particular light emitting element is the particular temperature. In the signal processing apparatus, the luminance degradation characteristic is produced based on the luminance value of the particular light emitting element which emits light and is degraded in the state in which the ambient temperature of the particular light emitting element is the particular temperature.

The predetermined state may be a state in which the pixel circuit suffers from no degradation of the luminance. In the signal processing apparatus, the state in which the pixel circuit suffers from no degradation of luminance is set as the predetermined state.

With the signal processing apparatus, display apparatus, electronic apparatus, signal processing method and program, a superior advantage that ghosting of a display apparatus which uses a light emitting element can be corrected with a high degree of accuracy can be achieved.

The above and other features and advantages of the present invention will become apparent from the following description and the appended claims, taken in conjunction with the accompanying drawings in which like parts or elements denoted by like reference symbols.

BRIEF DESCRIPTION OF THE DRAWINGS

FIGS. 13A to 13C are views illustrating an example of luminance measurement by three luminance sensors, an example of dummy pixel degradation information and an example of temperature information, respectively, used in the display apparatus of FIG. 1;

FIG. 28 is a view illustrating an example of dummy pixel degradation information used in the display apparatus of FIG. 24;

FIG. 35 is a view illustrating an example of dummy pixel degradation information used in the display apparatus according to the third embodiment of the present invention;

DETAILED DESCRIPTION OF THE PREFERRED EMBODIMENTS

In the following, preferred embodiments of the present invention are described. The description is given in the following order.

1. First Embodiment (display control: example wherein temperature condition conversion is carried out using a temperature condition conversion portion to calculate a degradation characteristic for each temperature)
2. Second Embodiment (example wherein a dummy pixel circuit which degrades only at a particular temperature is used to calculate a degradation characteristic for each temperature)
3. Third Embodiment (example wherein the temperature of a dummy pixel circuit is kept fixed at a predetermined temperature to calculate a degradation characteristic for each temperature)
4. Applications of the Invention (display control: examples of an electronic apparatus)

1. First Embodiment

Example of Configuration of Display Apparatus

Figure 1:
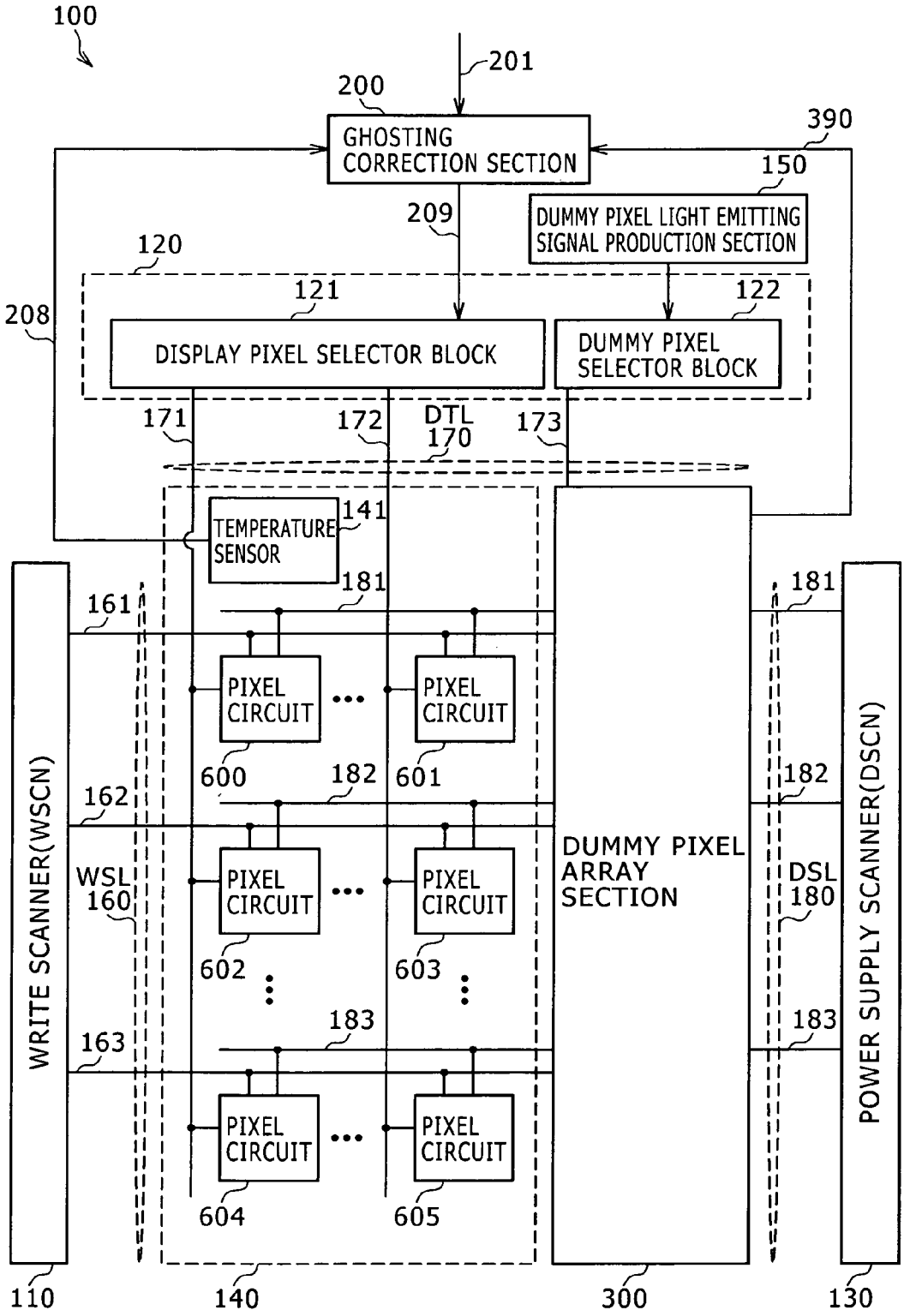
FIG. 1 is a block diagram showing an example of a configuration of a display apparatus according to a first embodiment of the present invention.

FIG. 1 shows an example of a configuration of a display apparatus 100 according to a first embodiment of the present invention. Referring to FIG. 1, the display apparatus 100 includes a ghosting correction section 200, a write scanner (WSCN: Write SCaNner) 110, and a horizontal selector (HSEL: Horizontal SELector) 120. The display apparatus 100 further includes a power supply scanner (DSCN: Drive SCaNner) 130, a pixel array section 140, a dummy pixel light emitting signal production section 150, and a dummy pixel array section 300. The pixel array section 140 includes n×m (m and n are integers equal to or greater than 2) pixel circuits 600 to 605 arrayed in a two-dimensional matrix. For the convenience of illustration and description, in FIG. 1, the six pixel circuits 600 to 605 disposed in the first column and the nth column in the first, second and mth rows are shown.

The pixel array section 140 further includes a temperature sensor 141. The temperature sensor 141 measures the ambient temperature of the pixel circuits and supplies the measured temperature information to the ghosting correction section 200 through a signal line 208. It is to be noted that it is assumed that the temperature of the pixel circuits is equal among all pixel circuits. In other words, it is assumed that the temperatures of the pixel array section 140 and the dummy pixel array section 300 are equal to each other.

The display apparatus 100 further includes scanning lines (WSL: Write Scan Line) 160 for connecting the pixel circuits 600 to 605 and the write scanner (WSCN) 110 to each other. It is to be noted that the scanning lines (WSL) 160 connect also dummy pixel circuits of the dummy pixel array section 300 and the write scanner (WSCN) 110 to each other. In FIG. 1, the scanning lines (WSL) 161 to 163 for the first, second and mth rows are shown for the convenience of illustration.

The display apparatus 100 further includes data lines (DTL: Data Line) 170 which connect the pixel circuits 600 to 605 and the horizontal selector (HSEL) 120 to each other. It is to be noted that the data lines (DTL) 170 connect also the dummy pixel circuits of the dummy pixel array section 300 and the horizontal selector (HSEL) 120 to each other. In FIG. 1, the data lines (DTL) 171 and 172 for the first and nth columns and the data line (DTL) 173 connected to the dummy pixel circuits are shown for the convenience of illustration.

Furthermore, the display apparatus 100 includes power supply lines (DSL: Drive Scan Line) 180 which connect the pixel circuits 600 to 605 and the power supply scanner (DSCN) 130 to each other. It is to be noted that the power supply lines (DSL) 180 connect also the dummy pixel circuits of the dummy pixel array section 300 and the power supply scanner (DSCN) 130 to each other. In FIG. 1, the power supply lines (DSL) 181 to 183 for the first, second and mth rows are shown for the convenience of illustration, respectively.

The ghosting correction section 200 changes the gradation value of an image signal in response to the degree of degradation of each of the pixel circuits 600 to 605 to correct ghosting. The ghosting correction section 200 calculates the degree of degradation of each of the pixel circuits 600 to 605 based on the luminance of the dummy pixel circuits supplied thereto through a signal line 390, temperature information supplied thereto through the signal line 208, and a gradation value of the image signal. Then, the ghosting correction section 200 changes the gradation value of the image signal supplied thereto through a signal line 201 based on the calculated degree of degradation of each of the pixel circuits 600 to 605. Here, the gradation value of the image signal is a value of a gradation of the image signal which designates a state of the magnitude of the luminance of the emitted light. Meanwhile, the dummy pixel circuits are pixels which are not actually used for display but are used to measure the degree of degradation of the pixel circuits.

Here, it is assumed that the magnitude of the luminance of emitted light is represented by 256 stages or gradations. Further, it is assumed that, by degradation of the pixel circuit 600, the luminance of emitted light based on the image signal having the gradation value "100" degrades from 200 nit to 100 nit and the luminance of emitted light based on the image signal having the gradation value "200" degrades from 300 nit to 200 nit. In this instance, the ghosting correction section 200 changes the gradation value of the image signal from "100" to "200" to correct ghosting in order to cause the pixel circuit 600 to emit light with 200 nit.

The ghosting correction section 200 supplies the corrected image signal, that is, the image signal of the corrected gradation value, to the horizontal selector (HSEL) 120 through a signal line 209. It is to be noted that the ghosting correction section 200 in the first embodiment of the present invention is hereinafter described in detail with reference to FIGS. 10A to 19B and so forth.

The write scanner (WSCN) 110 carries out line sequential scanning of sequentially scanning the pixel circuits 600 to 605 in a unit of a row. The write scanner (WSCN) 110 controls the timing, at which a data signal supplied from a data line (DTL) 170 is to be written into the pixel circuits 600 to 605, in a unit of a row. Further, the write scanner (WSCN) 110 carries out line sequential scanning for the dummy pixel circuits of the dummy pixel array section 300 to control the timing, at which the data signal supplied from the data line (DTL) 170 is to be written into the dummy pixel circuits, in a unit of a row. The write scanner (WSCN) 110 produces an on potential for writing the data signal or an off potential for stopping writing of the data signal as a scanning signal. The write scanner (WSCN) 110 supplies the produced scanning signal to the scanning lines (WSL) 160.

The horizontal selector (HSEL) 120 supplies a data signal for setting the magnitude of the luminance of light to be emitted to the pixel circuits 600 to 605 of the pixel array section 140 and the dummy pixel circuits of the dummy pixel array section 300. The horizontal selector (HSEL) 120 includes a display pixel selector block 121 and a dummy pixel selector block 122.

The display pixel selector block 121 supplies a data signal for setting the magnitude of the luminance of light to be emitted from the pixel circuits 600 to 605 to the pixel circuits 600 to 605 in each column in synchronism with line sequential scanning by the write scanner (WSCN) 110. The horizontal selector (HSEL) 120 produces a potential, that is, a signal potential, of the image signal for setting the magnitude of the luminance of light to be emitted and another potential, that is, a reference potential, for carrying out correction of the threshold voltage, that is, threshold value correction, of a driving transistor which is a component of the pixel circuits 600 to 605, as a data signal. The horizontal selector (HSEL) 120 supplies the produced data signal to a data line (DTL) 170.

The dummy pixel selector block 122 supplies a data signal for setting the magnitude of the emitted light luminance of the dummy pixel circuits of the dummy pixel array section 300 in synchronism with line sequential scanning by the write scanner (WSCN) 110. The dummy pixel selector block 122 produces a signal potential or a reference potential to be supplied to the dummy pixels as a data signal in response to a light emission signal supplied from the dummy pixel light emitting signal production section 150. The dummy pixel selector block 122 supplies the produced data signal to the data line (DTL) 170.

The power supply scanner (DSCN) 130 produces a power supply signal for driving the pixel circuits 600 to 605 in a unit of a row in synchronism with line sequential scanning by the write scanner 110. The power supply scanner (DSCN) 130 produces a power supply potential for driving the pixel circuits 600 to 605 or an initialization potential for initializing the pixel circuits 600 to 605 as the power supply signal. Further, the power supply scanner (DSCN) 130 produces the power supply potential or the initialization potential as a power supply for the dummy pixel circuits similarly to the pixel circuits 600 to 605. The power supply scanner (DSCN) 130 supplies the produced power supply signal to a power supply line (DSL) 180.

The dummy pixel light emitting signal production section 150 produces a light emission signal for determining the magnitude of the luminance of light to be emitted from the dummy pixel circuits. The dummy pixel light emitting signal production section 150 produces a light emission signal corresponding to the luminance for measuring the degradation of the dummy pixels and supplies the produced light emission signal to the dummy pixel selector block 122. It is to be noted that the dummy pixel light emitting signal production section 150 is an example of an image signal supplying section.

The dummy pixel array section 300 includes the dummy pixel circuits. The dummy pixel array section 300 is hereinafter described in detail with reference to FIG. 9.

The pixel circuits 600 to 605 retain the potential of the image signal from the data lines (DTL) 170 based on a scanning signal from the scanning lines (WSL) 160 and emit light for a predetermined period of time in response to the retained potential. Here, an example of the configuration of the pixel circuits 600 to 605 is described with reference to FIG. 2.

Example of Configuration of Pixel Circuits

Figure 2:
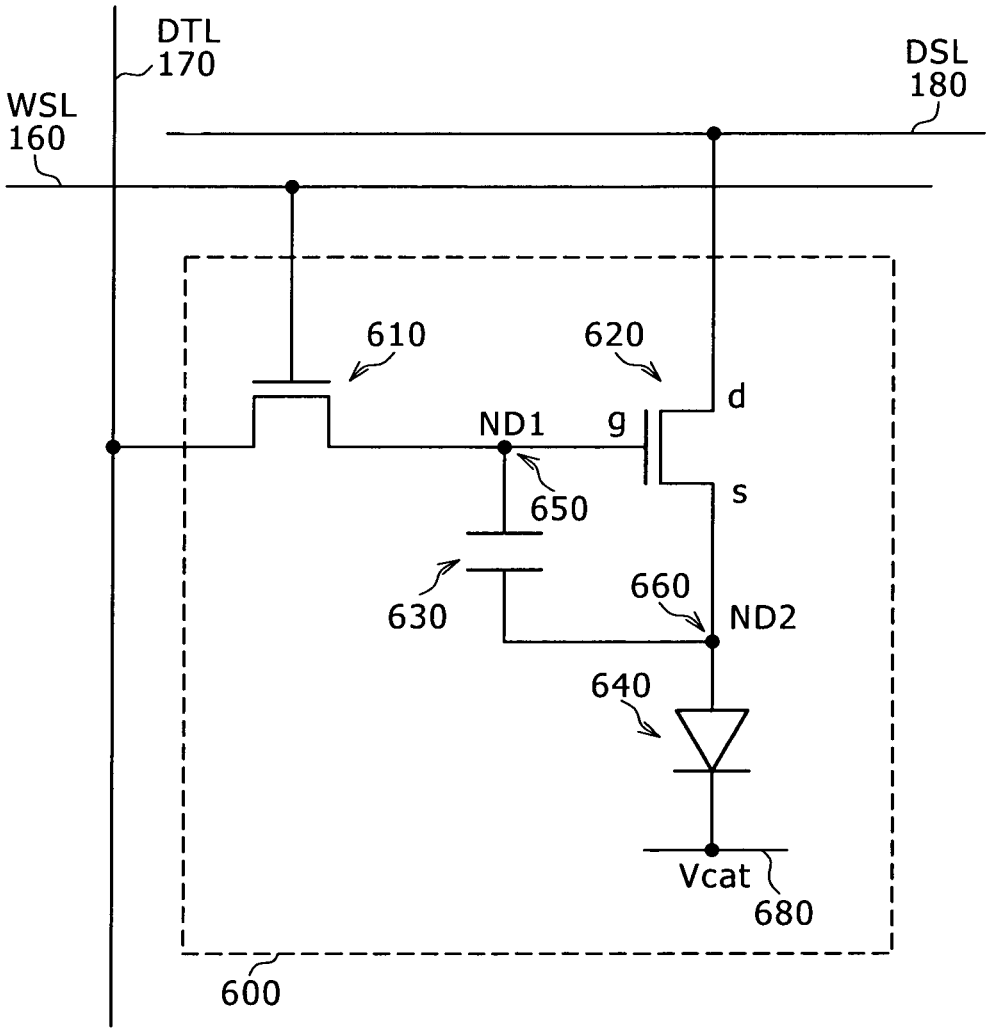
FIG. 2 is a circuit diagram schematically showing an example of a configuration of a pixel circuit of the display apparatus of FIG. 1.

FIG. 2 schematically shows an example of the configuration of the pixel circuits 600 to 605 in the first embodiment of the present invention. It is to be noted that the pixel circuits 600 to 605 have the same configuration, and therefore, in the following description given with reference to FIG. 2 and so forth, description is given principally of the pixel circuit 600 while description of the pixel circuits 601 to 605 is omitted herein.

Referring to FIG. 2, the pixel circuit 600 includes a write transistor 610, a driving transistor 620, a retaining capacitor 630, and a light emitting element 640. It is assumed here that each of the write transistor 610 and the driving transistor 620 is an n-channel transistor.

In the pixel circuit 600, a scanning line (WSL) 160 and a data line (DTL) 170 are connected to the gate terminal and the drain terminal of the write transistor 610, respectively. Further, the gate terminal (g) of the driving transistor 620 and one of electrodes, that is, one terminal, of the retaining capacitor 630 are connected to the source terminal of the retaining capacitor 630. Here, the connecting portion of them is represented as first node (ND1) 650. Meanwhile, a power supply line (DSL) 180 is connected to the drain terminal (d) of the driving transistor 620, and the other electrode or terminal of the retaining capacitor 630 and the anode electrode of the light emitting element 640 are connected to the source terminal (s) of the driving transistor 620. Here, the connecting portion is represented as second node (ND2) 660.

The write transistor 610 supplies a data signal from the data line (DTL) 170 to the first node (ND1) 650 in accordance with a scanning signal from the scanning line (WSL) 160. The write transistor 610 supplies a reference potential of the data signal to the one terminal of the retaining capacitor 630 in order to eliminate a dispersion of the threshold voltage of the driving transistor 620 of the pixel circuit 600. The reference potential here is a fixed potential used as a reference for causing a voltage corresponding to the threshold voltage of the driving transistor 620 into the retaining capacitor 630.

Further, the write transistor 610 successively writes, after the voltage corresponding to the threshold voltage of the driving transistor 620 is retained into the retaining capacitor 630, the signal potential of the data signal into the one terminal of the retaining capacitor 630.

The driving transistor 620 outputs driving current to the light emitting element 640 based on the signal voltage retained in the retaining capacitor 630 in response to the signal potential in order to drive the light emitting element 640 to emit light. The driving transistor 620 outputs driving current corresponding to the signal voltage retained in the retaining capacitor 630 to the light emitting element 640 in a state in which a power supply potential for driving the driving transistor 620 is applied from the power supply line (DSL) 180.

The retaining capacitor 630 retains a voltage corresponding to a data signal supplied thereto from the write transistor 610. In other words, the retaining capacitor 630 plays a role of retaining a signal voltage corresponding to the signal potential written therein by the write transistor 610.

The light emitting element 640 emits light in response to the magnitude of driving current outputted thereto from the driving transistor 620. The light emitting element 640 is connected at an output terminal thereof to the cathode line 680. From the cathode line 680, a cathode potential (Vcat) is supplied as a reference potential for the light emitting element 640. The light emitting element 640 can be implemented, for example, using an organic EL element.

It is to be noted that, while, in the present example, it is assumed that each of the write transistor 610 and the driving transistor 620 is an n-channel transistor, the combination of the types of the write transistor 610 and the driving transistor 620 is not limited to this. For example, each of the write transistor 610 and the driving transistor 620 may be a p-channel transistor. Further, the transistors mentioned may be of the enhancement type, the depletion type or the dual gate type.

Further, while an example of the configuration of the pixel circuit 600 wherein driving current is supplied from the two transistors 610 and 620 and the one retaining capacitor 630 to the light emitting element 640, the configuration of the pixel circuit is not limited to this. For example, any configuration can be applied only if it includes the driving transistor 620 and the light emitting element 640. For example, also in the case where the pixel circuit includes three or more transistors for controlling light emission, the pixel circuit can be applied if it includes the driving transistor 620 and the light emitting element 640. Now, an example of operation of the pixel circuit 600 described hereinabove is described in detail with reference to FIG. 3.

Example of Basic Operation of Pixel

Figure 3:
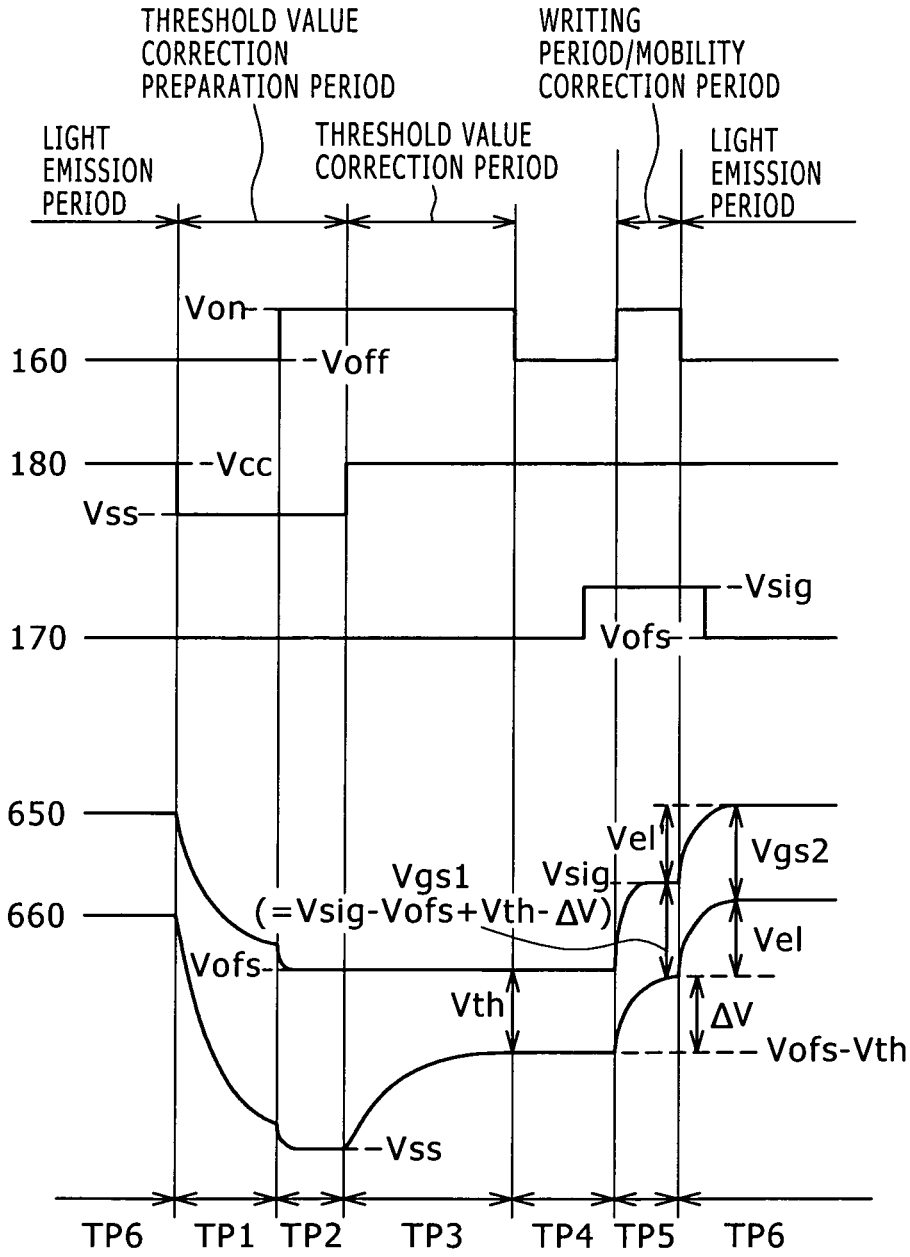
FIG. 3 is a timing chart illustrating an example of basic operation of the pixel circuit of FIG. 2.

FIG. 3 is a timing chart illustrating an example of basic operation of the pixel circuit 600 having the configuration described above with reference to FIG. 2. Referring to FIG. 3, the axis of abscissa is a common time axis, and potential variations of the scanning line (WSL) 160, power supply line (DSL) 180, data line (DTL) 170, first node (ND1) 650 and second node (ND2) 660 are illustrated. It is to be noted that the length of the axis of abscissa indicative of a time period is represented schematically but the ratio in time length among different time periods is not indicated.

In the timing chart of FIG. 3, the transition of operation of the pixel circuit 600 is divided into periods TP1 to TP6 for the convenience of illustration and description. First, within a light emission period TP6, the light emitting element 640 is in a light emitting state. Within this light emission period TP6, the potential of the scanning signal of the scanning line (WSL) 160 is set to an off potential (Voff). Further, within this light emission period TP6, the potential of the power supply signal of the power supply line (DSL) 180 is set to the power supply potential (Vcc).

Thereafter, a new field for line sequential scanning is entered, and within a threshold value correction preparation period TP1, the potential of the power supply line (DSL) 180 is set to an initialization potential (Vss) for initializing the second node (ND2) 660. Consequently, the potentials of the first node (ND1) 650 and the second node (ND2) 660 drop.

Then, within another threshold value correction preparation period TP2, the potential of the scanning line (WSL) 160 is set to an on potential (Von) so that the potential of the first node (ND1) 650 is initialized to the reference potential (Vofs). Consequently, the potential of the second node (ND2) 660 is initialized to the initialization potential (Vss). As the first node (ND1) 650 and the second node (ND2) 660 are individually initialized in this manner, preparations for threshold value correction operation are completed.

Then, within a threshold value correction period TP3, threshold value correction operation for correcting the threshold voltage of the driving transistor 620 of the pixel circuit 600 is carried out. At this time, the power supply voltage of the power supply line (DSL) 180 is set to the power supply potential (Vcc) so that a voltage (Vth) corresponding to the threshold voltage of the driving transistor 620 is retained between the first node (ND1) 650 and the second node (ND2) 660. In other words, the voltage (Vth) corresponding to the threshold voltage of the driving transistor 620 is retained in the retaining capacitor 630.

Thereafter, within a period TP4, after the potential of the scanning signal supplied to the scanning line (WSL) 160 changes to the off potential (Voff), the data signal of the data line (DTL) 170 is changed over from the reference potential (Vofs) to the signal potential (Vsig).

Then, within a writing period/mobility correction period TP5, writing operation of the image signal and mobility correction operation for carrying out correction of the mobility of the driving transistor 620 are carried out. At this time, the potential of the scanning signal of the scanning line (WSL) 160 is changed over to the on potential (Von), and consequently, the potential of the first node (ND1) 650 rises to the signal potential (Vsig). Consequently, the signal potential (Vsig) is written into the first node (ND1) 650 by the write transistor 610.

On the other hand, the potential of the second node (ND2) 660 rises by a rise amount (ΔV) according to the mobility of the driving transistor 620 which corresponds to the signal potential (Vsig) with respect to the threshold potential (Vofs−Vth) provided within the threshold value correction period TP3. In other words, as a result of the mobility correction operation, the potential of the second node (ND2) 660 rises by "ΔV."

In this manner, within the writing period/mobility correction period TP5, the signal potential (Vsig) is applied to the one terminal of the retaining capacitor 630 while the potential ((Vofs−Vth)+ΔV) which is a result of the addition of the rise amount (ΔV) to the threshold potential (Vofs−Vth) is applied to the other terminal of the retaining capacitor 630. In other words, the value "Vsig−((Vofs−Vth)+ΔV)" is retained as the signal voltage (Vgs1) according to the image signal in the retaining capacitor 630. In this manner, the signal voltage (Vsig−Vofs+Vth−ΔV) retained in the retaining capacitor 630 is corrected with the voltage (Vth) corresponding to the threshold voltage of the driving transistor 620 and the rise amount (ΔV) by the mobility correction operation. Therefore, a signal voltage from which an influence of a dispersion of the threshold voltage and the mobility of the driving transistor 620 for each pixel circuit 600 is eliminated is obtained.

Thereafter, within a subsequent light emission period TP6, the potential of the scanning signal of the scanning line (WSL) 160 is set to the off potential (Voff), and consequently, the first node (ND1) 650 is placed into a floating state. Then, the potential of the second node (ND2) 660 rises by an amount "Vel" with respect to the potential (Vofs−Vth+ΔV) given within the writing period/mobility correction period TP5. This potential rise amount "Vel" of the second node (ND2) 660 increases as the potential (Vsig) of the image signal rises. At this time, since the potential of the second node (ND2) 660 exceeds a light emission potential (Vthel+Vcat) which depends upon the threshold voltage (Vthel) of the light emitting element 640 and the cathode potential (Vcat) of the cathode line 680, the light emitting element 640 emits light.

On the other hand, also the potential of the first node (ND1) 650 rises by "Vel'" from the signal potential (Vsig) in such a manner as to follow up the potential rise of the second node (ND2) 660 by a coupling thereof through the retaining capacitor 630. Operation that the potential of the first node (ND1) 650 which is in a floating state rises by the coupling by the retaining capacitor 630 in response to the potential rise of the second node (ND2) 660 in this manner is called bootstrap operation.

In this bootstrap operation, the potential rise amount (Vel') of the first node (ND1) 650 is suppressed in comparison with the potential rise amount (Vel) of the second node (ND2) 660. The relationship between the potential rise amount (Vel) of the second node (ND2) 660 and the potential rise amount (Vel') of the first node (ND1) 650 can be represented by the following expression 1:

$$Vel'=Gb\times Vel \qquad \text{expression 1}$$

where Gb is a value lower than "1.0" and can be represented by the following expression 2. It is to be noted that Gb is a bootstrap gain.

$$Gb=Cs/(Cs+Cp) \qquad \text{expression 2}$$

where Cs is a capacitance value of the retaining capacitor 630, and Cp is the sum of parasitic capacitance between the gate and source terminals of the write transistor 610, that is, the write transistor gs parasitic capacitance, and the parasitic capacitance between the gate and drain terminals of the driving transistor 620, that is, the driving transistor gd parasitic capacitance. It is to be noted here that, as the parasitic capacitance which decreases the bootstrap gain Gb, only the write transistor gs parasitic capacitance and the driving transistor gd parasitic capacitance are taken into consideration.

From the expression 2, it can be recognized that, by the write transistor gs parasitic capacitance and the driving transistor gd parasitic capacitance, the bootstrap gain Gb comes to have a value lower than "1.0." This bootstrap gain Gb varies in response to the magnitude of the capacitance value Cp of the write transistor gs parasitic capacitance and the driving transistor gd parasitic capacitance. In other words, as the capacitance value Cp of the write transistor gs parasitic capacitance and the driving transistor gd parasitic capacitance increases, the bootstrap gain Gb decreases. Further, since the magnitude of the capacitance value Cp differs among the different pixel circuits 600 to 605, also the magnitude of the bootstrap gain Gb differs among the different pixel circuits 600 to 605.

In this manner, the bootstrap gain Gb has a value lower than "1.0" by the capacitance value Cp of the write transistor gs parasitic capacitance and the driving transistor gd parasitic capacitance. Therefore, the potential rise amount (Vel') of the first node (ND1) 650 is smaller than the potential rise amount (Vel) of the second node (ND2) 660. Consequently, the signal voltage (Vgs2) within the light emission period TP6 becomes lower by "Vel−Vel'=Ve·(1−Gb)" than the signal potential (Vgs1) within the writing period/mobility correction period TP6. It is to be noted that, intermediately of the light emission period TP5, the data signal of the data line (DTL) 170 is changed over from the signal potential (Vsig) to the reference potential (Vofs). Accordingly, within the light emission period TP6, the light emitting element 640 emits light with a luminance corresponding to the signal voltage (Vsig−Vofs+Vth−ΔV−(Vel−Vel')).

Details of Operation States of Pixel

Now, an example of transition of operation of the pixel circuit 600 described above is described in detail with reference to the accompanying drawings.

FIGS. 4A to 6 illustrate an example of transition of the operation of the pixel circuit 600 in the first embodiment of the present invention. In FIGS. 4A to 6 referred to in the following description, operation states of the pixel circuit 600 corresponding to the periods TP1 to TP6 of the timing chart shown in FIG. 3 are illustrated. Further, for the convenience of illustration, parasitic capacitance 641 of the light emitting element 640 is illustrated. Furthermore, the write transistor 610 is shown as a switch, and the scanning line (WSL) 160 is omitted.

Figure 4A:
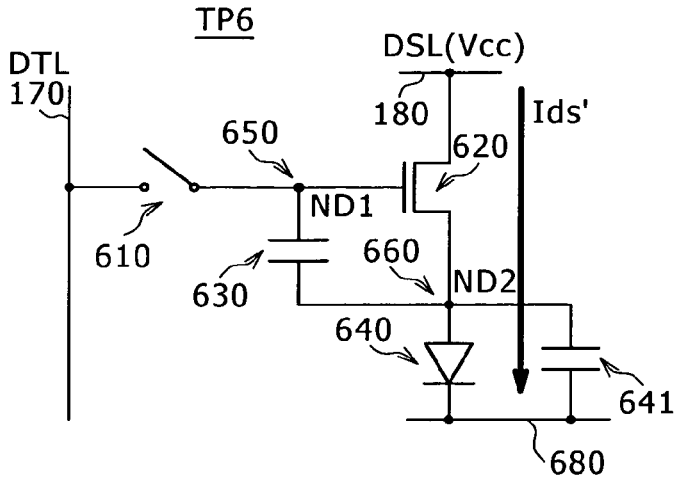
FIGS. 4A to 4C, 5A to 5C and 6 are schematic circuit diagrams illustrating different operation states of the pixel circuit of FIG. 2 within different periods.
Figure 4B:
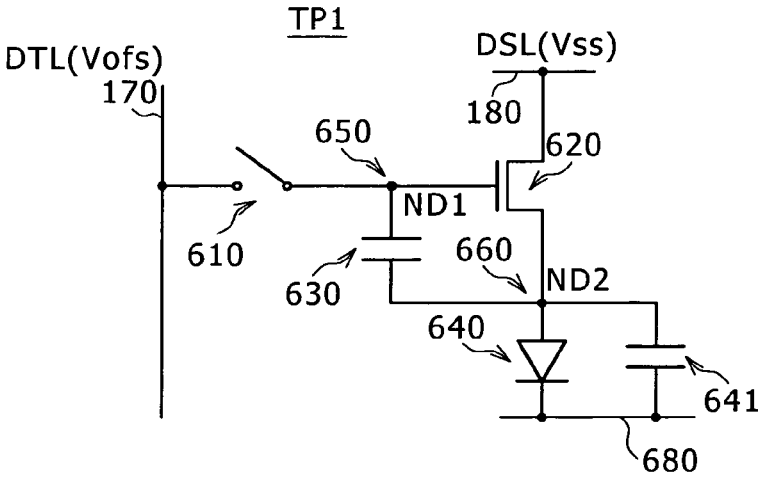
Figure 4C:
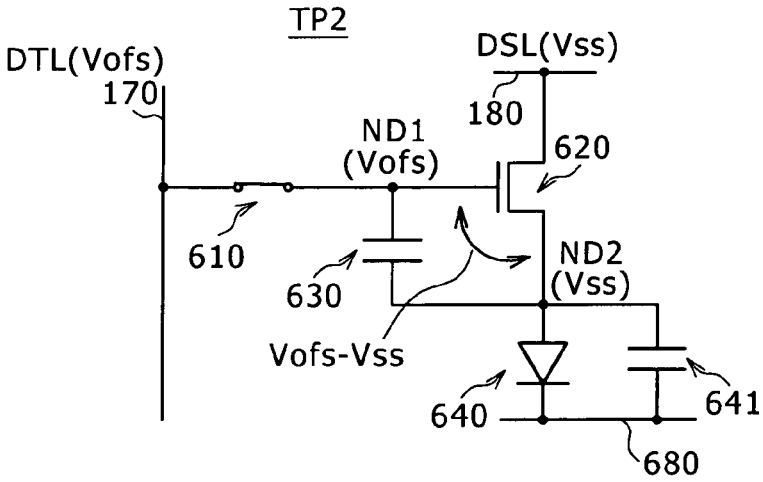

FIGS. 4A to 4C are schematic circuit diagrams illustrating operation states of the pixel circuit 600 corresponding to the periods TP6, TP1 and TP2, respectively. First, within the light emission period TP6, the write transistor 610 is in an off or non-conducting state and the power supply potential (Vcc) is applied from the power supply line (DSL) 180 to the driving transistor 620 as seen in FIG. 4A. Then, since driving current (Ids') is supplied from the driving transistor 620 to the light emitting element 640, the light emitting element 640 emits light with luminance corresponding to the driving current (Ids').

Then, within the threshold value correction preparation period TP1, the power supply signal of the power supply line (DSL) 180 changes from the power supply potential (Vcc) to the initialization potential (Vss) as seen in FIG. 4B. Consequently, since the potential of the second node (ND2) 660 drops, the light emitting element 640 is placed into a no-light emitting state. At this time, since the first node (ND1) 650 is in a floating state, also the potential of the first node (ND1) 650 drops in such a manner as to follow up the potential drop of the second node (ND2) 660.

Then, within the threshold value correction preparation period TP2, the potential of the scanning line (WSL) 160 (shown in FIG. 2) changes to the on potential (Von). Consequently, the write transistor 610 is placed into an on or conducting state as seen in FIG. 4C. As a result, the potential of the first node (ND1) 650 is initialized to the reference potential (Vofs) provided from the data line (DTL) 170.

On the other hand, the potential of the second node (ND2) 660 is initialized to the initialization potential (Vss) of the power supply line (DSL) 180. Consequently, the potential difference between the first node (ND1) 650 and the second node (ND2) 660 becomes "Vofs−Vss." It is to be noted here that it is assumed that the initialization potential (Vss) of the power supply line (DSL) 180 is set to a potential sufficiently lower than the reference potential (Vofs).

Figure 5A:
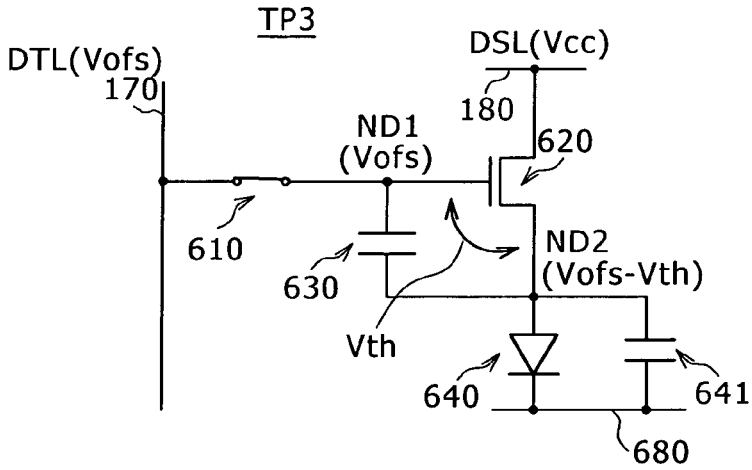
Figure 5B:
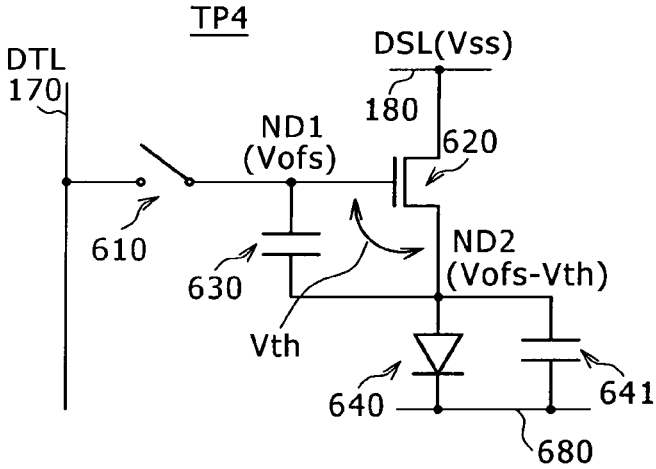
Figure 5C:
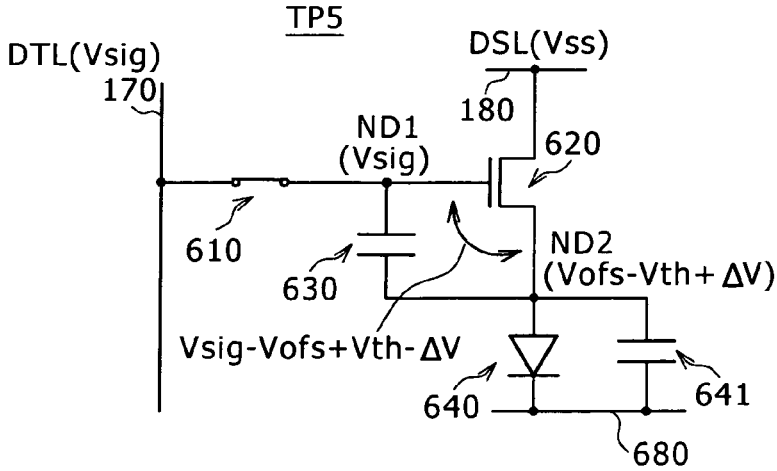

FIGS. 5A to 5C are schematic circuit diagrams illustrating operation states of the pixel circuit 600 corresponding to the periods TP3 to TP5, respectively.

Within the threshold value correction period TP3 next to the threshold value correction preparation period TP2, the power supply signal of the power supply line (DSL) 180 changes to the power supply potential (Vcc) as seen in FIG. 5A. Consequently, the driving transistor 620 is placed into an on state, and current is supplied from the driving transistor 620 to the second node (ND2) 660. As a result, the potential of the second node (ND2) 660 rises. In this instance, the potential of the second node (ND2) 660 rises until the potential difference between the first node (ND1) 650 and the second node (ND2) 660 becomes equal to the potential difference (Vth) which corresponds to the threshold voltage of the driving transistor 620.

The voltage (Vth) which corresponds to the threshold voltage of the driving transistor 620 is retained into the retaining capacitor 630 in such a manner as described above. In other words, this is the threshold value correction operation. It is to be noted that the cathode potential (Vcat) of the cathode line 680 and the reference potential (Vofs) from the data line (DTL) 170 are set in advance so that current may not flow from the driving transistor 620 to the light emitting element 640.

Thereafter, within the period TP4, the scanning signal supplied from the scanning line (WSL) 160 changes to the off potential (Voff) as seen in FIG. 5B, and the write transistor 610 is placed into an off state. Then, the potential of the data signal of the data line (DTL) 170 changes from the reference potential (Vofs) to the potential (Vsig) of the image signal. Here, the write transistor 610 is kept in an off state for a period of time until the data signal reaches the potential (Vsig) of the image signal taking a transient characteristic of the data line (DTL) 170 into consideration.

Thereafter, within the writing period/mobility correction period TP5, the potential of the scanning signal of the scanning line (WSL) 160 changes to the on potential (Von) as seen in FIG. 5C, and the write transistor 610 is placed into an on state. Consequently, the potential (Vsig) of the image signal is written into the one terminal of the retaining capacitor 630 by the write transistor 610, and as a result, the potential of the first node (ND1) 650 is set to the potential (Vsig) of the image signal.

At this time, since current which depends upon the mobility of the driving transistor 620 flows from the driving transistor 620 to the second node (ND2) 660, the retaining capacitor 630 and the parasitic capacitance 641 are charged and the potential of the second node (ND2) 660 rises. In particular, the potential of the second node (ND2) 660 rises by a rise amount (ΔV) according to the mobility of the driving transistor 620 with respect to the threshold potential (Vofs−Vth). In other words, this is the mobility correction operation.

Consequently, the signal voltage (Vgs1) which is the potential difference between the first node (ND1) 650 and the second node (ND2) 660 becomes "Vsig−Vofs+Vth−ΔV." In other words, the retaining capacitor 630 retains "Vsig−Vofs+Vth−ΔV" as the signal voltage (Vgs1).

Within the writing period/mobility correction period TP5, writing of the potential (Vsig) of the image signal and adjustment of the rise amount (ΔV) by the mobility correction are carried out in this manner. At this time, since the current from the driving transistor 620 increases as the potential (Vsig) of the image signal increases, also the rise amount (ΔV) by the mobility correction increases. Accordingly, mobility correction in response to the luminance level, that is, in response to the potential of the image signal, can be carried out.

Further, in the case where the potential (Vsig) of the image signals to the pixel circuits 600 to 605 is fixed, that one of the pixel circuits 600 to 605 in which the mobility of the driving transistor 620 is high exhibits a great rise amount (LV) as a result of the mobility correction. In particular, in that one of the pixel circuits 600 to 605 in which the mobility of the driving transistor 620 is high, the current from the driving transistor 620 is higher than another one of the pixel circuits 600 to 605 in which the mobility of the driving transistor 620 is lower, and the gate-source voltage of the driving transistor 620 decreases as much. Accordingly, in the pixel circuit 600 in which the mobility of the driving transistor 620 is high, the driving current outputted from the driving transistor 620 is adjusted to a magnitude substantially equal to that of the pixel circuits 601 to 605 in which the mobility of the driving transistor 620 is lower. The dispersion of the mobility of the driving transistor 620 for each of the pixel circuits 600 to 605 is removed in this manner.

Figure 6:
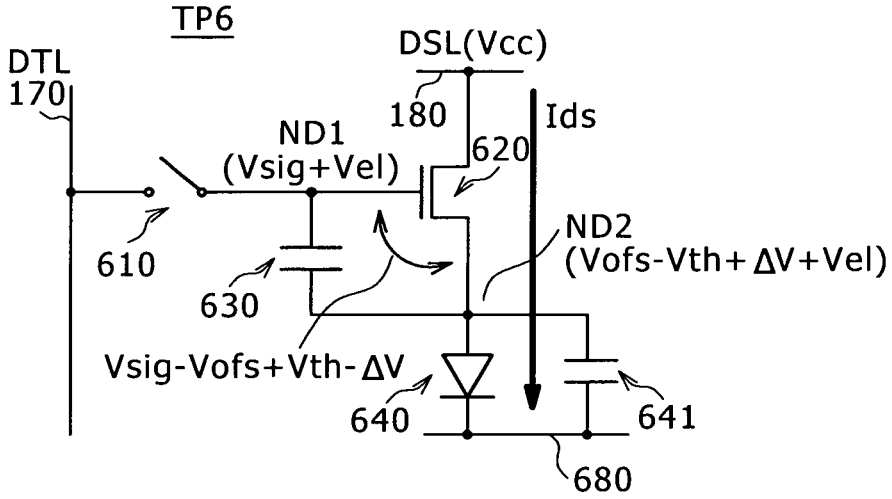

FIG. 6 is a schematic circuit diagram illustrating an operation state of the pixel circuit 600 corresponding to the period TP6.

Within the light emission period TP6, the potential of the scanning signal supplied from the scanning line (WSL) 160 changes to the off potential (Voff), and consequently, the write transistor 610 is placed into an off state. Then, the potential of the second node (ND2) 660 rises by a potential (Vel) according to the magnitude of the driving current from the driving transistor 620 with respect to the potential (Vofs−Vth+ΔV) given within the writing period/mobility correction period TP6.

In contrast, the potential of the first node (ND1) 650 rises at a rate given by the expression 1 by the bootstrap operation by the retaining capacitor 630. The potential rise amount (Vel') of the first node (ND1) 650 at this time is a value obtained by multiplying the potential rise amount (Vel) of the second node (ND2) 660 by the bootstrap gain Gb which is lower than "1.0." In particular, since the potential rise amount (Vel') of the first node (ND1) 650 is suppressed in response to the capacitance value Cp of the write transistor gs parasitic capacitance and the driving transistor gd parasitic capacitance, it is smaller than the potential rise amount (Vel) of the second node (ND2) 660.

Consequently, the signal voltage (Vgs2) which is a potential difference between the first node (ND1) 650 and the second node (ND2) 660 is lower by "Vel−Vel'" than the signal potential (Vgs1) at a point of time immediately prior to the end of the writing period/mobility correction period TP5. In other words, the signal voltage (Vgs2) at the point of time immediately prior to the end of the light emission period TP6 becomes "Vgs1−(Vel−Vel')" which is lower than the signal voltage (Vgs1) within the writing period/mobility correction period TP5. Accordingly, the light emitting element 640 emits light with luminance according to driving current Ids corresponding to the signal voltage (Vgs2) within the light emission period TP6.

As described hereinabove with reference to FIGS. 3 to 6, the pixel circuit 600 of the display apparatus 100 in the first embodiment of the present invention emits, when driving current corresponding to the signal potential supplied through the data line (DTL) 170 is supplied to the light emitting element 640, light with luminance according to the driving current. In particular, if the light emitting element 640 or the like which configures the pixel circuit 600 degrades, then the value of the luminance according to the signal potential is displaced from the initial state by a variation of the amount of emitted light or the like. If this displacement occurs by an equal amount with all pixel circuits, then a phenomenon that an image which has been displayed immediately before then looks remaining, that is, a ghosting phenomenon, does not occur.

However, since an organic EL element represents a gradation by varying the amount of light to be emitted in response to image data to be displayed, the degree of degradation of the organic EL element differs among different pixel circuits of the display screen. Therefore, as the display of a pixel circuit which suffers much from degradation becomes darker than the display of surrounding pixel circuits, a ghosting phenomenon occurs.

Example of Degradation of Pixel Circuit

Now, a characteristic of degradation of a pixel circuit in the first embodiment of the present invention is described with reference to FIGS. 7 and 8.

Figure 7:
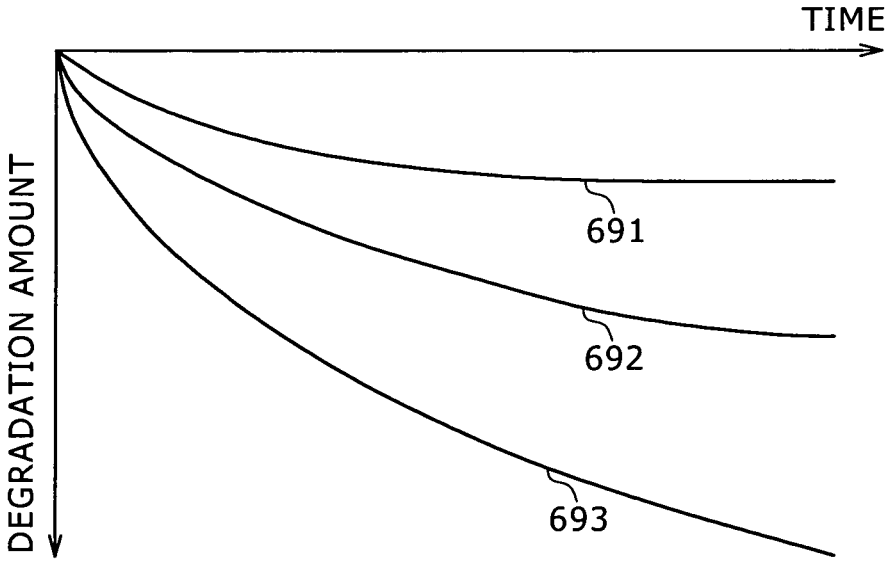
FIG. 7 is a diagram illustrating a relationship between the time of use and the degradation amount of the luminance of the pixel circuit of FIG. 2 when the pixel circuit is driven to emit light with an image signal of a predetermined gradation value.

FIG. 7 illustrates a relationship between the period of time of use of the pixel circuit 600 driven to emit light with an image signal of a predetermined gradation value and the degradation amount of the luminance of the pixel circuit in the first embodiment of the present invention.

In FIG. 7, the axis of ordinate indicates the degradation amount of the luminance, that is, the luminance degradation amount, of the pixel circuit 600, and the axis of abscissa indicates the period of time of use of the pixel circuit 600, that is, the light emission time period. FIG. 7 thus illustrates three degradation characteristics, that is, degradation characteristics 691 to 693. It is to be noted that, in FIG. 7, it is assumed that the temperatures of the pixel circuit 600 at which the three degradation characteristics are exhibited are equal to each other.

The degradation characteristic (gradation value 100) 691 is a characteristic indicating degradation of the pixel circuit 600 which emits light with the image signal having the gradation value "100." The degradation characteristic (gradation value 100) 691 indicates that the degradation based on the image signal of the gradation value "100" proceeds suddenly immediately after start of use but proceeds moderately after the light emission time elapses after the start of use.

The degradation characteristic (gradation value 150) 692 is a characteristic indicating degradation of the pixel circuit 600 which emits light with the image signal having the gradation value "150." The degradation characteristic (gradation value 150) 692 indicates that the degradation proceeds more suddenly than that of the pixel circuit 600 in the case where it is driven to emit light with the image signal of the gradation value "100."

The degradation characteristic (gradation value 200) 693 is a characteristic indicating degradation of the pixel circuit 600 which emits light with the image signal having the gradation value "200." The degradation characteristic (gradation value 200) 693 indicates that the degradation proceeds more suddenly than that of the pixel circuit 600 in the case where it is driven to emit light with the image signal of the gradation value "150."

As seen in FIG. 7, if the pixel circuit 600 is driven to emit light with the image signal of a low gradation value, then degradation thereof proceeds moderately, but if it is driven to emit light with the image signal of a high gradation value, then degradation thereof proceeds quickly. Further, the degradation of the pixel circuit 600 proceeds suddenly immediately after use of the pixel circuit 600 is started, but proceeds moderately after the light emission time elapses after the start of use.

Figure 8:
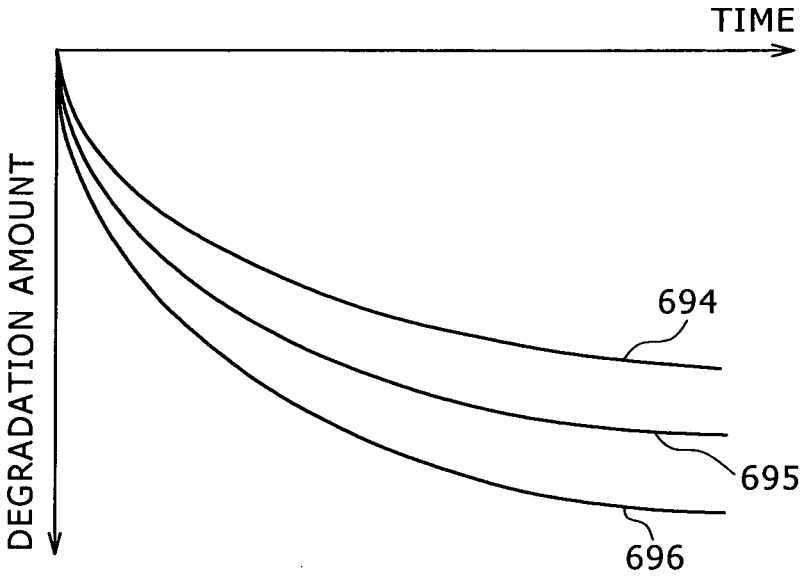
FIG. 8 is a diagram illustrating a relationship between the time of use and the degradation amount of the luminance of the pixel circuit of FIG. 2 when the pixel circuit is driven to emit light in a predetermined temperature condition.

FIG. 8 is a view illustrating a relationship between the period of time of use of the pixel circuit 600 and the degradation amount of the luminance of the pixel circuit 600 in the case where the pixel circuit 600 is driven to emit light in a predetermined temperature condition in the first embodiment of the present invention.

In FIG. 8, the axis of ordinate indicate the degradation amount of the luminance, that is, the luminance degradation amount, of the pixel circuit 600, and the axis of abscissa indicates the period of time of use, that is, the light emission time, of the pixel circuit 600. FIG. 8 thus illustrates three degradation characteristics 694 to 696. It is to be noted that, in FIG. 8, it is assumed that the gradation values of the image signal supplied to the pixel circuit 600 at which the three degradation characteristics are exhibited are equal to each other.

The degradation characteristic (temperature 20° C.) 694 indicates degradation of the pixel circuit 600 in the case where it is driven to emit light under the temperature condition "20° C." The degradation characteristic 694 (temperature 20° C.) indicates that the degradation proceeds suddenly immediately after start of use but proceeds moderately after the light emission time elapses after the start of use similarly to the three degradation characteristics 691 to 693 described hereinabove with reference to FIG. 7.

The degradation characteristic (temperature 30° C.) 695 is a characteristic indicating degradation of the pixel circuit 600 in the case where it is driven to emit light under the temperature condition "30° C." The degradation characteristic (temperature 30° C.) 695 indicates that the degradation proceeds more suddenly than that of the pixel circuit 600 in the case where it is driven to emit light under the temperature condition "20° C."

The degradation characteristic (temperature 40° C.) 696 is a characteristic indicating degradation of the pixel circuit 600 in the case where it is driven to emit light under the temperature condition "40° C." The degradation characteristic (temperature 40° C.) 696 indicates that the degradation proceeds more suddenly than that of the pixel circuit 600 in the case where it is driven to emit light under the temperature condition "30° C."

As seen in FIG. 8, if the pixel circuit 600 is driven to emit light under a low temperature condition, then degradation thereof proceeds moderately. On the other hand, if the pixel circuit 600 is driven to emit light under a high temperature condition, then degradation thereof proceeds suddenly.

In other words, the difference in temperature participates in difference in the proceeding speed of degradation of the pixel circuit 600. Therefore, in the first embodiment of the present invention, an example of a display apparatus wherein degradation of the luminance measured using a dummy pixel is corrected based on temperature information of the display apparatus to correct ghosting is described.

Example of Configuration of Dummy Pixel Array Section

Figure 9:
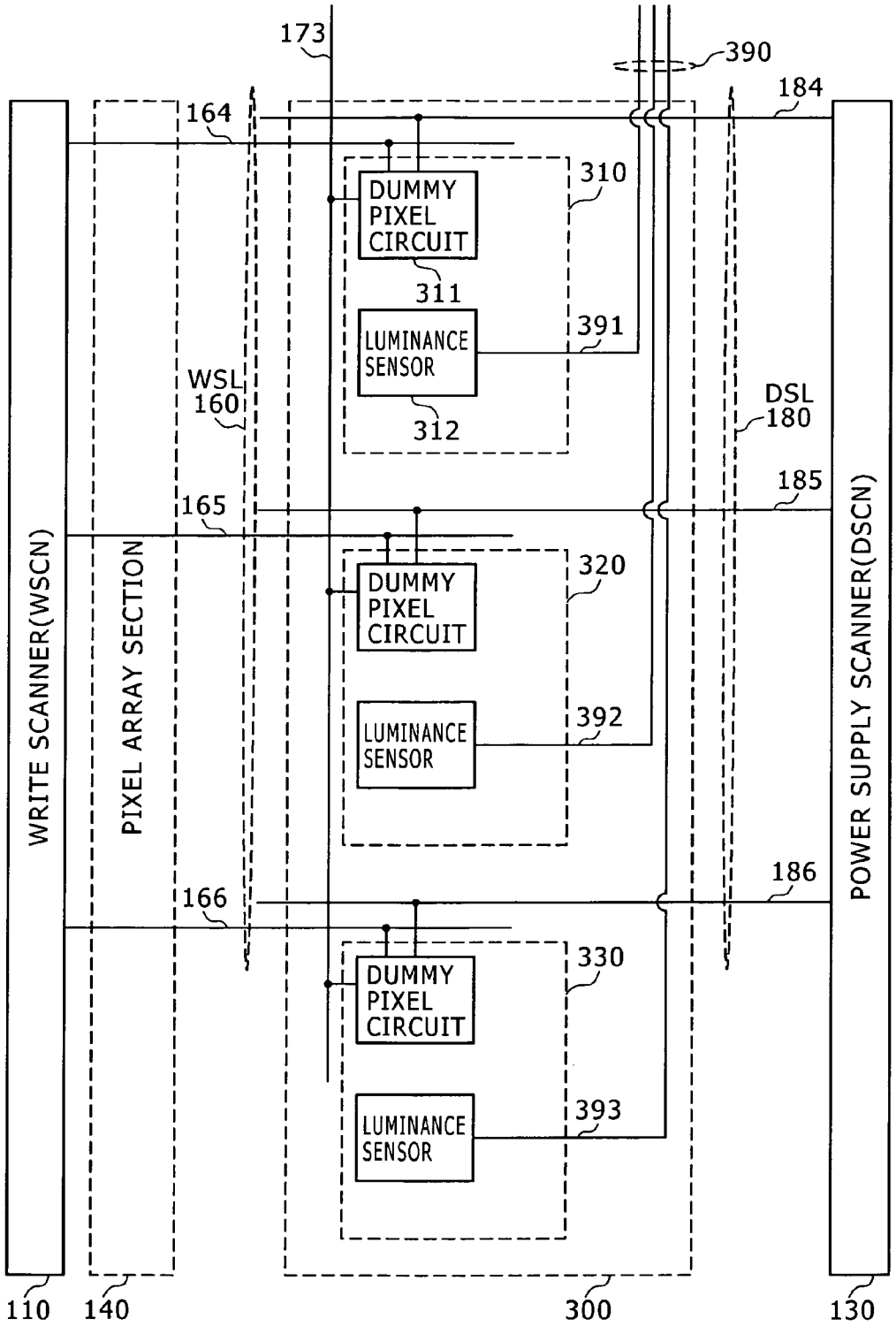
FIG. 9 is a block diagram showing an example of a configuration of a dummy pixel array section shown in FIG. 1.

FIG. 9 shows an example of the configuration of the dummy pixel array section 300 in the first embodiment of the present invention. It is to be noted that, in the first embodiment of the present invention, degradation of a pixel circuit based on a light emission signal of three gradation values is measured.

Referring to FIG. 9, the dummy pixel array section 300, write scanner (WSCN) 110, pixel array section 140 and power supply scanner (DSCN) 130 are shown. Further, scanning lines (WSL) 164 to 166 are shown as the scanning lines (WSL) 160 connected to the dummy pixel array section 300, and a data line (DTL) 173 is shown as the data line (DTL) 170 connected to the dummy pixel array section 300. Further, power supply lines (DSL) 184 to 186 are shown as the power supply lines (DSL) 180 connected to the dummy pixel array section 300. Further, signal lines 391 to 393 are shown as the signal lines 390 which connect the dummy pixel array section 300 and the ghosting correction section 200. Description is given paying attention to the dummy pixel array section 300 in FIG. 9.

The dummy pixel array section 300 is a region in which dummy pixel circuits which are not actually used for display but are used for measurement of the degree of degradation of the pixel circuits are disposed. The dummy pixel array section 300 is formed at a place of, for example, an array substrate at which no display is carried out such as a position at which the array substrate is hidden by the frame. The dummy pixel array section 300 includes luminance detection units 310, 320 and 330. It is to be noted that the luminance detection units 310, 320 and 330 are disposed in a column.

The luminance detection units 310, 320 and 330 are used to measure degradation of a pixel circuit based on an light emission signal of a predetermined gradation value. The luminance detection units 310, 320 and 330 include one dummy pixel circuit and one luminance sensor. It is to be noted that the luminance detection units 320 and 330 have the same configuration as the luminance detection unit 310, and therefore, description of a dummy pixel circuit 311 and a luminance sensor 312 of the luminance detection unit 310 is given below.

The dummy pixel circuit 311 retains a potential of an image signal from a data line (DTL) 170 based on a scanning signal from a scanning line (WSL) 160 and emits light for a predetermined period of time in response to the retained potential similarly to the pixel circuit 600 described hereinabove with reference to FIGS. 2 to 8. The scanning line (WSL) 164, data line (DTL) 173 and power supply line (DSL) 184 are connected to the dummy pixel circuit 311. It is to be noted that, in the first embodiment of the present invention, the dummy pixel circuit 311 has a configuration similar to that of the pixel circuit 600 described hereinabove with reference to FIG. 2. Also it is to be noted that the dummy pixel circuit 311 is an example of a particular pixel circuit.

The dummy pixel circuit 311 emits light only with a particular gradation value. For example, the dummy pixel circuit 311 of the luminance detection unit 310 emits light with a gradation value "200," and the dummy pixel circuit of the luminance detection unit 320 emits light with another gradation value "150" while the dummy pixel circuit of the luminance detection unit 330 emits light with a further gradation value "100."

The luminance sensor 312 is used to measure the luminance of the dummy pixel circuit 311. The luminance sensor 312 is disposed in the proximity of the dummy pixel circuit 311 in order to receive only emitted light of the dummy pixel circuit 311 and is isolated from external light together with the dummy pixel circuit 311 so that it may not receive light from the outside. The luminance sensor 312 supplies information regarding the luminance of the dummy pixel, that is, dummy pixel luminance information, to the ghosting correction section 200 through the signal line 391.

By providing the dummy pixel array section 300 in this manner, degradation of the luminance of a pixel circuit by light emission based on a predetermined luminance value, that is, luminance degradation, can be measured in a temperature conduction similar to that of the pixel circuit 600 for displaying an image.

It is to be noted that, while three luminance detection units are shown in FIG. 9, the present invention is not limited to this. The number of gradation values with which degradation is to be measured can be increased, for example, by increasing the number of luminance detection units to increase the number of gradation values to be measured.

Further, while, in FIG. 9, the luminance detection units are arrayed in a column and the scanning lines (WSL), data lines (DTL) and power supply lines (DSL) 184 for the dummy pixel array section 300 are disposed, the present invention is not limited to this. For example, the signal lines of the pixel array section 140 may be used commonly to achieve simplification of the circuitry.

Example of Disposition of Luminance Sensors and Dummy Pixel Circuits

Figure 10A:
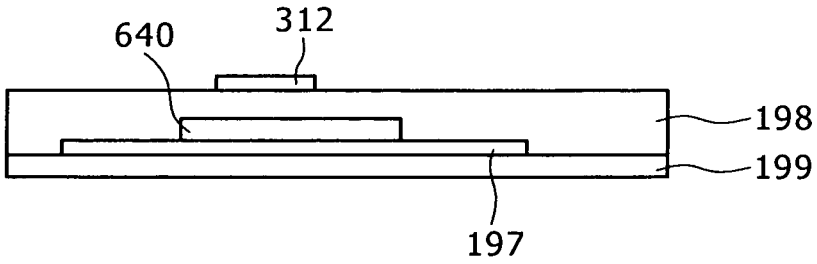
FIGS. 10A and 10B are a sectional view and a plan view, respectively, schematically showing an example of a position of a luminance sensor with respect to a dummy pixel circuit shown in FIG. 9.
Figure 10B:
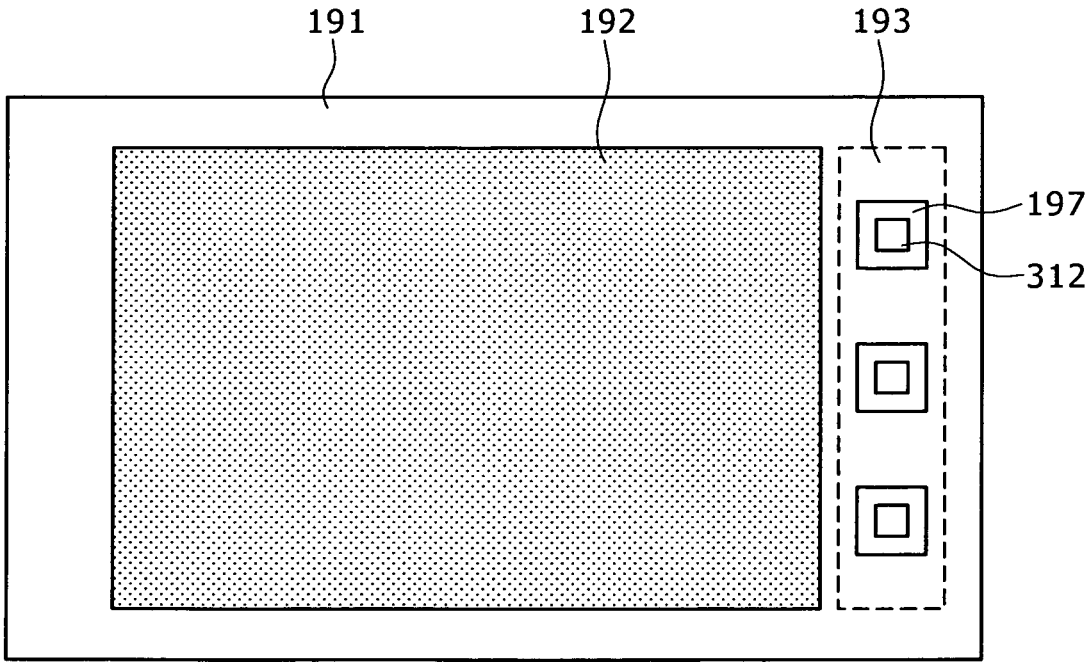

FIGS. 10A and 10B are a sectional view and a plan view, respectively, schematically showing an example of a disposition configuration of the dummy pixel circuits 311 and the luminance sensors 312 in the first embodiment of the present invention.

FIG. 10A schematically shows a sectional configuration of the luminance sensor 312 and the dummy pixel circuit 311. In FIG. 10A, a light emitting element 640 and a TFT (Thin Film Transistor) pixel circuit 197 are shown as circuits which configure the dummy pixel circuit 311. Further, in FIG. 10A, a luminance sensor 312, resin 198 and glass 199 are shown. For example, the TFT pixel circuit 197 is disposed on the glass 199, and the light emitting element 640 is disposed on the TFT pixel circuit 197. Further, the light emitting element 640 is covered with the resin 198, and the luminance sensor 312 is disposed on the resin 198. In other words, the luminance sensor 312 is disposed on the light emitting element 640 with the resin 198 interposed therebetween.

As seen in FIG. 10A, the luminance sensor 312 is disposed at a position at which it can receive light from the light emitting element 640 efficiently.

FIG. 10B shows an example of a disposition configuration of the luminance sensor 312 and the dummy pixel circuit 311 of a display unit including the display apparatus 100 in the inside of the display unit. Further, in FIG. 10B, a frame region 191 which is a frame section of the display unit and a display region 192 which is a section for displaying a screen image are shown. Further, a dummy pixel region 193, the TFT pixel circuits 197 and the luminance sensors 312 are shown in the frame region 191.

As seen in FIG. 10B, the luminance sensors and the dummy pixel circuits are disposed in a region of the display unit or the like which is not used for display.

Example of Configuration of Ghosting Correction Section

Figure 11:
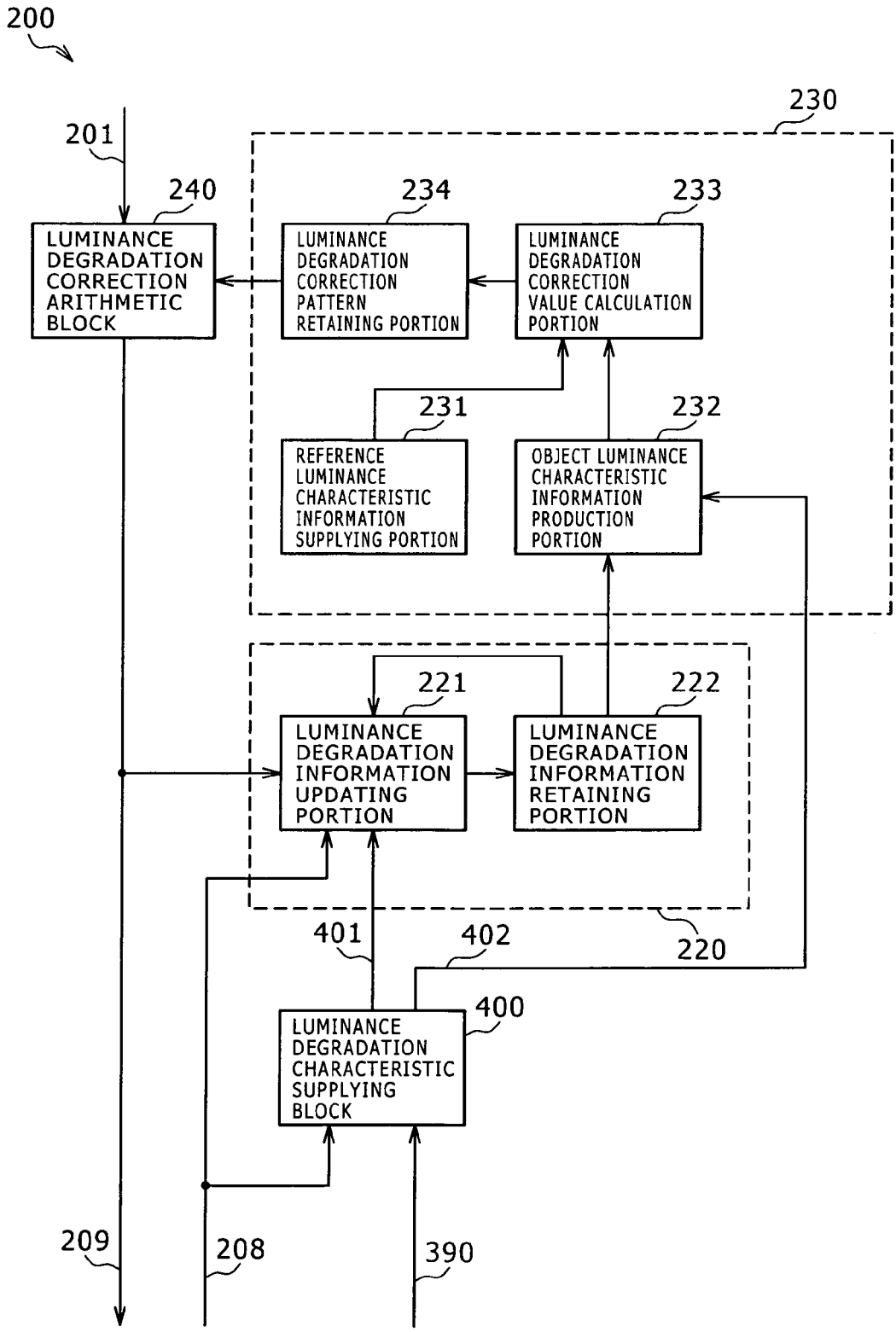
FIG. 11 is a block diagram showing an example of a functional configuration of a ghosting correction section shown in FIG. 1.

FIG. 11 is a block diagram showing an example of a functional configuration of the ghosting correction section 200 in the first embodiment of the present invention. Referring to FIG. 11, the ghosting correction section 200 includes a luminance degradation information integration block 220, a luminance degradation correction pattern production block 230, a luminance degradation correction arithmetic block 240 and a luminance degradation characteristic supplying block 400.

Here, in the first embodiment of the present invention, it is assumed that the luminance of a pixel circuit in an initial state in which it does not suffer from any degradation is used as a reference for correction, and an image signal is corrected so that the luminance of the pixel circuits 600 to 605 which suffer from degradation may coincide with the reference.

Further, it is assumed that the ghosting correction section 200 in the first embodiment of the present invention updates information retained in the luminance degradation information integration block 220 by acquiring a corrected image signal for each frame at intervals of time of one minute for the convenience of description. Furthermore, it is assumed that the luminance degradation correction pattern production block 230 produces a new correction pattern every time information retained in the luminance degradation information integration block 220 is updated for the convenience of description.

The luminance degradation characteristic supplying block 400 produces a luminance characteristic from a luminance of a dummy pixel circuit and supplies the produced luminance characteristic. In particular, the luminance degradation characteristic supplying block 400 produces a degradation characteristic for each temperature and for each luminance based on temperature information supplied from the temperature sensor 141 through the signal line 208 and dummy pixel luminance information supplied from the luminance sensor 312 through the signal line 390. The luminance degradation characteristic supplying block 400 supplies the produced degradation characteristic to the luminance degradation information integration block 220 through a signal line 401. Further, the luminance degradation characteristic supplying block 400 supplies the produced degradation characteristic to the luminance degradation correction pattern production block 230 through a signal line 402. It is to be noted that the luminance degradation characteristic supplying block 400 is an example of a luminance degradation characteristic production portion.

The luminance degradation information integration block 220 retains information regarding degradation of the luminance, that is, luminance degradation information, based on the degradation of the pixel circuits 600 to 605 and successively updates the luminance degradation information. Further, the luminance degradation information integration block 220 successively adds a new amount of the degradation regarding the luminance degradation of the pixel circuits 600 to 605 to the relevant luminance degradation information to update the luminance degradation information. Here, the luminance degradation information is a value, for example, obtained by converting the amount of luminance degradation of the pixel circuits 600 to 605 into a period of time of light emission by an image signal of a particular gradation value. The luminance degradation information integration block 220 includes a luminance degradation information updating portion 221 and a luminance degradation information retaining portion 222. It is to be noted that the luminance degradation information integration block 220 is an example of an addition section. Further, the luminance degradation characteristic supplying block 400 and the luminance degradation information integration block 220 are an example of a luminance degradation information production section.

The luminance degradation information updating portion 221 updates luminance degradation information retained in the luminance degradation information retaining portion 222 by adding a new amount of degradation of the luminance of the pixel circuits 600 to 605. In particular, the luminance degradation information updating portion 221 calculates information regarding new degradation of the luminance of the pixel circuits 600 to 605 using a degradation characteristic supplied from the signal line 401, for example, based on a corrected image signal supplied from the luminance degradation correction arithmetic block 240.

The luminance degradation information updating portion 221 successively adds the information regarding the new degradation to the luminance degradation information to produce updated luminance degradation information. The luminance degradation information updating portion 221 supplies the updated luminance degradation information to the luminance degradation information retaining portion 222. It is to be noted that an example of production of updated luminance degradation information is hereinafter described in detail with reference to FIG. 16.

The luminance degradation information retaining portion 222 retains luminance degradation information and particularly retains luminance degradation information of each of the pixel circuits 600 to 605. Further, the luminance degradation information retaining portion 222 successively retains, every time luminance degradation information updated by the luminance degradation information updating portion 221 is supplied, the updated luminance degradation information. The luminance degradation information retaining portion 222 supplies the luminance degradation information retained therein to the luminance degradation information updating portion 221 and the luminance degradation correction pattern production block 230. It is to be noted that an example of the luminance degradation information is hereinafter described with reference to FIG. 17.

The luminance degradation correction pattern production block 230 produces a pattern for correcting luminance degradation, that is, a luminance degradation correction pattern. The luminance gradation correction pattern is a correction pattern configured from correction values for luminance degradation, that is, from luminance degradation correction values, for the pixel circuits 600 to 605 and is correction information for correcting luminance degradation. The luminance degradation correction pattern production block 230 includes a reference luminance characteristic information supplying portion 231, a object luminance characteristic information production portion 232, a luminance degradation correction value calculation portion 233, and a luminance degradation correction pattern retaining portion 234. It is to be noted that the luminance degradation correction pattern production block 230 is an example of a luminance degradation value calculation section.

The reference luminance characteristic information supplying portion 231 supplies luminance characteristic information regarding a pixel circuit to be used as a reference for correction of luminance degradation as reference luminance characteristic information. The luminance characteristic information is information regarding a characteristic of a correlation, that is, a luminance characteristic, between an image signal supplied to a pixel circuit and a luminance of emitted light based on the image signal. For example, the reference luminance characteristic information supplying portion 231 retains, in the first embodiment of the present invention, luminance characteristic information regarding a pixel circuit in a state in which it does not suffer from degradation, that is, in an initial state. Then, the reference luminance characteristic information supplying portion 231 supplies the luminance characteristic information retained therein as reference luminance characteristic information to the luminance degradation correction value calculation portion 233. It is to be noted that an example of the luminance characteristic, luminance characteristic information and reference luminance characteristic information is hereinafter described with reference to FIGS. 18A and 18B.

The object luminance characteristic information production portion 232 supplies luminance characteristic information of a pixel circuit which is an object of production of a luminance degradation correction value as object luminance characteristic information. For example, the object luminance characteristic information production portion 232 successively acquires luminance degradation information regarding the pixel circuits 600 to 605 from the luminance degradation information retaining portion 222. Then, for example, if light emission time at a particular gradation value is luminance degradation information, then the object luminance characteristic information production portion 232 uses the degradation characteristic supplied thereto from the luminance degradation characteristic supplying block 400 to calculate the degradation amount of the pixel circuit from the acquired luminance degradation information. Then, the object luminance characteristic information production portion 232 calculates luminance characteristic information from the acquired degradation information using, for example, an expression representative of a correlation between the degradation amount and an efficiency coefficient. Then, the object luminance characteristic information production portion 232 supplies the calculated luminance characteristic information as object luminance characteristic information to the luminance degradation correction value calculation portion 233. It is to be noted that an example of the object luminance characteristic information is hereinafter described with reference to FIGS. 18A and 18B.

The luminance degradation correction value calculation portion 233 calculates a luminance degradation correction value for each of the pixel circuits 600 to 605 based on the reference luminance characteristic information and the object luminance characteristic information in order to produce a luminance degradation correction pattern. Particularly, the luminance degradation correction value calculation portion 233 calculates a luminance degradation correction value, for example, by division wherein the object luminance characteristic information is the numerator and the reference luminance characteristic information is the denominator. The luminance degradation correction value calculation portion 233 produces the luminance degradation correction value for all of the pixel circuits 600 to 605. The luminance degradation correction value calculation portion 233 supplies the produced luminance degradation correction values to the luminance degradation correction pattern retaining portion 234. It is to be noted that the luminance degradation correction value is hereinafter described with reference to FIGS. 18A and 18B.

The luminance degradation correction pattern retaining portion 234 retains the luminance degradation correction values supplied thereto from the luminance degradation correction value calculation portion 233 for the individual pixel circuits. The luminance degradation correction patterns regarding the pixel circuits are hereinafter referred to as luminance degradation correction pattern. The luminance degradation correction pattern retaining portion 234 supplies the luminance degradation correction pattern retained therein to the luminance degradation correction arithmetic block 240. It is to be noted that an example of the luminance degradation conversion pattern is hereinafter described with reference to FIG. 17.

The luminance degradation correction arithmetic block 240 changes the gradation value of an image signal inputted thereto through the signal line 201 based on a luminance degradation correction pattern supplied thereto from the luminance degradation correction pattern retaining portion 234 to correct the luminance degradation. Further, the luminance degradation correction arithmetic block 240 supplies the image signal whose gradation value is corrected, that is, the correction gradation value, to the luminance degradation information integration block 220 and the horizontal selector (HSEL) 120 through the signal line 209. It is to be noted that an example of the contents of correction of the luminance degradation correction arithmetic block 240 is hereinafter described in detail with reference to FIGS. 18A and 18B. It is to be noted that the luminance degradation correction arithmetic block 240 is an example of a correction section.

In this manner, by providing the luminance degradation characteristic supplying block 400 in the ghosting correction section 200, dummy pixel luminance information supplied from the luminance sensor 312 is used to correct degradation of the luminance based on the degradation of the pixel circuit.

It is to be noted here that, while information retained in the luminance degradation information integration block 220 is updated by acquiring an image signal, which is corrected in regard to each frame, at intervals of one minute, the present invention is not limited to this. For example, the corrected image signal may be acquired at intervals of ten minutes to update the luminance degradation information by assuming that the pixel circuit emits light for ten minutes with the acquired image signal. By setting the updating interval of luminance degradation information to a comparatively long period of time in this manner, the calculation amount can be further reduced. Also it seems a possible idea to set the acquisition interval by the luminance degradation information integration block 220 of the image signal corrected with regard to each frame shorter to update the luminance degradation information with a higher degree of accuracy.

Further, while the luminance degradation correction pattern production block 230 updates the retained luminance degradation correction pattern every time the luminance degradation information is updated, the present invention is not limited to this. For example, the luminance degradation correction pattern is not updated to a different pattern suddenly by updating after a short interval of time. This is because, even if the luminance disperses among different pixel circuits, degradation proceeds slowly. Therefore, it seems a possible idea to reduce the calculation amount, for example, by acquiring the luminance degradation information at intervals of one hour and updating the correction pattern at intervals of one hour based on the acquired information.

Further, while it is assumed here that the luminance degradation information is a value obtained by converting the same into a period of light emission according to an image signal of a particular gradation value, the present invention is not limited to this. Since this luminance degradation information is a value representative of a degree of degradation of the luminance based on degradation of the pixel circuit, it may be a rate of degradation of the luminance to that in the initial state. Or, luminance characteristic information may be calculated and retained as luminance degradation information.

Further, although it is assumed that the temperatures of the pixel array section 140 and the dummy pixel array section 300 are equal to each other and a single piece of temperature information is supplied to the luminance degradation information updating portion 221 and the luminance degradation characteristic supplying block 400 through the signal line 208, the present invention is not limited to this. The luminance degradation characteristic supplying block 400 must only be able to acquire the temperature of the dummy pixel circuits. Further, the luminance degradation information updating portion 221 must only be able to acquire the temperature of each pixel circuit. For example, if the temperature differs depending upon the place, then it is a possible idea for the luminance degradation information updating portion 221 to acquire temperature information from a temperature sensor positioned adjacent a pixel circuit and for the luminance degradation characteristic supplying block 400 to acquire temperature information from a temperature sensor positioned adjacent a dummy pixel circuit.

Figure 12:
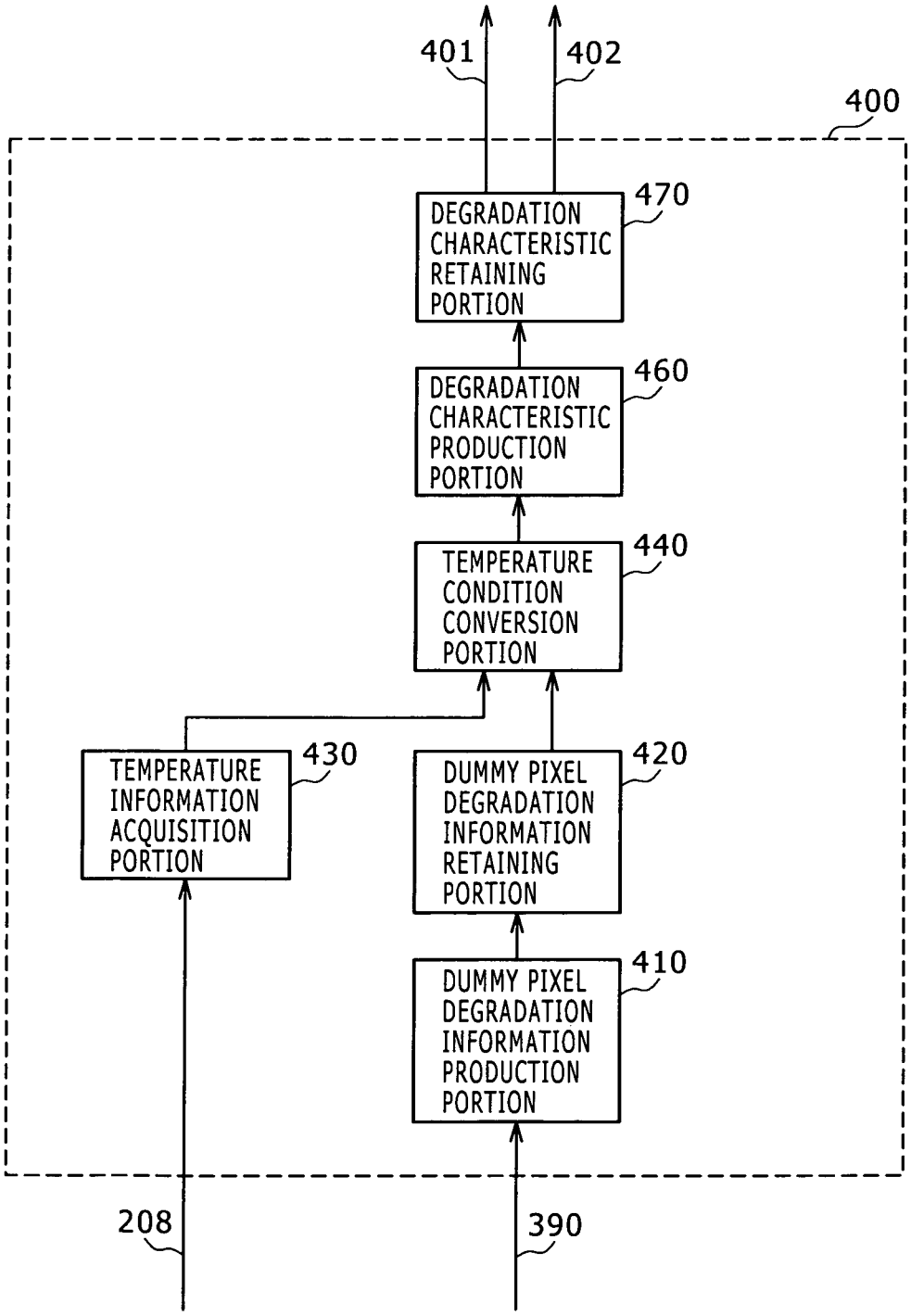
FIG. 12 is a block diagram showing an example of a functional configuration of a luminance degradation characteristic supplying block shown in FIG. 11.

Example of Configuration of Luminance Degradation Characteristic Supplying Block FIG. 12 is a block diagram showing an example of a functional configuration of the luminance degradation characteristic supplying block 400 in the first embodiment of the present invention. Referring to FIG. 12, the luminance degradation characteristic supplying block 400 shown includes a dummy pixel degradation information production portion 410, a dummy pixel degradation information retaining portion 420, a temperature information acquisition portion 430, a temperature condition conversion portion 440, a degradation characteristic production portion 460 and a degradation characteristic retaining portion 470.

The dummy pixel degradation information production portion 410 produces information regarding the degradation amount of the luminance of a dummy circuit, that is, dummy pixel degradation information, based on dummy pixel luminance information supplied thereto through the signal line 390. For example, the dummy pixel degradation information production portion 410 retains the luminance of the dummy pixel circuit 311 in an initial state in advance. Then, the dummy pixel degradation information production portion 410 compares a result of measurement of the luminance by the luminance sensor 312, that is, dummy pixel luminance information, and the luminance of the dummy pixel circuit 311 in the initial state with each other to produce a degradation amount of the dummy pixel circuit, that is, a dummy pixel degradation amount. The dummy pixel degradation information production portion 410 supplies the produced dummy pixel degradation amount as dummy pixel degradation information to the dummy pixel degradation information retaining portion 420.

The dummy pixel degradation information retaining portion 420 retains dummy pixel degradation information. For example, if the number of luminance detection units is three (310, 320 and 330), then the dummy pixel degradation information retaining portion 420 retains dummy pixel degradation information of the dummy pixels of the individual luminance detection units. The dummy pixel degradation information retaining portion 420 supplies the dummy pixel degradation information retained therein to the temperature condition conversion portion 440. It is to be noted that an example of the dummy pixel degradation information retained in the dummy pixel degradation information retaining portion 420 is hereinafter described with reference to FIGS. 13A and 13B.

The temperature information acquisition portion 430 acquires temperature information supplied thereto from the temperature sensor 141 through the signal line 208 and retains the acquired temperature information. More particularly, the temperature information acquisition portion 430 acquires the temperature information, for example, in synchronism with a timing at which the dummy pixel degradation information production portion 410 produces dummy pixel degradation information, and retains the acquired temperature information. The temperature information acquisition portion 430 supplies the retained temperature information to the temperature condition conversion portion 440.

The temperature condition conversion portion 440 calculates a degradation characteristic at a predetermined temperature based on dummy pixel degradation information and temperature information. In particular, the temperature condition conversion portion 440 calculates, in order to calculate a degradation characteristic at a predetermined temperature, a period of time demanded for the same degradation in the predetermined temperature condition from the degradation of the measured period and produces information regarding the period of time, that is, calculation period information. The temperature condition conversion portion 440 uses dummy pixel degradation information which includes temperature information, which represents the temperature upon measurement, of "20° C." to calculate a period of time required for the same amount of degradation at the temperature "30° C." This calculation of the period of time is carried out by the temperature condition conversion portion 440, for example, retaining previously information obtained by converting a difference in degradation characteristic depending upon the temperature into a formula and using the formula upon calculation. The temperature condition conversion portion 440 supplies the produced calculation period information to the degradation characteristic production portion 460 together with the dummy pixel degradation information. It is to be noted that an example of production of calculation period information by the temperature condition conversion portion 440 is hereinafter described with reference to FIG. 14A.

The degradation characteristic production portion 460 produces a degradation characteristic of a pixel circuit at a predetermined temperature based on calculation period information and dummy pixel degradation information. For example, the degradation characteristic production portion 460 uses calculation period information calculated at the temperature of "30° C." and dummy pixel degradation information used for calculation of the calculation period information to produce a degradation characteristic of the pixel circuit in the case where the temperature condition is "30° C." fixed. The degradation characteristic production portion 460 supplies the produced degradation characteristic to the degradation characteristic retaining portion 470. It is to be noted that an example of production of a degradation characteristic by the degradation characteristic production portion 460 is hereinafter described with reference to FIG. 14B.

The degradation characteristic retaining portion 470 retains a degradation characteristic supplied thereto from the degradation characteristic production portion 460. The degradation characteristic retaining portion 470 supplies the retained degradation characteristic to the luminance degradation information updating portion 221 through the signal line 401. Further, the degradation characteristic retaining portion 470 supplies the retained degradation characteristic to the object luminance characteristic information production portion 232 through the signal line 402.

It is to be noted that, while, in the first embodiment of the present invention, it is assumed that the temperature condition conversion portion 440 calculates calculation period information, the present invention is not limited to this. The temperature condition conversion portion 440 must only produce information from which a degradation characteristic can be produced by the degradation characteristic production portion 460. For example, such an example may be possible that the temperature condition conversion portion 440 calculates a gradient of a characteristic within a calculation period in such a case that the acquisition interval of dummy pixel luminance information is long or the like.

Further, while, in FIG. 12, a luminance of dummy pixel luminance information and a luminance in an initial state are compared with each other to produce a dummy pixel degradation amount, the present invention is not limited to this. The dummy pixel degradation amount may be any information relating to degradation.

Example of Luminance Measurement, Example of Dummy Pixel Degradation Information and Example of Temperature Information FIGS. 13A to 13C illustrate an example of luminance measurement by the three luminance sensors in the first embodiment of the present invention, an example of dummy pixel degradation information and an example of temperature information, respectively.

In FIGS. 13A to 13C, it is assumed that the number of times of measurement of the luminance by the luminance sensors is three and that the dummy pixel circuits are emitting light in response to a predetermined light emission signal.

FIG. 13A shows a graph indicative of an example of measurement of the luminance degradation of the three dummy pixel circuits which emit light with three different gradation values 100, 150 and 200. Referring to FIG. 13A, the axis of ordinate of the graph indicates the degradation amount of the dummy pixel circuits and the axis of abscissa indicates the light emission time. FIG. 13A thus illustrates measurement degradation characteristics 411, 412 and 413 which are results of measurement of the luminance of the dummy pixel circuits when they emit light with the predetermined light emission signals whose luminance value is 100, 150 and 200, respectively. It is to be noted that, along the axis of ordinate of the graph shown in FIG. 13A, as the degradation amount of a dummy pixel circuit comes nearer to the origin at which the axis of ordinate and the axis of abscissa cross with each other, it is nearer to that of the dummy pixel circuit in the initial state, that is, to a state in which the deterioration degree is low, but the luminance decreases, that is, the degradation increases, downwardly along the axis of ordinate.

Further, in FIG. 13A, as a period within which the luminance is measured, a measurement period (1) T1 representative of the first time, measurement, a measurement period (2) T2 representative of the second time measurement and a measurement period (3) T3 representative of the third time measurement are illustrated. Further, in FIG. 13A, it is assumed that the temperature of the dummy pixel circuits within the measurement period (1) T1 is 20° C.; the temperature of the dummy pixel circuits within the measurement period (2) T2 is 40° C.; and the temperature of the dummy pixel circuits within the measurement period (3) T3 is 30° C.

The measurement degradation characteristic (gradation value 100) 411 schematically indicates a result of measurement of the luminance of the dummy circuits when they emit light with a light emission signal of the gradation value "100." This measurement degradation characteristic (gradation value 100) 411 indicates that, since the temperature of the dummy pixel circuits differs among the different measurement periods, the characteristic of the degradation differs among the different measurement periods. The characteristic within the measurement period (1) T1 from within the measurement degradation characteristic (gradation value 100) 411 originates from the fact that the dummy pixel circuits are degraded in accordance with the characteristic of degradation at the temperature 20° C., for example, a degradation characteristic (temperature 20° C.) 694 of FIG. 8. Meanwhile, the characteristic within the measurement period (2) T2 from within the measurement degradation characteristic (gradation value 100) 411 originates from the fact that the dummy pixel circuits are degraded in accordance with the characteristic of degradation at the temperature 40° C., for example, a degradation characteristic (temperature 40° C.) 696 of FIG. 8. Further, the characteristic within the measurement period (3) T3 from within the measurement degradation characteristic (gradation value 100) 411 originates from the fact that the dummy pixel circuits are degraded in accordance with the characteristic of degradation at the temperature 30° C., for example, a degradation characteristic (temperature 30° C.) 695 of FIG. 8.

The measurement degradation characteristic (gradation value 150) 412 schematically indicates a result of measurement of the luminance of the dummy circuits when they emit light with a light emission signal of the gradation value "150." This measurement degradation characteristic (gradation value 150) 412 indicates that degradation by a light emission signal of the gradation value "150" proceeds more quickly than degradation by a light emission signal of the gradation value "100." It is to be noted that a characteristic for each measurement period from within the measurement degradation characteristic (gradation value 150) 412 is similar to that of the measurement degradation characteristic (gradation value 100) 411, and therefore, overlapping description of the same is omitted herein to avoid redundancy.

The measurement degradation characteristic (gradation value 200) 413 which schematically indicates a result of measurement of the luminance of the dummy circuits when they emit light with a light emission signal of the gradation value "200." This measurement degradation characteristic (gradation value 200) 413 indicates that degradation by a light emission signal of the gradation value "200" proceeds more quickly than degradation by a light emission signal of the gradation value "150."

As seen from FIG. 13A, degradation of the dummy pixel circuits is influenced by the temperature upon light emission.

FIG. 13B shows a table schematically illustrating an example of dummy pixel degradation information retained in the dummy pixel degradation information retaining portion 420 at the end of the measurement period (3) T3 of FIG. 13A.

It is to be noted that, in FIG. 13B, the intensity of the luminance, that is, dummy pixel luminance information, upon measurement is schematically represented by a ratio (%) to that of the dummy pixel circuits in the initial state and is indicated as dummy pixel degradation information. It is to be noted that, in the embodiments of the present invention, the values indicated in the table of FIG. 13B and so forth are simplified values in order to facilitate illustration and description while actual measurement values are omitted.

In a column 421 of FIG. 13B, dummy pixel degradation information produced based on a result of measurement of the luminance within the measurement period (1) T1 and retained into the dummy pixel degradation information retaining portion 420 within the measurement period (1) T1 is indicated. Similarly, dummy pixel degradation information retained within the measurement period (2) T2 is indicated in another column 422, and dummy pixel degradation information retained within the measurement period (3) T3 is indicated in a further column 423.

Meanwhile, in a row 424 of FIG. 13B, dummy pixel degradation information produced based on a result of measurement of the luminance of the dummy pixel circuits driven to emit light based on a light emission signal of the gradation value "100" is indicated. Similarly, dummy pixel degradation information produced based on a result of measurement of the luminance of the dummy pixel circuits driven to emit light based on a light emission signal of the gradation value "150" is indicated in another row 425. Further, dummy pixel degradation information produced based on a result of measurement of the luminance of the dummy pixel circuits driven to emit light based on a light emission signal of the gradation value "200" is indicated in a further row 426.

While FIG. 13B illustrates dummy pixel degradation information at the end of the measurement period (3) T3, when the fourth time measurement period (not shown) thereafter comes to an end, the dummy pixel degradation information based on the luminance within this measurement period is retained for each of the dummy pixel circuits.

As seen in FIG. 13B, dummy pixel degradation information produced for the individual dummy pixel circuits is successively retained into the dummy pixel degradation information retaining portion 420 for the individual measurement periods.

FIG. 13C shows a table schematically indicating an example of temperature information retained in the temperature information acquisition portion 430 at the end of the measurement period (3) T3 of FIG. 13A.

Referring to FIG. 13C, in a column 431, temperature information (20° C.) detected by the temperature sensor 141 within the measurement period (1) T1 of FIG. 13A and retained into the temperature information acquisition portion 430 within the measurement period (1) T1 is indicated. Similarly, in another column 432, temperature information (40° C.) retained within the measurement period (2) T2 is indicated, and in a further column 433, temperature information (30° C.) retained within the measurement period (3) T3 is indicated.

While FIG. 13C indicates temperature information at the end of the measurement period (3) T3, when the fourth time measurement period (not shown) thereafter comes to an end, the temperature information indicative of temperatures detected within this measurement period is retained into the temperature information acquisition portion 430.

As seen from FIG. 13C, temperature information for the individual measurement periods is successively retained into the temperature information acquisition portion 430 for the individual measurement periods.

Figure 14A:
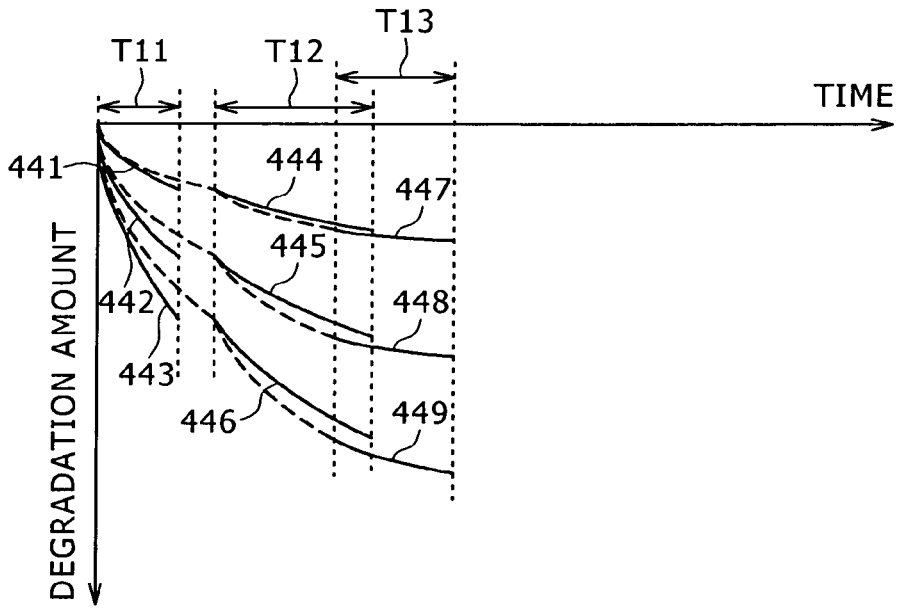
FIGS. 14A and 14B are diagrams illustrating an example of temperature condition conversion by a temperature condition conversion portion shown in FIG. 12 and an example of degradation characteristic production by a degradation characteristic production portion shown in FIG. 12, respectively.
Figure 14B:
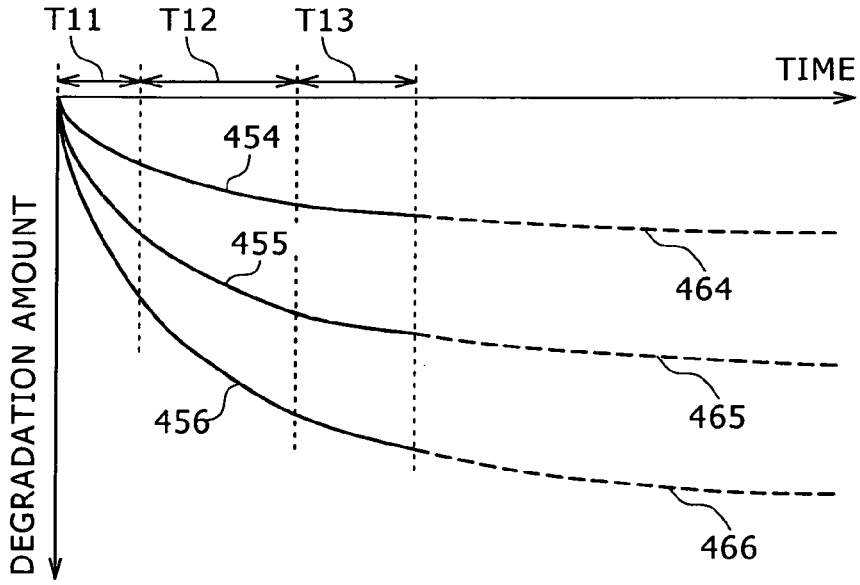

Example of Temperature Condition Conversion and Degradation Characteristic Production FIGS. 14A and 14B are views illustrating an example of temperature condition conversion by the temperature condition conversion portion 440 and an example of degradation characteristic production by the degradation characteristic production portion 460 in the first embodiment of the present invention, respectively.

FIG. 14A shows a graph schematically illustrating an example of temperature condition conversion by the temperature condition conversion portion 440. It is to be noted that, in FIGS. 14A and 14B, it is assumed that a degradation characteristic in the case where the temperature of the dummy pixel circuits is 30° C. is produced.

In the graph of FIG. 14A, the axis of ordinate indicates the degradation amount of the dummy pixel circuits, and the axis of abscissa indicates time required for the degradation. In the graph, conversion characteristics 441 to 449 obtained by temperature condition conversion of the measured degradation characteristics illustrated in FIG. 13A are indicated by solid line curves. Further, the measurement degradation characteristics 411 to 413 illustrated in FIG. 13A are indicated by broken line curves.

It is to be noted that, within a calculation period (1) T11 indicated in the graph, a length of time necessary to obtain degradation similar to the characteristic within the measurement period (1) T1 in FIG. 13A, that is, calculation period information, is illustrated. In other words, the calculation period (1) T11 indicates a length of time necessary for the degradation of the conversion characteristics 441 to 443 at "30° C." Similarly, within another calculation period (2) T12, a length of time necessary to obtain degradation similar to the characteristic within the measurement period (2) T2 is indicated, and within a further calculation period (3) T13, a length of time necessary to obtain degradation similar to the characteristic within the measurement period (3) T3 is indicated.

The conversion characteristics 441 to 443 are curves indicating results of temperature condition conversion within the measurement period (1) T1 of the measurement degradation characteristics 411 to 413 illustrated in FIG. 13A. The conversion characteristics 441 to 443 are produced by converting the temperature condition of the measurement degradation characteristics 411 to 413 within the measurement period (1) T1 from "20° C." to "30° C." The gradient of each of the conversion characteristics 441 to 443 is greater than the gradient of each of the measurement degradation characteristics 411 to 413 within the measurement period (1) T1 because the degradation proceeds more rapidly at "30° C." than at "20° C." Further, since the temperature upon measurement is "20° C.," the calculation period (1) T11 is shorter than the measurement period (1) T1.

The conversion characteristics 444 to 446 are curves indicative of results of temperature condition conversion of the measurement degradation characteristics 411 to 413 illustrated in FIG. 13A within the measurement period (2) T2. The conversion characteristics 444 to 446 are produced by converting the temperature condition of the measurement degradation characteristics 411 to 413 within the measurement period (2) T2 from "40° C." to "30° C." The gradient of each of the conversion characteristics 444 to 446 is smaller than the gradient of each of the measurement degradation characteristics 411 to 413 within the measurement period (2) T2 because the degradation proceeds more slowly at "30° C." than at "40° C." Further, since the temperature upon measurement is "40° C.," the calculation period (2) T12 is longer than the measurement period (2) T2.

The conversion characteristics 447 to 449 are curves indicative of results of temperature condition conversion of the measurement degradation characteristics 411 to 413 illustrated in FIG. 13A within the measurement period (3) T3. The conversion characteristics 447 to 449 are same as the measurement degradation characteristics 411 to 413 within the measurement period (3) T3 because the temperature condition of the measurement degradation characteristics 441 to 443 within the measurement period (3) T3 is "30° C." Also the length of the calculation period (3) T13 is same as that of the measurement period (3) T3.

In this manner, calculation period information is produced by the temperature condition conversion portion 440 in order to produce a degradation characteristic at a predetermined temperature.

FIG. 14B shows a graph schematically illustrating an example of degradation characteristic production by the degradation characteristic production portion 460. In FIG. 14B, it is assumed that a degradation characteristic is produced based on the information illustrated in FIG. 14A.

In the graph of FIG. 14B, the axis of ordinate indicates the degradation amount of the dummy pixel circuits, and the axis of abscissa indicates time required for the degradation. In the graph, calculation characteristics 454 to 456 which are formed by connecting the conversion characteristics 441 to 449 illustrated in FIG. 14A are indicated by solid line curves. Further, degradation characteristics 464 to 466 produced by the degradation characteristic production portion 460 are indicated by broken line curves.

The calculation characteristic (gradation value 100) 454 is calculated by connecting the conversion characteristics 441, 444 and 447 (refer to FIG. 14A) produced based on the measurement degradation characteristic (gradation value 100) 411 (refer to FIG. 13A to each other. The calculation characteristic (gradation value 100) 454 is a characteristic until degradation by an amount equal to that of the measurement degradation characteristic (gradation value 100) 411, that is, by a degradation amount indicated in the row 424 in the column 423 of FIG. 13B is obtained under a condition that the temperature is fixed at "30° C." The calculation characteristic (gradation value 100) 454 is produced, for example, by disposing a degradation amount indicated by dummy pixel degradation information of the dummy pixel circuit which is driven to emit light with the gradation value "100" at intervals of a period indicated by the calculation period information and then carrying out fitting.

The calculation characteristic (gradation value 150) 455 is calculated by connecting the conversion characteristics 442, 445 and 448 (refer to FIG. 14A) produced based on the measurement degradation characteristic (gradation value 150) 412 (refer to FIG. 13A).

The calculation characteristic (gradation value 200) 456 is calculated by connecting the conversion characteristics 443, 446 and 449 (refer to FIG. 14A) produced based on the measurement degradation characteristic (gradation value 200) 413 (refer to FIG. 13A).

It is to be noted that the calculation characteristic (gradation value 150) 455 and the calculation characteristic (gradation value 200) 456 are similar to the calculation characteristic (gradation value 100) 454 except that the gradation value is "150" and "200," respectively, and therefore, detailed description of them is omitted herein to avoid redundancy.

In this manner, the degradation characteristic production portion 460 first produces a calculation characteristic using a conversion characteristic produced by the temperature condition conversion portion 440. Then, the degradation characteristic production portion 460 produces a degradation characteristic using the produced calculation characteristic.

The degradation characteristic (gradation value 100) 464 is calculated from the calculation characteristic (gradation value 100) 454. The degradation characteristic (gradation value 100) 464 is produced, for example, by producing an approximate curve using the calculation characteristic (gradation value 100) 454.

The degradation characteristic (gradation value 150) 465 is calculated from the calculation characteristic (gradation value 150) 455.

The degradation characteristic (gradation value 200) 466 is calculated from the calculation characteristic (gradation value 200) 456.

It is to be noted that the degradation characteristic (gradation value 150) 465 and the degradation characteristic (gradation value 200) 466 are similar to the degradation characteristic (gradation value 100) 464 except that the gradation value is "150" and "200," respectively, and therefore, detailed description of them is omitted herein to avoid redundancy.

Example of Gradation Characteristic at Plurality of Temperatures

Figure 15A:
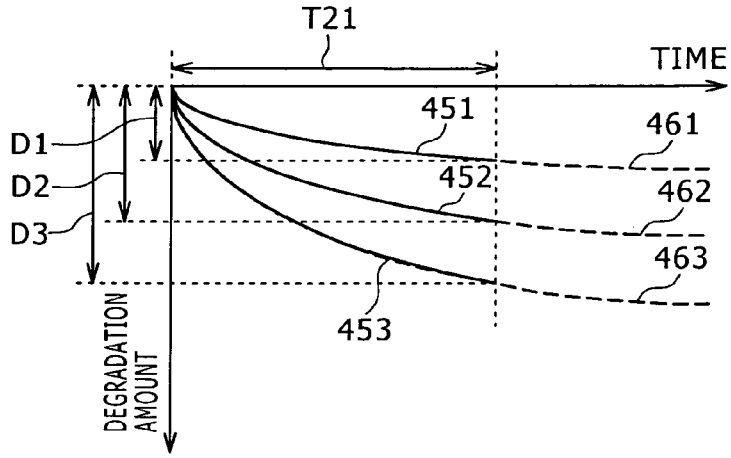
FIGS. 15A to 15C are diagrams schematically illustrating an example of degradation characteristics for individual temperatures produced by the degradation characteristic production portion shown in FIG. 12.
Figure 15B:
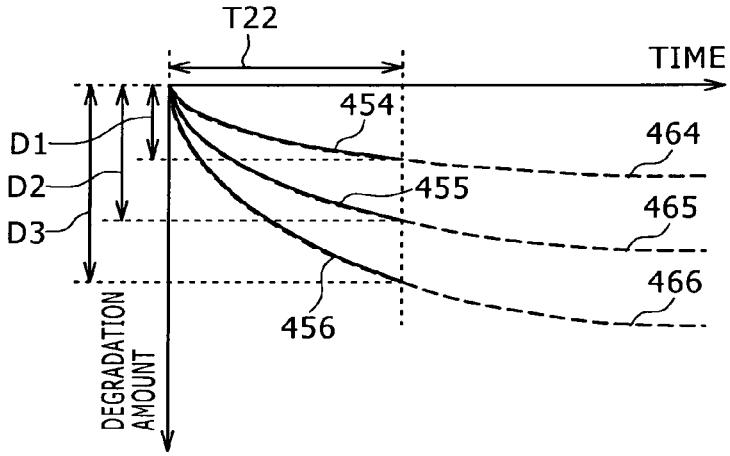
Figure 15C:
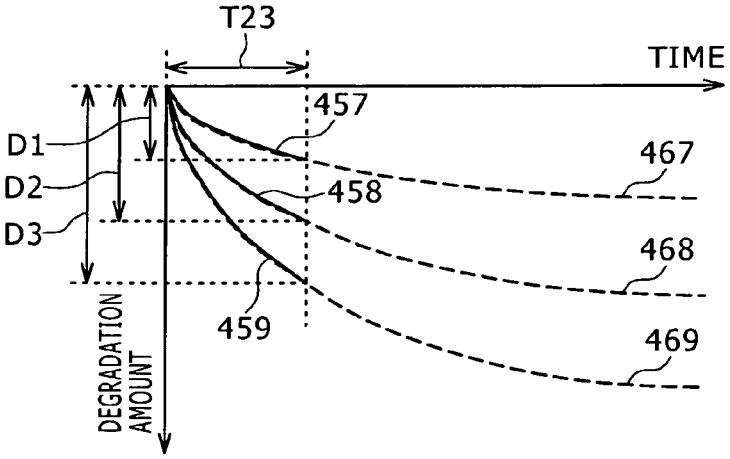

FIGS. 15A to 15C schematically illustrate an example of a degradation characteristic at different temperatures produced by the degradation characteristic production portion 460 in the first embodiment of the present invention. In FIGS. 15A to 15C, the degradation characteristic production portion 460 produces degradation characteristics in temperature conditions of "20° C.," "30° C." and "40° C." and the degradation characteristic retaining portion 470 retains the produced degradation characteristics. In FIGS. 15A to 15C, the axis of ordinate indicates the degradation amount of the dummy pixel circuits and the axis of abscissa indicates the time required for the degradation, and three graphs ("20° C.," "30° C." and "40° C.") are shown, respectively.

FIG. 15A shows a graph schematically illustrating a degradation characteristic in the case where the temperature condition is "20° C." In the graph, calculation characteristics produced in the case where the temperature condition of degradation within the measurement periods of the measurement degradation characteristics 411 to 413 is "20° C." are indicated by solid line curves, that is, by calculation characteristics 451 to 453. Further, degradation characteristics calculated from the calculation characteristics 451 to 453, that is, degradation characteristics 461 to 463, are indicated by broken line curves.

It is to be noted that the calculation characteristics 451 to 453 are similar to the calculation characteristics 454 to 456 described hereinabove with reference to FIG. 14B except that the temperature condition is "20° C.," and therefore, overlapping description of them is omitted herein to avoid redundancy. Further, the degradation characteristics 461 to 463 are similar to the degradation characteristics 464 to 466 described hereinabove with reference to FIG. 14B except that the temperature condition is "20° C.," and therefore, overlapping description of them is omitted herein to avoid redundancy.

In FIG. 15A, degradation amounts D1 to D3 indicative of the degradation amounts of the calculation characteristics 451 to 453 are illustrated. It is to be noted that, since the degradation amounts D1 to D3 indicate an equal degradation amount in FIGS. 15A to 15C because the degradation amounts of the calculation characteristics 451 to 453 and the degradation amounts of the measurement degradation characteristics 411 to 413 at the end of the measurement period (3) T3 are equal to each other.

Further, in FIG. 15A, a period T21 is illustrated as a period required for the deterioration by the degradation amounts D1 to D3 at the temperature condition "20° C." It is to be noted that this period T21 is the sum of the calculation periods calculated with the temperature condition set to "20° C."

The degradation characteristics 461 to 463 illustrated in FIG. 15A are supplied as degradation characteristics for calculation of degradation of the pixel circuits, that is, luminance degradation information in the temperature condition "20° C." to the luminance degradation information updating portion 221.

FIG. 15B shows a graph schematically illustrating a degradation characteristic in the case where the temperature condition is "30° C." The graph shown in FIG. 15B is same as that shown in FIG. 14B. Further, in FIG. 15B, a period T22 is illustrated as a period required for the deterioration by the degradation amounts D1 to D3 at the temperature condition "30° C." It is to be noted that, since the degradation speed in the temperature condition "30° C." is higher than the degradation speed in the temperature condition "20° C.," the period T22 is shorter than the period T21.

The degradation characteristics 464 to 466 illustrated in FIG. 15B are supplied as degradation characteristics for calculation of degradation of the pixel circuits, that is, luminance degradation information, in the temperature condition "30° C." to the luminance degradation information updating portion 221.

FIG. 15C shows a graph schematically illustrating a degradation characteristic in the case where the temperature condition is "40° C." calculation characteristics 457 to 459 and degradation characteristics 467 to 467 illustrated in FIG. 15C are similar to the calculation characteristics and the degradation characteristics described hereinabove with reference to FIGS. 15A and 15B, respectively, except that the temperature condition is "40° C." Therefore, overlapping description of them is omitted herein to avoid redundancy. Further, in FIG. 15C, a period T23 is illustrated as a period required for the deterioration by the degradation amounts D1 to D3 at the temperature condition "40° C." It is to be noted that this period T23 is shorter than the period T22 because the degradation speed in the temperature condition "40° C." is higher than the degradation speed in the temperature condition "30° C."

The degradation characteristics 467 to 469 illustrated in FIG. 15C are supplied as degradation characteristics for calculation of degradation of the pixel circuits, that is, luminance degradation information, in the temperature condition "40° C." to the luminance degradation information updating portion 221.

In this manner, degradation characteristics in a plurality of temperature conditions are produced based on a plurality of calculation characteristics produced by conversion of the temperature condition by the degradation characteristic production portion 460.

It is to be noted that, while, in the description of the first embodiment of the present invention, degradation characteristics at three gradation values, that is, "100," "200" and "300," in three temperature conditions, that is, "20° C.," "30° C." and "40° C.," are described, the present invention is not limited to this. For example, it seems a possible idea to improve the accuracy in production of luminance degradation information for each pixel circuit by producing a degradation characteristic with regard to a greater number of temperature conditions and/or gradation values.

Further, while, in the first embodiment of the present invention, the degradation characteristic retaining portion 470 retains a degradation characteristic, an expression representing the produced degradation characteristic may actually be retained in the degradation characteristic retaining portion 470.

Example of Production of Luminance Degradation Information

An example of updating of luminance degradation information using the degradation characteristics 461 to 469 described hereinabove with reference to FIGS. 15A to 15C is described with reference to FIG. 16.

Figure 16:
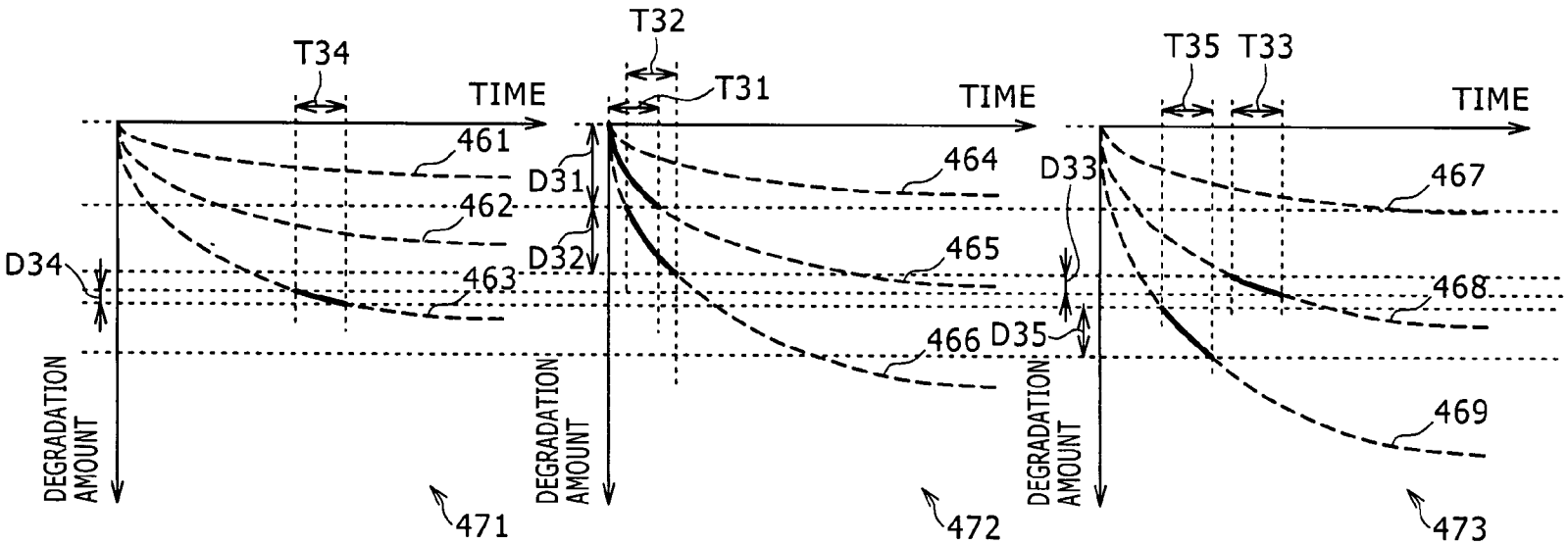
FIG. 16 is a diagram illustrating an example of production of luminance degradation information by a luminance degradation information updating portion shown in FIG. 11.

FIG. 16 illustrates a concept of an example of production of luminance degradation information by the luminance degradation information updating portion 221 in the first embodiment of the present invention.

It is to be noted that, in FIG. 16, it is assumed that updating of luminance degradation information is carried out five times. Further, it is assumed that updating of luminance degradation information is carried out at intervals of one minute. It is assumed that emission of light within first one minute of a pixel circuit indicated by the luminance degradation information in FIG. 16 depends upon a light emission signal whose gradation value is "150" in an environment in which the temperature is "30° C." Further, it is assumed that emission of light for the second time depends upon a light emission signal whose gradation value is "200" in an environment in which the temperature is "30° C." Further, it is assumed that emission of light for the third time depends upon a light emission signal whose gradation value is "150" in an environment in which the temperature is "40° C." Further, it is assumed that emission of light for the fourth time depends upon a light emission signal whose gradation value is "200" in an environment in which the temperature is "20° C." Further, it is assumed that emission of light for the fifth time depends upon a light emission signal whose gradation value is "200" in an environment in which the temperature is "40° C."

In FIG. 16, the axis of ordinate indicates the degradation amount of a pixel circuit and the axis of abscissa indicates the time required for degradation, and three graphs, that is, degradation characteristics 471 to 473, are shown.

On the degradation characteristic (20° C.) 471, the degradation characteristics 461 to 463 illustrated in FIG. 15A are indicated by broken line curves. Further, on the degradation characteristic (20° C.) 471, a period of time for calculating a degradation amount to be added upon fourth time updating of the luminance degradation information is indicated as a degradation amount D34. Further, an interval of the degradation characteristic 463 corresponding to the degradation amount D34 is indicated by a solid line curve.

On the degradation characteristic (30° C.) 472, the degradation characteristics 464 to 466 illustrated in FIG. 15B are indicated by broken line curves. On the degradation characteristic (30° C.) 472, periods of time for calculating a degradation amount to be added upon first and second time updating of the luminance degradation information are indicated as a degradation time period (1) T31 and a degradation time (period 2) T32. Further, on the degradation characteristic (30° C.) 472, new degradation amounts to be added upon the first and second time updating of the luminance degradation information are indicated as degradation amounts D31 and D32. Furthermore, an interval of the degradation characteristic 466 corresponding to the degradation amount D32 and an interval of the degradation characteristic 465 corresponding to the degradation amount D31 are indicated by solid line curves.

On the degradation characteristic (40° C.) 473, the degradation characteristics 467 to 469 illustrated in FIG. 15C are indicated by broken line curves. On the degradation characteristic (40° C.) 473, periods of time for calculating a degradation amount to be added upon third and fifth time updating of the time luminance degradation information are indicated as a degradation time period (3) T33 and a degradation time period (5) T35. Further, on the degradation characteristic (40° C.) 473, new degradation amounts to be added upon the third and fifth time updating of the luminance degradation information are indicated as degradation amounts D33 and D35. Furthermore, an interval of the degradation characteristic 468 corresponding to the degradation amount D33 and an interval of the degradation characteristic 469 corresponding to the degradation amount D35 are indicated by solid line curves.

Here, updating of luminance degradation information by the luminance degradation information updating portion 221 is described briefly using the first, second and third time updating.

First, in the first time updating, the luminance degradation information updating portion 221 calculates the degradation amount D31 from a light emission signal whose gradation value is "150," temperature information representative of "30° C.," the degradation characteristic 465 and the luminance degradation information (which represents no degradation). Then, information regarding the degradation amount D31 is retained as luminance degradation information into the luminance degradation information retaining portion 222.

Then, in the second time updating, the luminance degradation information updating portion 221 calculates the degradation amount D32 from a light emission signal whose gradation value is "200," temperature information representative of "30° C.," the degradation characteristic 466 and the luminance degradation information (information representative of the degradation amount D31). Then, the luminance degradation information updating portion 221 causes the luminance degradation information retaining portion 222 to retain new luminance degradation information obtained by adding the degradation amount D32 to the luminance degradation information, which is information representative of the degradation amounts D31, that is, information representative of the degradation amounts D31+D32.

Then, in the third time updating, the luminance degradation information updating portion 221 calculates the degradation amount D33 from a light emission signal whose gradation value is "150," temperature information representative of "40° C.," the degradation characteristic 468 and the luminance degradation information, which is the degradation amounts D31+D32. Then, the luminance degradation information updating portion 221 causes the luminance degradation information retaining portion 222 to retain new luminance degradation information obtained by adding the degradation amount D33 to the luminance degradation information, which is information representative of the degradation amounts D31 and D32, that is, information representative of the degradation amounts D31+D32+D33.

In this manner, the luminance degradation information updating portion 221 adds the degradation amount for each degradation period to produce luminance degradation information.

It is to be noted that, while, in FIG. 16, the degradation characteristics 461 to 469 are used to produce luminance degradation information, it is a possible idea to improve the accuracy or preciseness of luminance degradation information by using degradation characteristics regarding a greater number of temperature conditions or gradation values.

Example of Production of Luminance Degradation Correction Pattern

Figure 17:
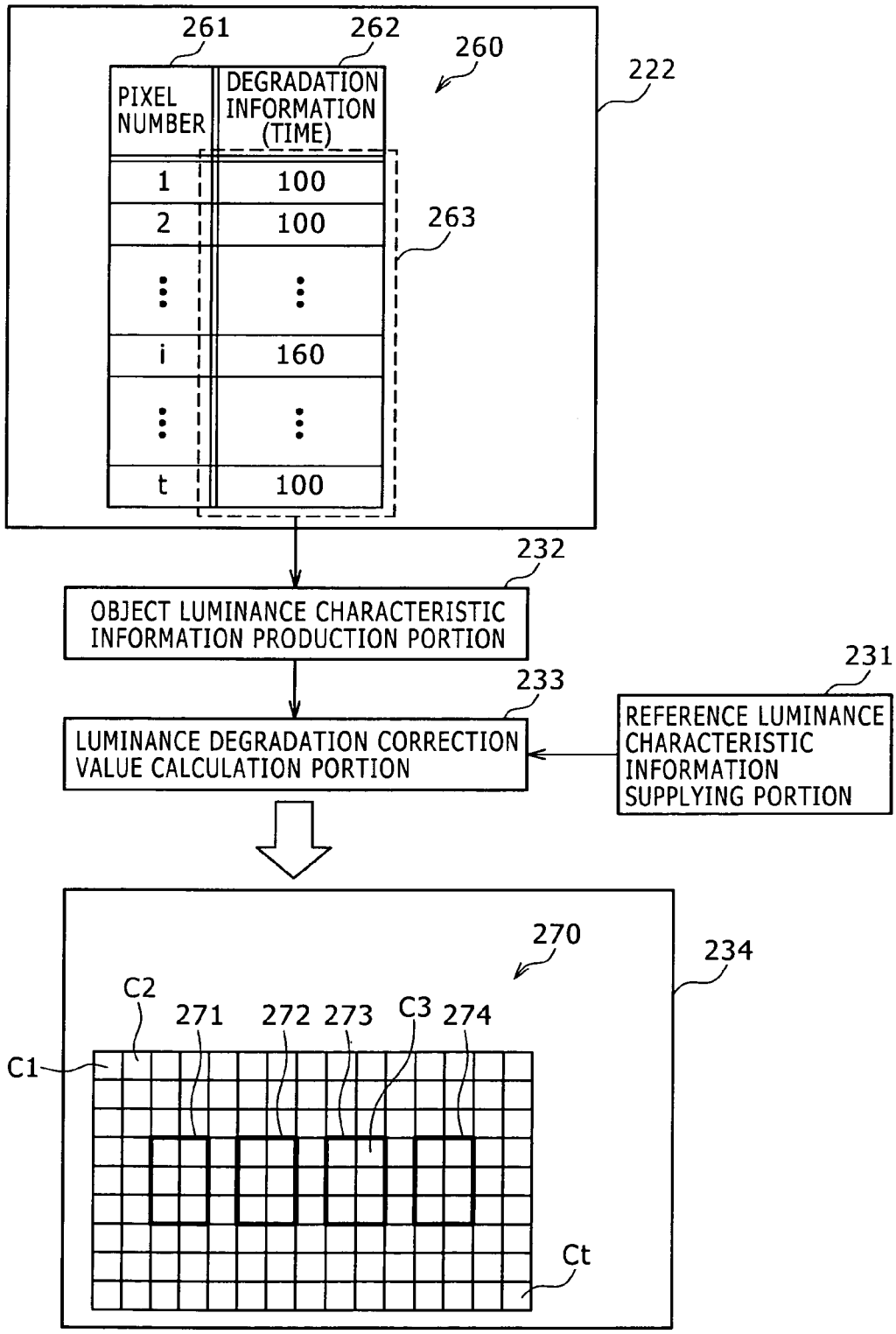
FIG. 17 is a diagrammatic view illustrating an example of production of a luminance degradation correction pattern by a luminance degradation correction value calculation portion shown in FIG. 11.

FIG. 17 shows an example of production of a luminance degradation correction pattern by the luminance degradation correction value calculation portion 233 in the first embodiment of the present invention. In particular, FIG. 17 schematically illustrates a flow of operation until a luminance degradation correction pattern of the luminance degradation correction pattern retaining portion 234 is produced based on luminance degradation information retained in the luminance degradation information retaining portion 222. It is to be noted here that pixel circuits provided in the display apparatus 100 are identified by reference characters 1 to t for the convenience of illustration and description. Further, in FIG. 17, the luminance degradation information is a value obtained by converting a degradation amount into a period of time of light emission with the gradation value "100" in the temperature condition "30° C."

Luminance degradation information (n−1) 260 is retained in the luminance degradation information retaining portion 222. In the example illustrated in FIG. 17, the luminance degradation information retained in the luminance degradation information retaining portion 222 based on display for n−1th time (n is an integer equal to or greater than 2) one minute is illustrated as the luminance degradation information. The luminance degradation information (n−1) is used to produce a luminance degradation correction pattern (n) 270 for correcting display of nth one minute. In the column (pixel number 261) on the left side of the luminance degradation information (n−1) 260, pixel numbers "1," "2," "i" and "t" which are numbers of the pixel circuits which configure the screen are indicated.

Further, in the column (degradation information 262) on the right side of the luminance degradation information (n=1) 260, luminance degradation information (degradation information) regarding the pixel circuit of the pixel number is indicated. Here, it is assumed that the pixel circuit corresponding to the pixel number 261 "i" suffers from comparatively great degradation while the pixel circuits corresponding to the pixel numbers 261 "1," "2" and "t" suffer from comparatively little degradation. It is assumed that, for example, "160" hours are retained as the luminance degradation information corresponding to the pixel number 261 "i" while "100" hours are retained as the luminance degradation information corresponding to the pixel numbers 261 "1," "2" and "t."

Further, degradation information 262 (indicated in broken lines 263) retained in the luminance degradation information (n−1) 260 is updated by the luminance degradation information updating portion 221 and acquired by the object luminance characteristic information production portion 232.

In the case where such luminance degradation information (n−1) 260 as described above is retained in the luminance degradation information retaining portion 222, the luminance degradation correction pattern production block 230 carries out nth time updating of the luminance degradation correction pattern.

Here, as an example, a process wherein object luminance characteristic information of the pixel number 261 "1" is supplied to the luminance degradation correction value calculation portion 233 is described. First, the object luminance characteristic information production portion 232 acquires the "100" hours of the degradation information 262 of the pixel number 261 "1" and calculates the degradation amount of the pixel circuit using the degradation characteristic. Then, the object luminance characteristic information production portion 232 produces luminance characteristic information, here denoted by "h," from the calculated degradation amount and supplies the produced luminance characteristic information "h" as object luminance characteristic information to the luminance degradation correction value calculation portion 233.

Thereafter, the luminance degradation correction value calculation portion 233 produces a luminance degradation correction value for each pixel circuit based on the reference luminance characteristic information and object luminance characteristic information. For example, in the case where "g" is supplied as the reference luminance characteristic information from the reference luminance characteristic information supplying portion 231, "h/g" is produced as the luminance degradation correction value. It is to be noted that the luminance degradation correction value is hereinafter described in detail with reference to FIGS. 18A and 18B.

Now, a luminance degradation correction pattern configured from luminance degradation correction values for the individual pixel circuits produced by the luminance degradation correction value calculation portion 233 is described.

The luminance degradation correction pattern (n) 270 schematically indicates a luminance degradation correction pattern produced by the luminance degradation correction value calculation portion 233. In the example illustrated in FIG. 17, a luminance degradation correction pattern in the case where a luminance degradation correction pattern for the individual pixel circuits produced by the luminance degradation correction value calculation portion 233 is disposed in accordance with the arrangement of pixels which configure the display screen is schematically illustrated. In particular, the luminance degradation correction pattern (n) 270 is an example of a correction pattern configured from luminance degradation correction values produced based on the luminance degradation information (n−1). Further, the luminance degradation correction pattern (n) 270 is updated for the nth time and is used to correct an image signal regarding each frame to be displayed within the nth one minute.

A luminance degradation correction value C1 in the luminance degradation correction pattern (n) 270 is used to correct the pixel circuit corresponding to the pixel number 261 "1" described in regard to the luminance degradation information (n−1) 260. Further, the position of the luminance degradation correction value C1 in the luminance degradation correction pattern (n) 270 corresponds to the position of the pixel circuit corresponding to the pixel number 261 "1" on the display screen. Also luminance degradation correction values C2, Ci and Ct are used to correct image signals to be supplied to the pixel circuits corresponding to the pixel numbers 2, i and t in the luminance degradation information (n−1) 260, respectively. Further, the positions of the luminance degradation correction values C2, Ci and Ct on the luminance degradation correction pattern (n) 270 correspond to the positions of the pixel circuits corresponding to the pixel numbers 261 "2," "i" and "t" on the display screen.

Further, pixel regions 271 to 274 in the luminance degradation correction pattern (n) 270 represent regions in which luminance degradation correction values which make the gradation values of the image signal in the pixel regions 271 to 274 higher than the other pixel circuits are disposed. Further, the pixel circuits other than those in the pixel regions 271 to 274 represent regions in which luminance degradation correction values which make the gradation values of the image signal a little higher are disposed. In other words, the pixel regions 271 to 274 are regions in which luminance degradation correction values regarding those pixel circuits which suffer much from degradation are disposed, and the pixel circuits other than those in the pixel regions 271 to 274 are regions in which luminance degradation correction values regarding those pixel circuits which suffer only a little from degradation are disposed.

In this manner, luminance degradation correction values for changing gradation values of an image signal to be displayed by the pixel circuits in response to the degree of degradation in luminance for each pixel circuit are produced. Then, since such luminance degradation correction value is produced with regard to all pixel circuits, correction of the pixel circuits which configure the display screen can be carried out appropriately.

Example of Correction of Luminance Degradation of Pixel Circuit

Figure 18A:
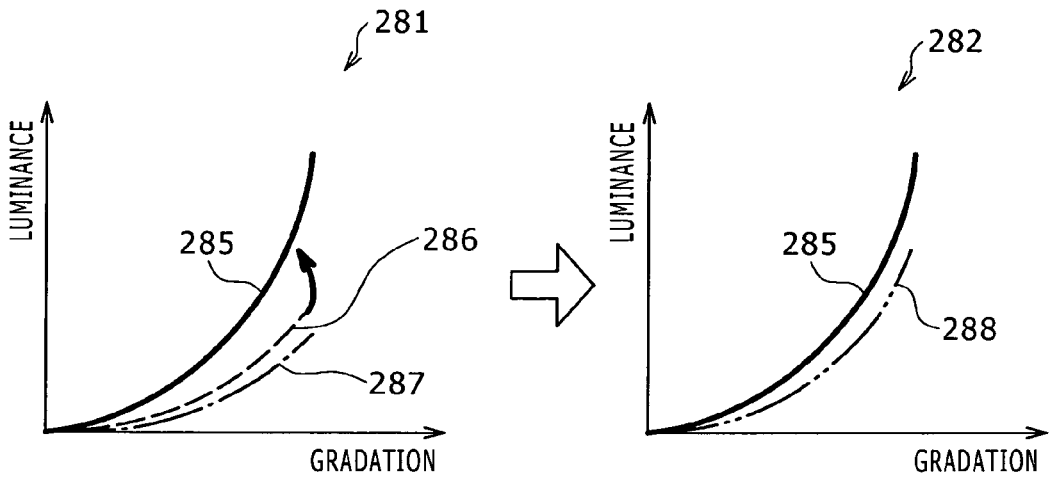
FIGS. 18A and 18B are diagrams illustrating an example of correction of luminance degradation of a pixel circuit in the case where a degradation characteristic for each temperature is not produced and an example of correction of luminance degradation of a pixel circuit in the display apparatus of FIG. 1, respectively.
Figure 18B:
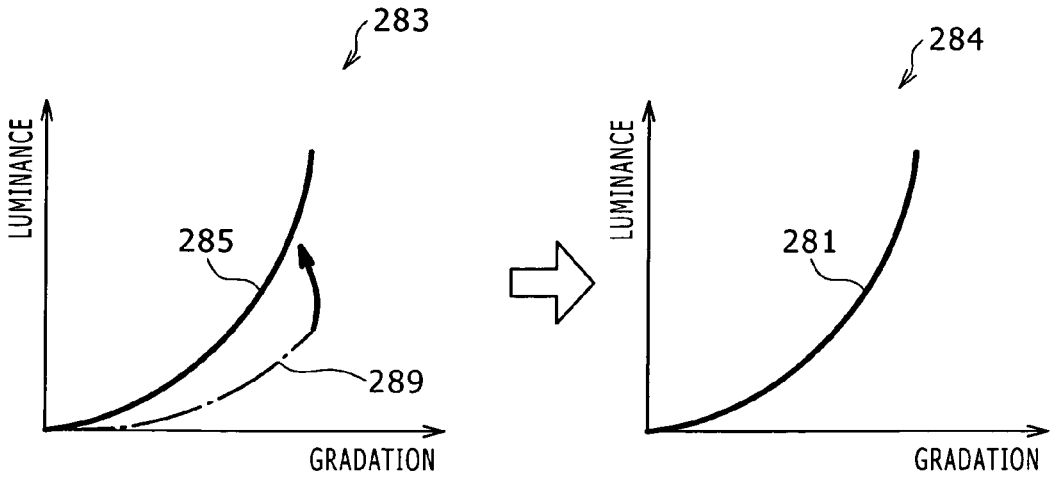

FIGS. 18A and 18B illustrate an example of correction of luminance degradation of a pixel circuit in the case where a degradation characteristic for each temperature is not produced and an example of correction of luminance degradation of a pixel circuit in the first embodiment of the present invention, respectively.

FIG. 18A shows a graph schematically illustrating an example of correction of luminance degradation of a pixel circuit in the case where a degradation characteristic for each temperature is not produced. In FIG. 18A, it is assumed that the luminance degradation characteristic supplying block 400 produces a degradation characteristic while the temperature condition conversion portion 440 does not produce a conversion characteristic. In other words, in FIG. 18A, a result of fitting of the measurement degradation characteristics 411 to 413 illustrated in FIG. 13A as they are is supplied as a degradation characteristic to the luminance degradation information updating portion 221. Further, in FIG. 18A, inaccurate luminance degradation information is provided based on this inaccurate degradation characteristic. Then, it is assumed that an inaccurate luminance degradation correction value is produced based on this inaccurate luminance degradation information.

In FIG. 18A, the axis of abscissa indicates the value of the gradation of the image signal inputted to the ghosting correction section 200, that is, the input gradation value, and the axis of ordinate indicates the value of the luminance of emitted light from a pixel circuit, that is, the luminance value. FIG. 18A thus indicates two graphs, that is, a pre-correction luminance characteristic graph 281 and a post-correction luminance characteristic graph 282.

The pre-correction luminance characteristic graph (with error) 281 illustrates an example of correction of luminance degradation of a pixel circuit in the case where a degradation characteristic for each temperature is not produced. The pre-correction luminance characteristic graph (with error) 281 illustrates a reference luminance characteristic 285, a correction object luminance characteristic (with error) 286, and a correction object luminance characteristic (actual) 287.

The reference luminance characteristic 285 is a curve indicative of a luminance characteristic of a pixel circuit in an initial state which makes a reference for correction. It is to be noted that the same reference luminance characteristic 285 is illustrated in FIGS. 18A and 18B, and therefore, overlapping description of the reference luminance characteristic 285 is omitted herein to avoid redundancy.

The correction object luminance characteristic (with error) 286 is a luminance characteristic of a pixel circuit of an object of correction and is a curve indicative of a luminance characteristic based on luminance degradation information which is inaccurate because a degradation characteristic for each temperature is not involved. In other words, the correction object luminance characteristic (with error) 286 indicates a luminance characteristic indicated by object luminance characteristic information to be used for correction by the ghosting correction section 200.

Further, the curve of the correction object luminance characteristic (with error) 286 has a gradient more moderate than that of the reference luminance characteristic 285. This variation in gradient occurs because degradation of the pixel circuit occurs, principally because degradation in efficiency in conversion of driving current of the light emitting element 640 into driving current occurs.

The correction object luminance characteristic (actual) 287 indicates an actual luminance characteristic of the pixel circuit of the object of correction. It is to be noted that, if the accuracy of the object luminance characteristic information used for correction by the ghosting correction section 200 is high, then the luminance characteristic indicated by the object luminance characteristic information, that is, the correction object luminance characteristic (with error) 286, becomes proximate to the correction object luminance characteristic (actual) 287.

A luminance degradation correction value is calculated based on such a luminance characteristic as indicated by the correction object luminance characteristic (with error) 286 of FIG. 18A, and change of the gradation value of the image signal is carried out. In particular, the gradation value of the image signal to be supplied to the pixel circuit is changed so that the luminance of emitted light with respect to the input gradation value becomes similar to that of the reference luminance characteristic 285.

Here, a luminance characteristic and a correction method are described.

First, a luminance characteristic is described. This luminance characteristic is represented, for example, by a quadratic function given as the following expression 3:

$$L=A\times S^2 \qquad \text{expression 3}$$

where L is the luminance value, and A is a coefficient, that is, an efficiency coefficient, which depends upon the efficiency in conversion of current through the light emitting element 640 into a luminance.

Further, in the expression 3 above, S is a value corresponding to the gate-source voltage of the driving transistor 620, and $S^2$ is a value calculated using a square characteristic of the driving transistor 620 and corresponds to driving current to be supplied to the light emitting element 640. In this manner, by multiplying the driving current $S^2$ by the conversion efficiency A of the light emitting element 640, the luminance value L can be calculated.

Now, a correction method of the ghosting correction section 200 is described. The ghosting correction section 200 changes the gradation of an image signal in accordance with the following expression 4:

$$S_{out}=(\Delta A)^{-1/2}\times S_{in} \qquad \text{expression 4}$$

$$\Delta A=A_d/A \qquad \text{expression 5}$$

where $S_{nut}$ is the corrected graduation value of the image signal corrected by the ghosting correction section 200, and $S_{in}$ is the gradation value of the image signal before the correction by the ghosting correction section 200. Meanwhile, ΔA is a value, that is, a luminance degradation correction value, in the form of a fraction indicative of a ratio in conversion efficiency wherein the efficiency coefficient ($A_d$) of the correction object pixel circuit is the numerator and the efficiency coefficient (A) of the pixel circuit in the initial sate is the denominator. It is to be noted that the conversion efficiency ($A_d$) of the correction object pixel circuit is an example of object luminance characteristic information to be supplied from the object luminance characteristic information production portion 232 (refer to FIG. 11). Further, the efficiency coefficient (A) of the pixel circuit in the initial state is an example of reference luminance characteristic information to be supplied by the reference luminance characteristic information supplying portion 231 (refer to FIG. 11).

In order to change the gradation value of the image signal in accordance with the expression 4, the ghosting correction section 200 retains information regarding degradation of the individual pixel circuits, that is, luminance degradation information, and calculates an efficiency coefficient of each of the pixel circuits from the degradation information. Then, the ghosting correction section 200 calculates a luminance degradation correction value ΔA and changes the gradation of the image signal based on the calculated luminance degradation correction value ΔA to produce a corrected value of the gradation of the image signal, that is, a correction gradation value.

The post-correction luminance characteristic graph (with error) 282 illustrates an example of a result of correction of luminance degradation of the pixel circuit in the case where a degradation characteristic for each temperature is not produced. The post-correction luminance characteristic graph 282 indicates a reference luminance characteristic 285, and a post-correction luminance characteristic (actual) 288.

The post-correction luminance characteristic (actual) 288 indicates a result of correction of the pixel circuit of the object of correction in the case where correction is carried out based on the correction object luminance characteristic with error) 286. The gradient of the curve of the post-correction luminance characteristic (actual) 288 is a little moderate in comparison with that of the reference luminance characteristic 285. The difference in gradient arises from the fact that the luminance degradation correction value is produced from the luminance characteristic information regarding the correction object luminance characteristic (with error) 286. In particular, since the luminance characteristic of the correction object luminance characteristic (with error) 286 and the actual luminance characteristic of the pixel circuit of the object of correction are different from each other, the luminance characteristic after the correction is displaced by an amount corresponding to this error from the reference luminance characteristic 285.

In this manner, in the case where a degradation characteristic for each temperature is not produced, since the luminance degradation information becomes inaccurate, the correction of the luminance degradation of the pixel circuit becomes inaccurate.

FIG. 18B shows a graph schematically illustrating an example of correction of luminance degradation of a pixel circuit in the first embodiment of the present invention. In FIG. 18B, the axis of abscissa indicates the input gradation value and the axis of ordinate indicates the luminance value, and two graphs including a pre-correction luminance characteristic graph 283 and a post-correction luminance characteristic graph 284 are shown.

The pre-correction luminance characteristic graph (without error) 283 is a graph illustrating an example of correction of luminance degradation of a pixel circuit by the ghosting correction section 200 in the first embodiment of the present invention. The pre-correction luminance characteristic graph (without error) 283 indicates a reference luminance characteristic 285 and a correction object luminance characteristic (without error) 289.

The correction object luminance characteristic (without error) 289 is a luminance characteristic of a pixel circuit of a correction object and is a curve indicative of a luminance characteristic based on luminance degradation information produced accurately, that is, with a high degree of accuracy, using a gradation characteristic for each temperature. In particular, the correction object luminance characteristic (without error) 289 indicates the luminance characteristic indicated by the object luminance characteristic information to be used for correction by the ghosting correction section 200. Further, in FIG. 18B, it is assumed that the correction object luminance characteristic (without error) 289 is similar to the correction object luminance characteristic (actual) 287 described hereinabove with reference to FIG. 18A.

In the first embodiment of the present invention described above with reference to FIG. 18B, a luminance degradation correction value is calculated based on such an accurate luminance characteristic as represented by the correction object luminance characteristic (without error) 289, and change of the gradation value of the image signal is carried out.

The post-correction luminance characteristic graph (without error) 284 illustrates an example of correction result of luminance degradation of a pixel circuit in the case where a degradation characteristic for each temperature is used. The post-correction luminance characteristic graph (without error) 284 indicates that, if an image signal is corrected based on the correction object luminance characteristic (without error) 289, then the luminance value with respect to an input value in a degraded pixel circuit becomes similar to that of the reference luminance characteristic 285.

In this manner, a degraded luminance characteristic for each pixel circuit can be calculated with a high degree of accuracy by the ghosting correction section 200 using a degradation characteristic for each temperature. Then, correction can be carried out accurately by the ghosting correction section 200 using the luminance characteristic calculated with a high degree of accuracy.

It is to be noted that, while, in the description of the first embodiment of the present invention described above, an example wherein the luminance of a pixel circuit in an initial state free from degradation is used as a reference for correction, the present invention is not limited to this. For example, the luminance of a pixel circuit which suffers most from degradation may alternatively be used as a reference for correction.

Example of Display after Correction

Figure 19A:
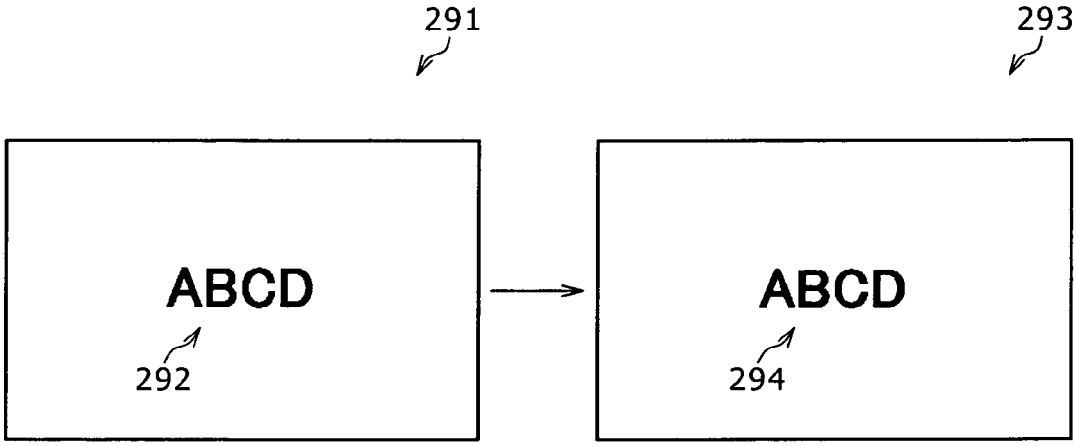
FIGS. 19A and 19B are schematic views illustrating an effect of correction of an image signal by the first embodiment of the present invention.
Figure 19B:
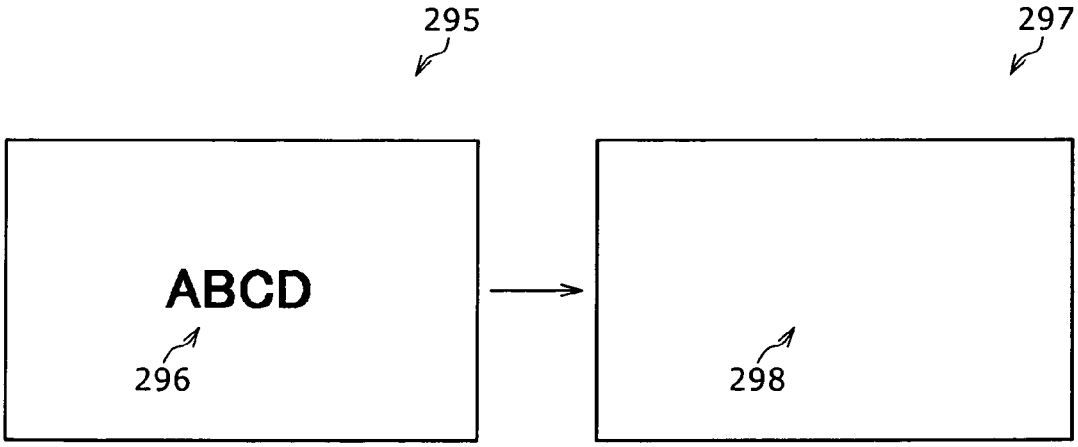

FIGS. 19A and 19B illustrate a concept of an effect of correction of an image signal by the first embodiment of the present invention.

In particular, FIG. 19A illustrates an effect of the correction in the case where a degradation characteristic for each temperature is not produced as described hereinabove with reference to FIG. 18A, and FIG. 19B illustrates an effect of the correction by the first embodiment of the present invention as described hereinabove with reference to FIG. 18B. Here, it is assumed that ghosting of characters "ABCD" appears on the display screen of the display apparatus 100.

FIG. 19A shows a comparative example of a display screen image in the case where a degradation characteristic for each temperature is not produced. It is assumed that an image signal of a high luminance is used to cause the display screen to emit light with a uniform luminance.

A display screen image 291 represents an example of a display image in the case where an image signal which is not in a corrected state is supplied. Meanwhile, a ghosting display region 292 is a region corresponding to those pixels which suffer from ghosting on the display screen image 291, that is, those pixel circuits with regard to which the degree of degradation is high. In FIG. 19A, characters "ABCD" are indicated in gray in the ghosting display region 292. Meanwhile, the region of the display screen image 291 other than the ghosting display region 292, that is, a region of the display screen image 291 represented by blank, corresponds to those pixel circuits which suffer little from degradation. In the case where an image signal is not corrected, since the gradation of the degraded pixel circuits drops in this manner, the characters "ABCD" are displayed in the ghosting display region 292.

A display screen image 293 represents an example of display in the case where a corrected image signal is supplied. A ghosting display region 294 represents a region of the display screen image 291 which corresponds to the ghosting display region 292. In this ghosting display region 294, since the image signal is corrected inaccurately as seen in FIG. 19A, the characters "ABCD" are displayed with a higher luminance than that before the correction although the luminance is lower than that in the other region of the display screen image 291 than the ghosting display region 292. It is to be noted that also the luminance of emitted light from those pixel circuits of the display screen image 293 which suffer little from degradation is corrected so as to be higher than that before the correction although it is lower than that in the other region of the display screen image 291 than the ghosting display region 292.

FIG. 19B shows a comparative example of a display image after correction in the first embodiment of the present invention.

A display screen image 295 represents an example of a display image in the case where an image signal which is not in a corrected form is supplied. Meanwhile, a ghosting display region 296 represents a region corresponding to those pixel circuits which suffer from ghosting in the display screen image 295, that is, those pixel circuits with regard to which the degree of degradation is high. In FIG. 19B, characters "ABCD" are displayed in gray in the ghosting display region 296. Meanwhile, a region of the display screen image 295 other than the ghosting display region 296, that is, a region represented by blank, corresponds, to those pixel circuits which suffer little from degradation. In the case where an image signal is not corrected, since the luminance of the degraded pixel circuits drops in this manner, the characters "ABCD" are displayed in the ghosting display region 296 similarly as in FIG. 19A.

A display screen image 297 represents an example of a display image in the case where a corrected image signal is supplied. Meanwhile, a ghosting display region 298 corresponds to the ghosting display region 296 of the display screen image 295. In this ghosting display region 298, the characters "ABCD" are not displayed because the image signal is corrected accurately and the luminance of emitted light from the degraded pixel circuits becomes equal to that of emitted light of those pixel circuits which suffer little from degradation. It is to be noted that also the luminance of emitted light from the pixel circuits of the display screen image 297 which suffer little from degradation is corrected so as to be equal to the luminance of the pixel circuits in their initial state.

Since the luminance of emitted light by degraded pixel circuits is corrected with a high degree of accuracy so as to be equal to the luminance of emitted light from the pixel circuits in the initial state, ghosting can be eliminated with a high degree of accuracy.

Example of Operation of Ghosting Correction Section

Now, operation of the ghosting correction section 200 in the first embodiment of the present invention is described with reference to the drawings.

Figure 20:
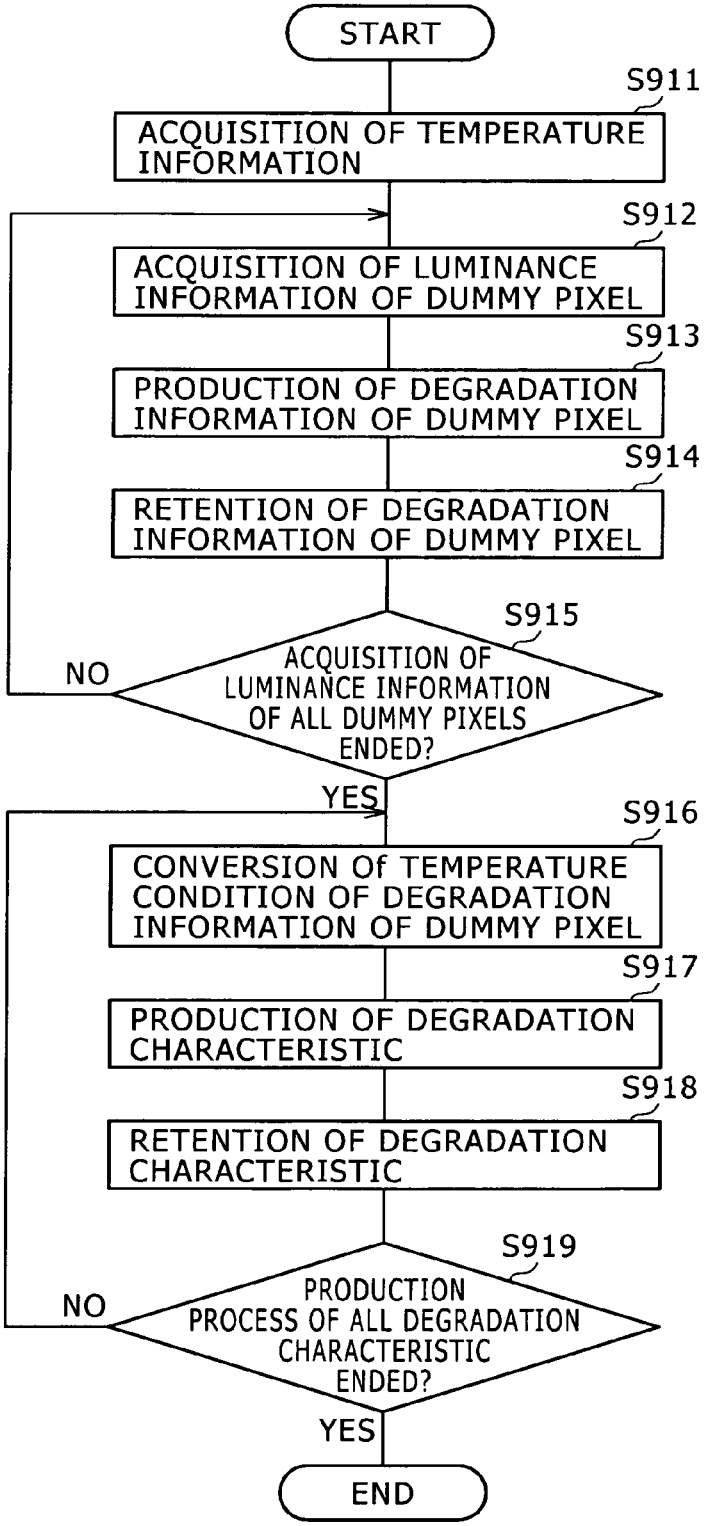
FIG. 20 is a flow chart illustrating an example of a production processing procedure of a degradation characteristic by the luminance degradation characteristic supplying block of FIG. 12.

FIG. 20 illustrates an example of a production processing procedure of a degradation characteristic by the luminance degradation characteristic supplying block 400 of the ghosting correction section 200 in the first embodiment of the present invention. More particularly, FIG. 20 illustrates an example of a processing procedure after dummy pixel luminance information within one measurement period such as, for example, within the measurement period (3) T3 of FIG. 13A till production of a degradation characteristic using the dummy pixel luminance information.

Referring to FIG. 20, temperature information produced by the temperature sensor 141 is acquired by and retained into the temperature information acquisition portion 430 at step S911. Then, information of the luminance of a dummy pixel produced by the luminance sensor 312, that is, dummy pixel luminance information, is acquired by the dummy pixel degradation information production portion 410 at step S912.

Then, information of degradation of the dummy pixel, that is, dummy pixel degradation information, is produced by the dummy pixel degradation information production portion 410 based on the acquired dummy pixel luminance information at step S913. Thereafter, the produced dummy pixel degradation information is retained into the dummy pixel degradation information retaining portion 420 at step S914.

Thereafter, it is decided at step S915 whether or not dummy pixel degradation information regarding all dummy pixel circuits is retained. Then, if it is decided that dummy pixel degradation information regarding all dummy pixel circuits is not retained, then the processing returns to step S912 so that a production process of dummy pixel degradation information regarding a dummy pixel circuit with regard to which dummy pixel degradation information is not retained as yet is carried out.

On the other hand, if it is decided at step S915 that dummy pixel degradation information regarding all dummy pixel circuits is retained, then conversion of a temperature condition of the dummy pixel degradation information is carried out based on the temperature information and the dummy pixel degradation information by the temperature condition conversion portion 440 at step S916. At step S916, calculation period information is produced. Then, a degradation characteristic is produced by the degradation characteristic production portion 460 based on the dummy pixel degradation information and the calculation period information at step S917. Then, the produced degradation characteristic is retained by the degradation characteristic retaining portion 470 at step S918.

Thereafter, it is decided at step S919 whether or not all degradation characteristics for temperatures and luminance values of an object of production of a degradation characteristic are produced. Then, if it is decided that all degradation characteristics for the temperatures and the luminance values are not produced, then the processing returns to step S916 so that a production process for a degradation process which is not produced as yet is carried out.

On the other hand, if it is decided at step S919 that all degradation characteristics for the temperatures and the luminance values are produced, then the degradation characteristic production process by the luminance degradation characteristic supplying block 400 is ended.

Figure 21:
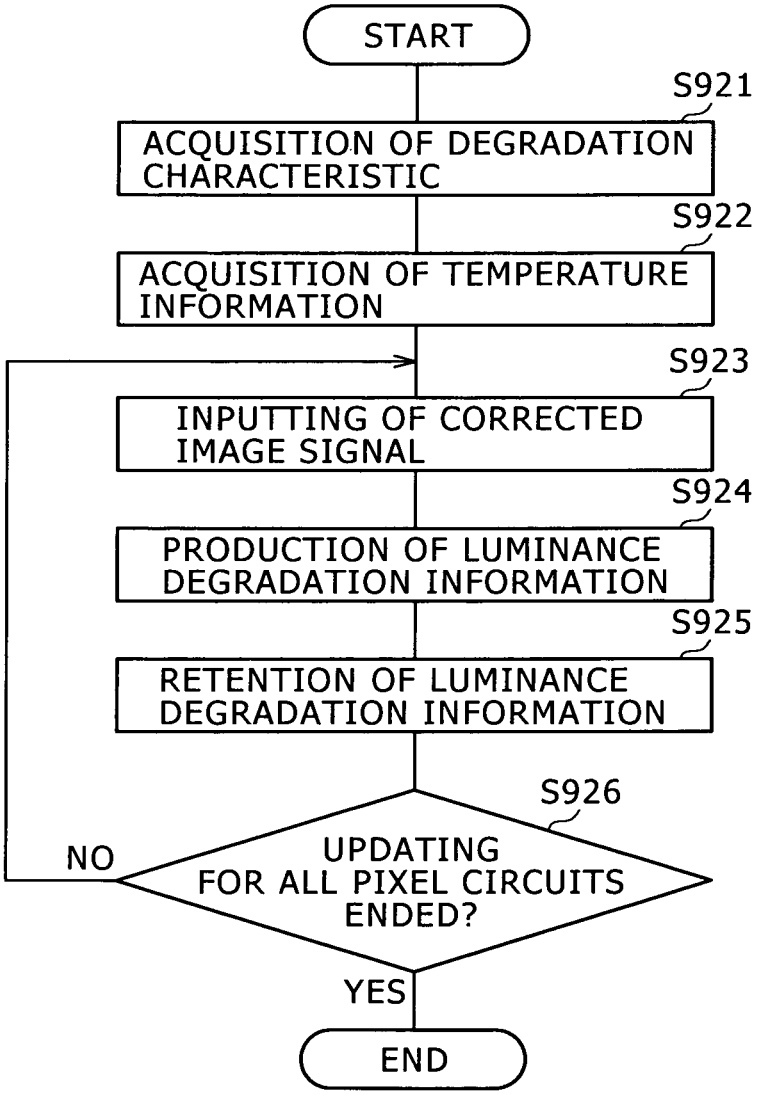
FIG. 21 is a flow chart illustrating an example of an updating processing procedure of luminance degradation information by a luminance degradation information integration block shown in FIG. 11.

FIG. 21 is a flow chart illustrating an example of an updating processing procedure of luminance degradation information by the luminance degradation information integration block 220 of the ghosting correction section 200 in the first embodiment of the present invention.

First at step S921, a degradation characteristic produced by the luminance degradation characteristic supplying block 400 is acquired by the luminance degradation information updating portion 221. Then at step S922, temperature information produced by the temperature sensor 141 is acquired by the luminance degradation information updating portion 221.

Then at step S923, an image signal corrected by the luminance degradation correction arithmetic block 240 is inputted to the luminance degradation information updating portion 221. Thereafter, luminance degradation information is produced by the luminance degradation information updating portion 221 based on the image signal, temperature information and degradation characteristic at step S924. Then at step S925, luminance degradation information retained in the luminance degradation information retaining portion 222 is updated with the luminance degradation information produced by the luminance degradation information updating portion 221. In particular, the luminance degradation information produced by the luminance degradation information updating portion 221 is retained into the luminance degradation information retaining portion 222 to update the luminance degradation information in the luminance degradation information retaining portion 222. It is to be noted that the step S924 is an example of a luminance degradation information production procedure.

Thereafter, it is decided at step S926 whether or not luminance degradation information is updated with regard to all pixel circuits which configure the display screen. Then, if it is decided that the luminance degradation is not updated with regard to all pixel circuits, then the processing returns to step S923 so that an updating process of the luminance degradation information regarding a pixel circuit with regard to which the luminance degradation information is not updated as yet is carried out.

On the other hand, if it is decided at step S926 that updating is carried out with regard to all pixel circuits which configure the display screen, then the luminance degradation information updating process by the luminance degradation information integration block 220 is ended.

Figure 22:
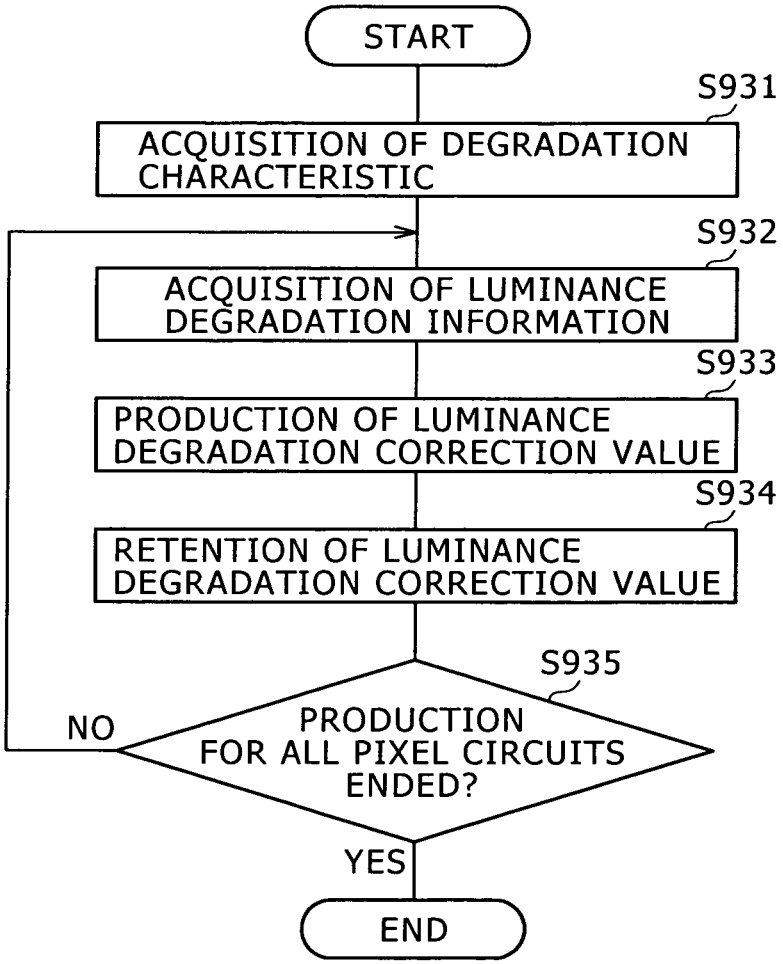
FIG. 22 is a flow chart illustrating an example of a production processing procedure of a luminance degradation correction pattern by a luminance degradation correction pattern production block shown in FIG. 11.

FIG. 22 is a flow chart illustrating a luminance degradation correction pattern production processing procedure by the luminance degradation correction pattern production block 230 of the ghosting correction section 200 in the first embodiment of the present invention.

First at step S931, a degradation characteristic necessary to carry out the degree of degradation of a pixel circuit from luminance degradation information is acquired by the object luminance characteristic information production portion 232.

Then, from within luminance degradation information retained in the luminance degradation information retaining portion 222, luminance degradation information of a pixel circuit of an object of production of luminance degradation information is acquired by the object luminance characteristic information production portion 232 at step S932. Upon the acquisition of the luminance degradation information, object luminance characteristic information is produced from the acquired luminance degradation information by the object luminance characteristic information production portion 232.

Then at step S933, a luminance degradation correction value is produced based on the reference luminance characteristic information and the object luminance characteristic information by the luminance degradation correction value calculation portion 233. Then, the produced luminance degradation correction value is retained into the luminance degradation correction pattern retaining portion 234 at step S934. It is to be noted that the step S933 is an example of a luminance degradation value calculation procedure.

Thereafter, it is decided at step S935 whether or not a luminance degradation correction value is produced with regard to all pixel circuits which configure the display screen. Then, if it is decided that a luminance degradation correction value is not produced with regard to all pixel circuits, then the processing returns to step S932 so that a production process of a luminance degradation correction value which is not produced as yet is carried out.

On the other hand, if it is decided at step S935 that a luminance degradation correction value is produced with regard to all pixel circuits which configure the display screen and a luminance degradation correction pattern is retained, then the luminance degradation correction pattern production process by the luminance degradation correction pattern production block 230 is ended.

Figure 23:
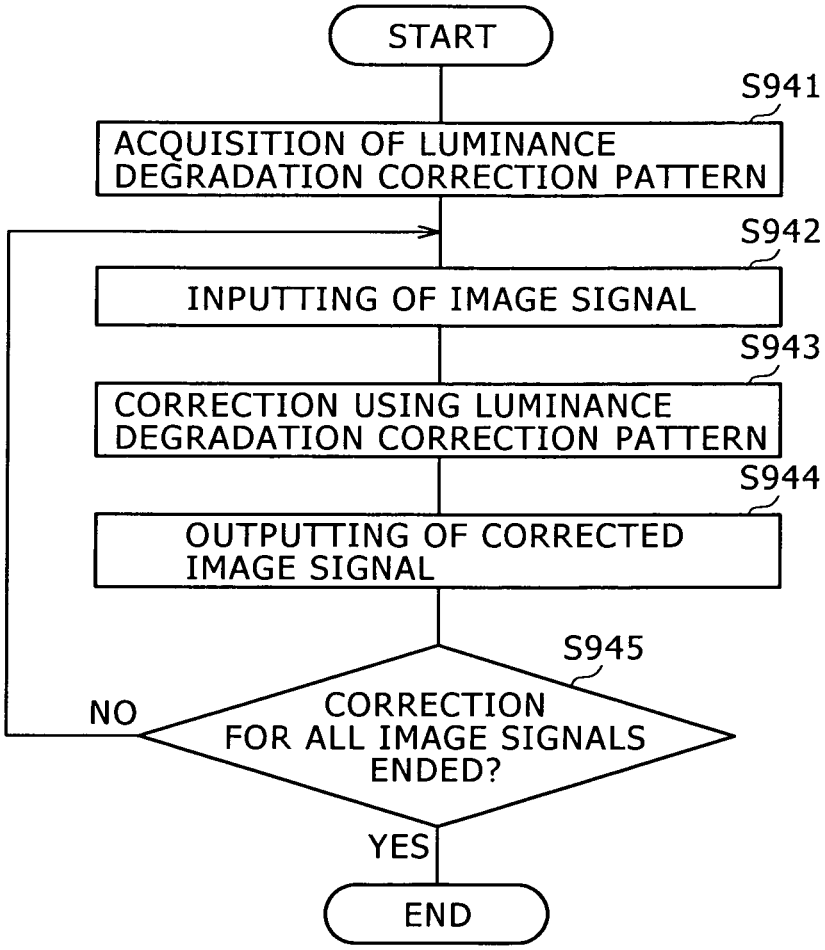
FIG. 23 is a flow chart illustrating an example of a correction processing procedure of an image signal by a luminance degradation correction arithmetic block shown in FIG. 11.

FIG. 23 is a flow chart illustrating an image signal correction processing procedure by the luminance degradation correction arithmetic block 240 of the ghosting correction section 200 in the first embodiment of the present invention. The present process is directed to an example of a correction process for an image signal with regard to one frame.

First at step S941, a luminance degradation correction pattern retained in the luminance degradation correction pattern retaining portion 234 is acquired by the luminance degradation correction arithmetic block 240.

Then at step S942, the image signal is inputted to the luminance degradation correction arithmetic block 240 through the signal line 201. Then, correction of the image signal is carried out for each of the pixel circuits using the luminance degradation correction values of the luminance degradation correction pattern by the luminance degradation correction arithmetic block 240 at step S943. Then, the corrected image signal is outputted at step S944. It is to be noted that the step S943 is an example of a correction procedure.

Thereafter, it is decided at step S945 whether or not all image signals which configure the one frame to be displayed are corrected. Then, if it is decided that the image signal is not corrected with regard to all pixel circuits, then the processing returns to step S942 so that a correction process of an image signal which is not corrected as yet is carried out.

On the other hand, if an image signal with regard to all pixel circuits which configure the one frame to be displayed is corrected at step S945, then the image signal correction process by the luminance degradation correction arithmetic block 240 is ended.

In this manner, according to the first embodiment of the present invention, the gradation values of the image signal can be changed with a high degree of accuracy so that the luminance of emitted light from a degraded pixel circuit may coincide with the luminance of emitted light from the pixel circuit in its initial state.

It is to be noted that, while, in the first embodiment of the present invention, a pixel circuit in an initial state is used as a reference, also a method may be used wherein correction of ghosting is carried out with reference to a degraded pixel circuit.

2. Second Embodiment

In the first embodiment of the present invention, in order to calculate a degradation characteristic for each temperature, the temperature condition conversion portion 440 is used to carry out temperature condition conversion to produce calculation period information. The temperature condition conversion portion 440 uses a difference in degradation characteristic (refer to FIG. 8) which depends upon the temperature retained in advance to calculate calculation period information based on dummy pixel degradation information and temperature information. In other words, in the first embodiment of the present invention, in order to produce a degradation characteristic for each temperature, it is necessary to retain information regarding the difference in degradation characteristic which depends upon the temperature in advance. Therefore, if the information regarding the difference in degradation characteristic has some error with respect to an actual value, then there is the possibility that the degradation characteristic becomes inaccurate. Therefore, it seems a possible idea to use a display apparatus which acquires dummy pixel degradation information for each temperature to calculate a degradation characteristic for each temperature without using the temperature condition conversion portion 440.

In a second embodiment of the present invention, dummy pixel degradation information for each temperature is acquired using a dummy pixel circuit which is degraded only at a predetermined temperature.

Example of Configuration of Display Apparatus

Figure 24:
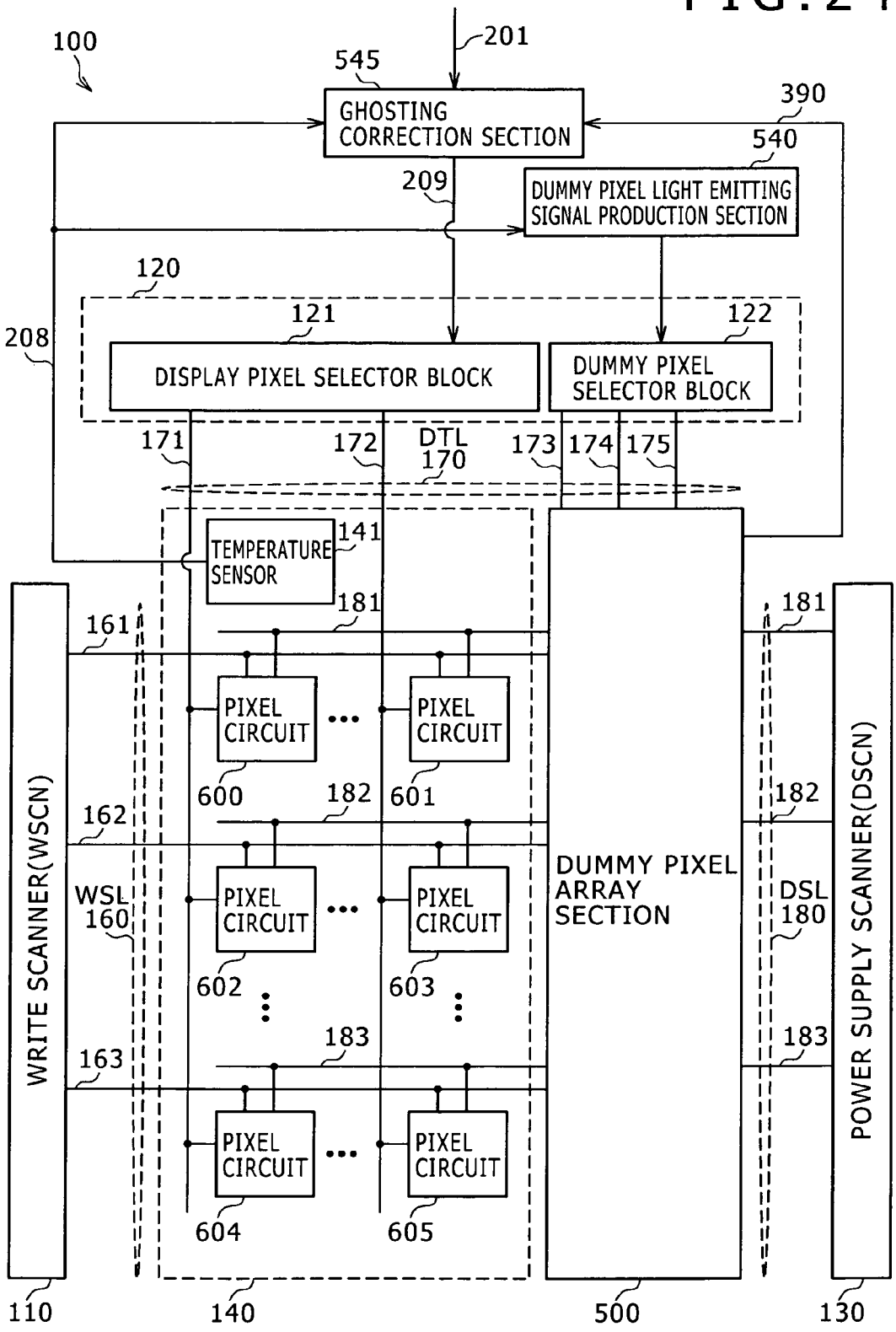
FIG. 24 is a block diagram showing an example of a configuration of a display apparatus according to a second embodiment of the present invention.

FIG. 24 is a block diagram showing an example of a configuration of the display apparatus 100 according to the second embodiment of the present invention. The display apparatus 100 shown in FIG. 24 includes some common components to the display apparatus 100 according to the first embodiment of the present invention described hereinabove with reference to FIG. 1. The following description is given principally of differences of the display apparatus 100 according to the second embodiment from the display apparatus 100 of the first embodiment.

Referring to FIG. 24, the display apparatus 100 is common in configuration to the display apparatus 100 described hereinabove with reference to FIG. 1 except a dummy pixel array section 500, a dummy pixel light emitting signal production section 540 and a ghosting correction section 545. Therefore, the dummy pixel light emitting signal production section 540 and the ghosting correction section 545 are described with reference to FIG. 24. It is to be noted that the dummy pixel array section 500 is hereinafter described with reference to FIG. 25.

The display apparatus 100 includes a number of dummy pixel circuits greater than that of the dummy pixel array section 300 described hereinabove with reference to FIG. 1, and therefore includes, as an example, data lines (DTL) 174 and 175 in addition to the data line (DTL) 173.

The dummy pixel light emitting signal production section 540 produces a light emission signal similarly to the dummy pixel light emitting signal production section 150 described hereinabove with reference to FIG. 1. The dummy pixel light emitting signal production section 540 determines based on temperature information supplied thereto through the signal line 208 whether or not light is emitted from the dummy pixel circuits of the dummy pixel array section 500. The dummy pixel light emitting signal production section 540 produces a light emission signal in response to the determination and supplies the produced light emission signal to the dummy signal selector section 122.

The ghosting correction section 545 changes the gradation value of an image signal in accordance with the degree of degradation of each of the pixel circuits 600 to 605 to correct ghosting similarly as in the ghosting correction section 200 described hereinabove with reference to FIG. 1. This ghosting correction section 545 includes a luminance degradation characteristic supplying block 550 in place of the luminance degradation characteristic supplying block 400 of the ghosting correction section 200. It is to be noted that the luminance degradation characteristic supplying block 550 is hereinafter described with reference to FIGS. 26 to 29C. Meanwhile, the other components of the ghosting correction section 545 than the luminance degradation characteristic supplying block 550 are similar to those of the ghosting correction section 200 described hereinabove with reference to FIG. 11, and therefore, overlapping description of them is omitted herein to avoid redundancy.

In this manner, whether or not light is emitted from the dummy circuits is determined based on the ambient temperature of the dummy pixel circuits by the dummy pixel light emitting signal production section 540.

Example of Configuration of Dummy Pixel Array Section

Figure 25:
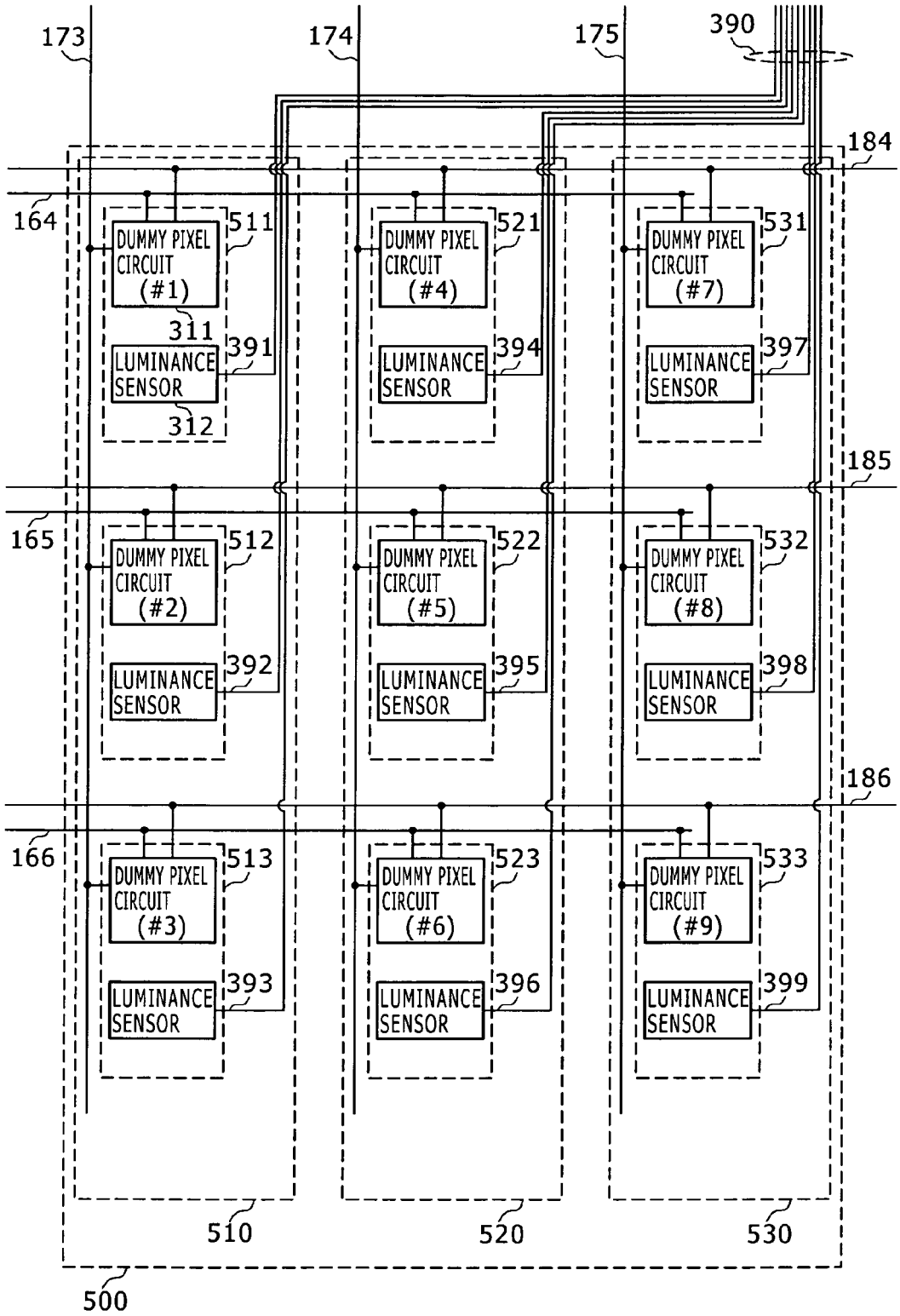
FIG. 25 is a block diagram showing an example of a configuration of a dummy pixel array section shown in FIG. 24.

FIG. 25 is a block diagram showing an example of a configuration of the dummy pixel array section 500 in the second embodiment of the present invention. It is to be noted that, in the second embodiment of the present invention, degradation of the pixel circuit 600 is measured based on a light emission signal of three gradation values.

Referring to FIG. 25, nine luminance detection units, that is, luminance detection units 511 to 513, 521 to 523 and 531 to 533, and three light emission regions, that is, a first light emission region 510, a second light emission region 520 and a third light emission region 530, which classify the luminance detection units are shown.

The luminance detection units 511 to 513, 521 to 523 and 531 to 533 are similar to the luminance detection unit 310 described hereinabove with reference to FIG. 9, and therefore, description of them is omitted herein to avoid redundancy. It is to be noted that, in FIG. 25, the dummy pixel circuits for the luminance detection units 511 to 513, 521 to 523 and 531 to 533 are identified by numbers #1 to #9 added annexed thereto.

The first light emission region 510 emits light only at a particular temperature, that is, at a first temperature, and indicates luminance detection units, that is, the luminance detection units 511 to 513, with regard to which measurement of degradation is carried out based on the emitted light. For example, in the case where the first temperature is "20±2° C.," a data signal is supplied to the dummy pixel circuits #1 to #3 in the first light emission region 510 so that light is emitted only when the temperature information represents "20±2° C."

The second light emission region 520 emits light only at another particular temperature different from the first temperature, that is, at a second temperature, and indicates luminance detection units, that is, the luminance detection units 521 to 523, with regard to which measurement of degradation is carried out based on the emitted light. For example, in the case where the second temperature is "30±2° C.," a data signal is supplied to the dummy pixel circuits #4 to #6 in the second light emission region 520 so that light is emitted only when the temperature information represents "30±2° C."

The third light emission region 530 emits light only at a particular temperature different from the first and second temperatures, that is, at a third temperature, and indicates luminance detection units, that is, the luminance detection units 531 to 533, with regard to which measurement of degradation is carried out based on the emitted light. For example, in the case where the third temperature is "40±2° C.," a data signal is supplied to the dummy pixel circuits #7 to #9 in the third light emission region 530 so that light is emitted only when the temperature information represents "40±2° C."

By providing many dummy pixel circuits and luminance sensors in the dummy pixel array section 500 in this manner, the dummy pixel circuits which emit light only at predetermined temperatures can be provided in the dummy pixel array section 500.

Figure 26:
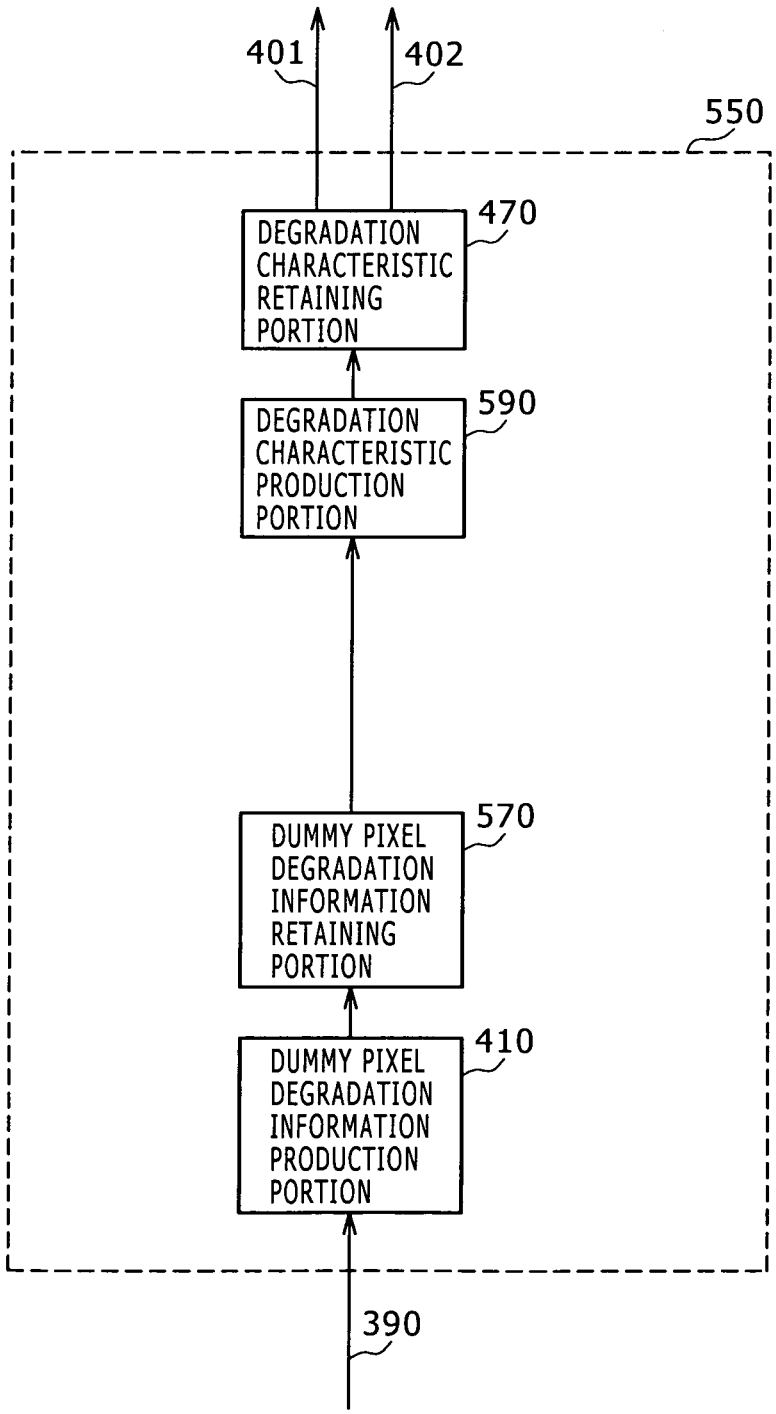
FIG. 26 is a block diagram showing an example of a functional configuration of a luminance degradation characteristic supplying block shown in FIG. 24.

Example of Configuration of Luminance Degradation Characteristic Supplying Block FIG. 26 is a block diagram showing an example of a functional configuration of the luminance degradation characteristic supplying block 550 in the second embodiment of the present invention. The luminance degradation characteristic supplying block 550 includes a dummy pixel degradation information production portion 410, a dummy pixel degradation information retaining portion 570, a degradation characteristic production portion 590, and a degradation characteristic retaining portion 470. It is to be noted that the dummy pixel degradation information production portion 410 and the degradation characteristic retaining portion 470 are similar to the degradation characteristic retaining portion 470 described hereinabove with reference to FIG. 12, and therefore, overlapping description of them is omitted herein to avoid redundancy.

The dummy pixel degradation information retaining portion 570 retains dummy pixel degradation information similarly to the dummy pixel degradation information retaining portion 420 described hereinabove with reference to FIG. 12. The dummy pixel degradation information retaining portion 570 retains, for example, dummy pixel degradation information regarding the individual dummy pixel circuits. The dummy pixel degradation information retaining portion 570 supplies the dummy pixel degradation information retained therein to the degradation characteristic production portion 590. It is to be noted that an example of the dummy pixel degradation information retained in the dummy pixel degradation information retaining portion 570 is hereinafter described with reference to FIGS. 27 and 28.

The degradation characteristic production portion 590 calculates a degradation characteristic at a particular temperature based on dummy pixel degradation information. The degradation characteristic production portion 590 calculates a degradation characteristic at the first temperature, that is, at 20±2° C., from dummy pixel degradation information of the dummy pixel circuits in the first light emission region 510 shown in FIG. 25. The degradation characteristic production portion 590 retains the calculated degradation characteristic into the degradation characteristic retaining portion 470. It is to be noted that an example of production of a degradation characteristic by the degradation characteristic production portion 590 is hereinafter described with reference to FIGS. 29A to 29C.

Example of Luminance Measurement

Figure 27:
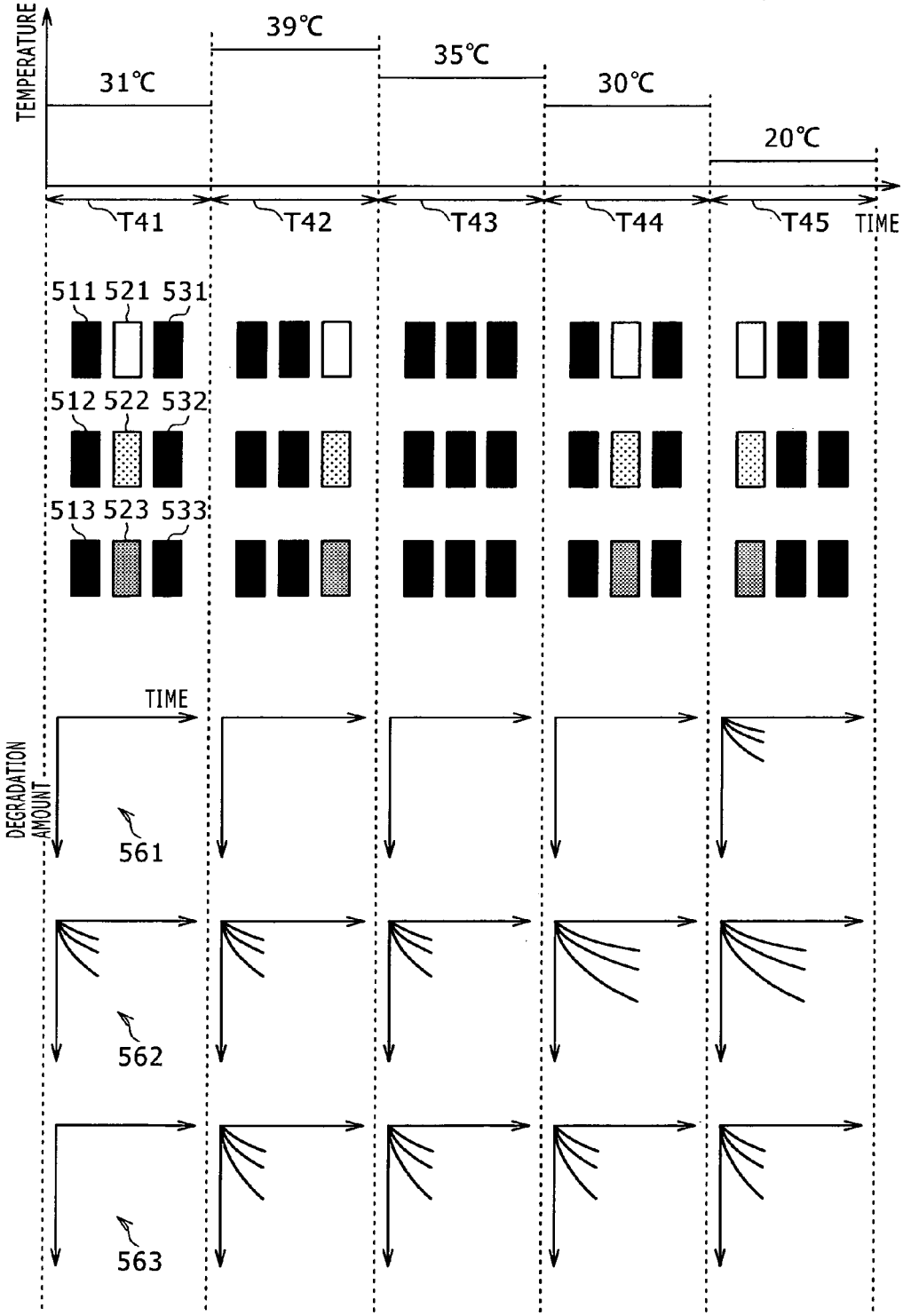
FIG. 27 is a diagrammatic view illustrating an example of luminance measurement by nine luminance sensors used in the display apparatus of FIG. 24.

FIG. 27 illustrates an example of luminance measurement by the nine luminance sensors in the second embodiment of the present invention.

Referring to FIG. 27, the axis of ordinate indicates the temperature and the axis of abscissa indicates the measurement period, and temperatures within five successive measurement periods, that is, within measurement periods (1) T41 to (5) T45, are illustrated by graphs. Further, in FIG. 27, those dummy pixels which emit light within the five measurement periods are represented by rectangles indicative of the luminance detection units 511 to 513, 521 to 523 and 531 to 533 are shown. Further, in FIG. 27, graphs schematically illustrating the degradation amounts of the dummy pixel circuits within the measurement periods, that is, a 20° C. degradation characteristic 561, a 30° C. degradation characteristic 562 and a 40° C. degradation characteristic 563 are shown.

It is to be noted here that, in FIG. 27, the temperature within the first time measurement period, that is, within the measurement period (1) T41, is "31° C."; the temperature within the second time measurement period, that is, within the measurement period (2) T42, is "39° C."; the temperature within the third time measurement period, that is, within the measurement period (3) T43, is "35° C."; the temperature within the fourth time measurement period, that is, within the measurement period (4) T44, is "30° C."; and the temperature within the fifth time measurement period, that is, within the measurement period (5) T45, is "20° C."

Here, measurement of the luminance in the second embodiment of the present invention is described with reference to the first to third measurement periods T41 to T43.

First, within the measurement period (1) T41, temperature information representative of "31° C." is supplied to the dummy pixel light emitting signal production section 540 through the signal line 208. Then, a light emission signal of a predetermined gradation value is supplied from the dummy pixel light emitting signal production section 540 to those dummy pixel circuits which emit light only at the second temperature, that is, at 30±2° C., particularly to the dummy pixel circuits #4 to #6 of the luminance detection units 521 to 523. It is to be noted that, to the other dummy pixel circuits, a light emission signal of the luminance value "0" is supplied in order to place them into a no-light emitting state. Consequently, the dummy pixel circuits of the luminance detection units 521 to 523 emit light based on the predetermined gradation value while the dummy pixel circuits of the luminance detection units 511 to 513 and 531 to 533 do not emit light.

In FIG. 27 which shows schematic views illustrating the light emission states, in FIG. 27, the luminance detection unit 521 which emits light with the gradation value "200" is indicated by a blank rectangle while the luminance detection unit 522 which emits light with the gradation value "150" is indicated by a light gray rectangle. Meanwhile, the luminance detection unit 523 which emits light with the gradation value "100" is indicated by a deep gray rectangle, and the other luminance detection units 511 to 513 and 531 to 533 which emit no light are indicated by dark rectangles.

Further, in FIG. 27, the 20° C. degradation characteristic 561 is illustrated as a graph indicative of a gradation state of the dummy pixel circuits of the luminance detection units 511 to 513. Further, as a graph indicating a degradation state of the dummy pixel circuits of the luminance detection units 521 to 523, the 30° C. degradation characteristic 562 is illustrated. Furthermore, as a graph illustrating a degradation state of the dummy pixel circuits of the luminance detection units 531 to 533, the 40° C. degradation characteristic 563 is illustrated.

Since the dummy pixel circuits of the luminance detection units 521 to 523 are degraded within this measurement period (1) T41, on the 30° C. degradation characteristic 562 illustrated within the measurement period (1) T41, a solid line indicating the degradation of the measured dummy pixel circuits is shown.

Meanwhile, since the dummy pixel circuits of the luminance detection units 511 to 513 are not degraded within the measurement period (1) T41, on the 20° C. degradation characteristic 561 illustrated within the measurement period (1) T41, a solid line representative of degradation of the measured dummy pixel circuits is not shown. Further, since also the dummy pixel circuits of the luminance detection units 531 to 533 are not degraded within the measurement period (1) T41, on the 40° C. degradation characteristic 563 shown within the measurement period (1) T41, a solid line indicative of degradation of the measured dummy pixel circuits is not shown.

Then, within the measurement period (2) T42, a light emission signal of a predetermined gradation value is supplied based on temperature information indicative of "39° C." to the dummy pixel circuits which emit light only at the third temperature of 40±2° C., that is, to the dummy pixel circuits of the luminance detection units 531 to 533. Consequently, the dummy pixel circuits of the luminance detection units 521 to 523 emit light based on the predetermined gradation value (white, light gray and deep gray rectangles). On the other hand, the dummy pixel circuits of the luminance detection units 511 to 513 and 531 to 533 do not emit light (dark rectangles).

As a result of the light emission within the measurement period (2) T42, the dummy pixel circuits of the luminance detection units 531 to 533 are degraded within the measurement period (2) T42 (addition of a solid line to the 40° C. degradation characteristic 563 within the measurement period (2) T42). Meanwhile, the dummy pixel circuits of the luminance detection units 511 to 513 are not degraded within the measurement period (2) T42 (the 20° C. degradation characteristic 561 within the measurement period (2) T42 is same as that within the measurement period (1) T41). Also the dummy pixel circuits of the luminance detection units 521 to 523 are not degraded within the measurement period (2) T42 (the 30° C. degradation characteristic 562 within the measurement period (2) T42 is same as that within the measurement period (1) T41).

Then, within the measurement period (3) T43, the temperature information indicates "35° C." This temperature "35° C." does not belong to any of the first temperature of 20±2° C., second temperature of 30±2° C. and third temperature of 40±2° C. Therefore, the dummy pixel light emitting signal production section 540 supplies a light emission signal which has the gradation value "0" and renders a dummy pixel circuit into a no-light emitting state to all dummy pixel circuits. Consequently, the luminance detection units 511 to 513, 521 to 523 and 531 to 533 emit no light (dark rectangles).

Within the measurement period (3) T43, since all dummy pixel circuits emit no light, no dummy pixel circuit is degraded (the three degradation characteristics 561 to 563 within the measurement period (3) T43 are same as the degradation characteristics within the measurement period (2) T42).

By using dummy pixel circuits which emit light only at predetermined temperatures in this manner, degradation of the dummy pixel circuits at each temperature can be measured.

Example of Dummy Pixel Degradation Information

FIG. 28 illustrates an example of dummy pixel degradation information in the second embodiment of the present invention.

FIG. 28 particularly shows a table which schematically illustrates an example of dummy pixel degradation information retained in the dummy pixel degradation information retaining portion 570 at the end of the measurement period (5) T45 illustrated in FIG. 27. It is to be noted that, in FIG. 28, the intensity of the luminance, that is, dummy pixel luminance information, upon measurement as represented by a rate (%) to that of the dummy pixel circuits in their initial state is represented as dummy pixel degradation information.

A column 571 of FIG. 28 represents dummy pixel degradation information of the dummy pixel circuits regarding the first time measurement period. Meanwhile, another column 572 represents dummy pixel degradation information of the dummy pixel circuits regarding the second time measurement period.

Here, the dummy pixel degradation information in the table of FIG. 28 is described.

In the column 571 of the dummy pixel circuits #1 to #3, an example of degradation amounts based on light emission by the dummy pixel circuits #1 to #3 of the luminance detection units 511 to 513 within the measurement period (5) T45 (refer to FIG. 27) is illustrated, respectively. Meanwhile, in the column 571 of the dummy pixel circuits #4 to #6, an example of degradation amounts based on light emission by the dummy pixel circuits #4 to #6 of the luminance detection units 521 to 523 within the measurement period (1) T41 is illustrated, respectively. Further, in the column 571 of the dummy pixel circuits #7 to #9, an example of degradation amounts based on light emission by the dummy pixel circuits #7 to #9 of the luminance detection units 531 to 533 within the measurement period (2) T42 is illustrated, respectively.

It is to be noted that, since the dummy pixel circuits #1 to #3 and the dummy pixel circuits #7 to #9 do not emit light for the second time light emission within the measurement periods T41 to T45, "-" which represents that no dummy pixel degradation information is applicable is indicated in the column 572 with regard to the dummy circuits #1 to #3 and the dummy pixel circuits #7 to #9. Further, in the column 572 with regard to the dummy pixel circuits #4 to #6, an example of degradation amounts based on light emission within the measurement period (4) T44 illustrated in FIG. 27 is illustrated.

In this manner, dummy pixel degradation information of the dummy pixel circuits is retained in the dummy pixel degradation information retaining portion 570 in accordance with the number of times of light emission of the dummy pixel circuits.

Example of Degradation Characteristics at Plurality of Temperatures

Figure 29A:
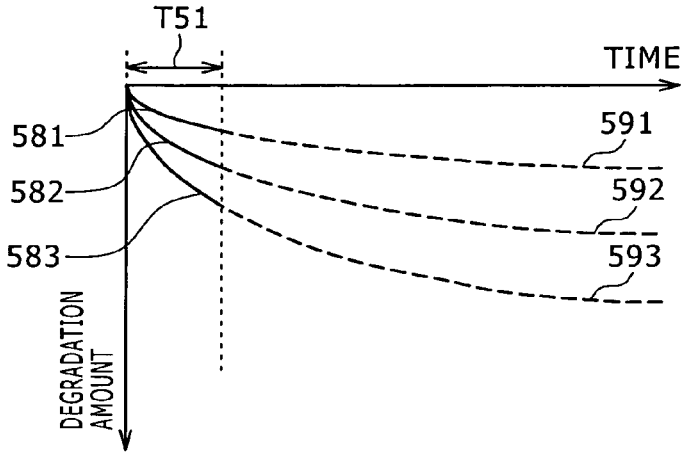
FIGS. 29A to 29C are diagrams schematically illustrating an example of degradation characteristics for individual temperatures produced by a degradation characteristic production portion shown in FIG. 26.
Figure 29B:
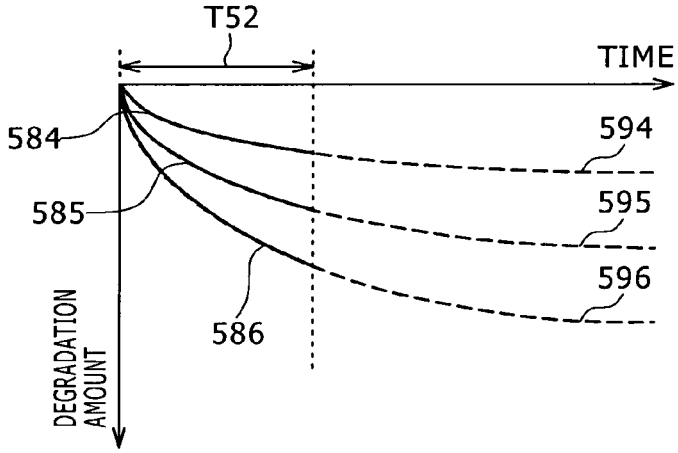
Figure 29C:
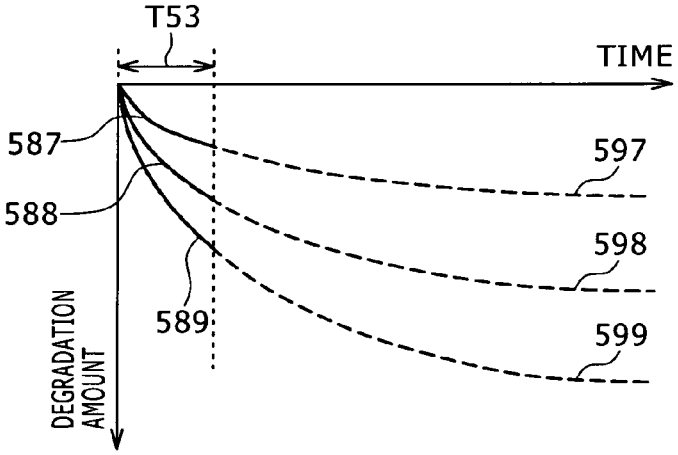

FIGS. 29A to 29C schematically illustrate an example of a degradation characteristic for each temperature produced by the degradation characteristic production portion 590 in the second embodiment of the present invention.

It is to be noted that, in FIGS. 29A to 29C, it is assumed that a degradation characteristic is produced based on the dummy pixel degradation information illustrated in FIG. 28 as an example.

FIG. 29A shows a graph schematically illustrating degradation characteristics in the temperature condition of "20±2° C." In this graph, degradation characteristics regarding degradation of the dummy pixel circuits #1 to #3 which emit light only at the first temperature of 20±2° C. are indicated by solid line curves, that is, by measurement degradation characteristics 581 to 583. Further, degradation characteristics calculated from the measurement degradation characteristics 581 to 583, that is, degradation characteristics 591 to 593, are indicated by broken line curves.

FIG. 29A further illustrates a use period T51 within which the dummy circuits #1 to #3 are driven to emit light.

FIG. 29B shows a graph schematically illustrating degradation characteristics in the temperature condition of "30±2° C." In this graph, degradation characteristics regarding degradation of the dummy pixel circuits #4 to #6 which emit light only at the second temperature of 30±2° C. are indicated by solid line curves, that is, by measurement degradation characteristics 584 to 586. Further, degradation characteristics calculated from the measurement degradation characteristics 584 to 586, that is, degradation characteristics 594 to 596, are indicated by broken line curves.

Further, FIG. 29B illustrates a use period T52 within which the dummy circuits #4 to #6 are driven to emit light. It is to be noted that, since the number of times of light emission of the dummy pixel circuits #4 to #6 is greater than that of the dummy pixel circuits #1 to #3 as seen from the table of FIG. 28, the use period T52 is represented by a period longer than the use period T51. Similarly, also the measurement degradation characteristics 584 to 586 are indicated by solid lines longer than those of the measurement degradation characteristics 581 to 583.

FIG. 29C shows a graph schematically illustrating degradation characteristics in the temperature condition of "40±2° C." In this graph, degradation characteristics regarding degradation of the dummy pixel circuits #7 to #9 which emit light only at the third temperature of 40±2° C. are indicated by solid line curves, that is, by measurement degradation characteristics 587 to 589. Further, degradation characteristics calculated from the measurement degradation characteristics 587 to 589, that is, degradation characteristics 597 to 599, are indicated by broken line curves.

FIG. 29C further illustrates a use period T53 within which the dummy circuits #7 to #9 are driven to emit light.

In this manner, degradation characteristics in a plurality of temperature conditions are produced based on measurement degradation characteristics in the plural temperature conditions by the degradation characteristic production portion 590.

Example of Operation of Luminance Degradation Characteristic Supplying Block

Now, operation of the luminance degradation characteristic supplying block 550 in the second embodiment of the present invention is described with reference to the drawings.

Figure 30:
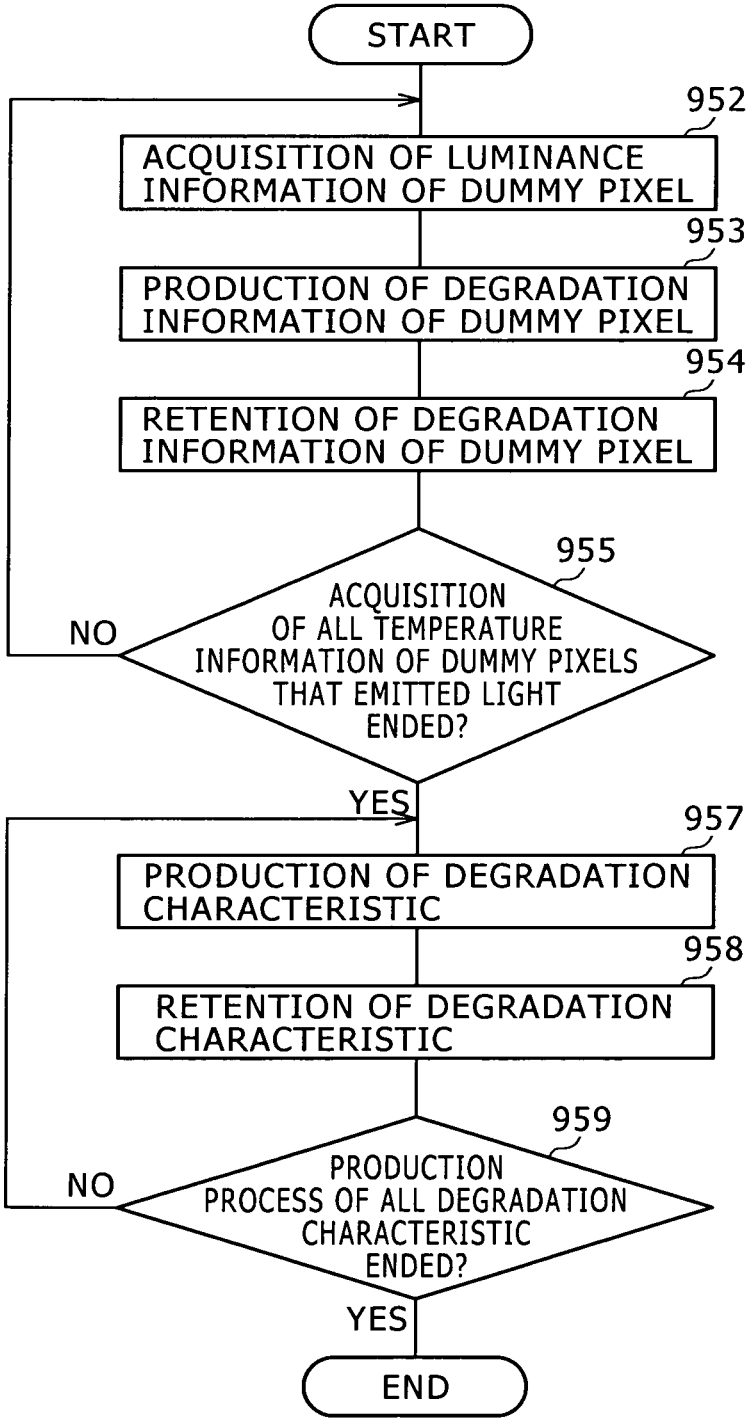
FIG. 30 is a flow chart illustrating an example of a production processing procedure of a degradation characteristic by the luminance degradation characteristic supplying block of FIG. 26.

FIG. 30 is a flow chart illustrating an example of a production processing procedure of a degradation characteristic by the luminance degradation characteristic supplying block 550 of the ghosting correction section 545 in the second embodiment of the present invention. FIG. 30 particularly illustrates an example of a processing procedure after acquisition of dummy pixel luminance information within one measurement period till production of a degradation characteristic using the dummy pixel luminance information.

First at step S952, luminance information of a dummy pixel produced by a luminance sensor, that is, dummy pixel luminance information, is acquired by the dummy pixel degradation information production portion 410.

Then at step S953, degradation information of the dummy pixel, that is, dummy pixel degradation information, is produced based on the acquired dummy pixel luminance information by the dummy pixel degradation information production portion 410. Then at step S954, the produced dummy pixel degradation information is retained into the dummy pixel degradation information retaining portion 570.

Thereafter, it is decided at step S955 whether or not dummy pixel degradation information regarding all dummy pixel circuits from which light is emitted is retained. Then, if it is decided that dummy pixel degradation information regarding all dummy pixel circuits from which light is emitted is not retained, then the processing returns to step S952 so that a production process of dummy pixel degradation information which is not retained as yet with regard to any of the dummy pixel circuits from which light is emitted is carried out.

On the other hand, if it is decided at step S955 that dummy pixel degradation information regarding all dummy pixel circuits from which light is emitted is retained, then a degradation characteristic is produced based on the retained dummy pixel degradation information by the degradation characteristic production portion 590 at step S957. Then, the produced degradation characteristic is retained into the degradation characteristic retaining portion 470 at step S958.

Thereafter, it is decided at step S959 whether or not all degradation characteristics for the individual temperatures and the individual luminance values are produced. If it is decided that all degradation characteristics for the individual temperatures and the individual luminance values are not produced, then the processing returns to step S957 so that a production process for a degradation characteristic which is not produced as yet is carried out.

On the other hand, if it is decided at step S959 that all degradation characteristics for the individual temperatures and the individual luminance values are produced, then the production processing procedure of a degradation characteristic by the luminance degradation characteristic supplying block 550 is ended.

Example of Operation of Dummy Pixel Light Emitting Signal Production Section

Now, operation of the dummy pixel light emitting signal production section 540 in the second embodiment of the present invention is described with reference to the drawings.

Figure 31:
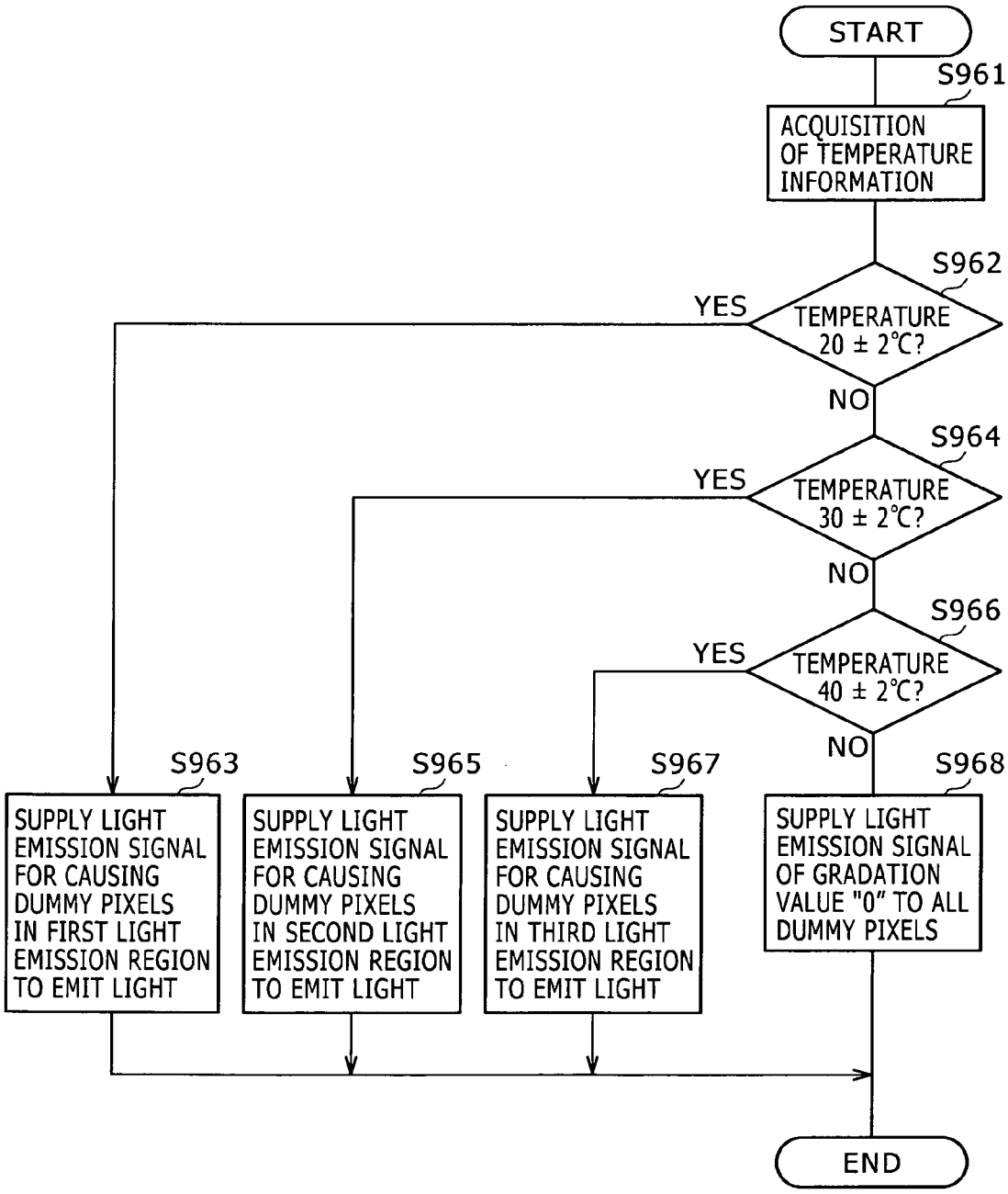
FIG. 31 is a flow chart illustrating an example of a production processing procedure of a light emission signal by a dummy pixel light emission signal production section shown in FIG. 24.

FIG. 31 is a flow chart illustrating a production processing procedure of a light emission signal by the dummy pixel light emitting signal production section 540 in the second embodiment of the present invention.

Referring to FIG. 31, temperature information produced by the temperature sensor 141 is acquired by the dummy pixel light emitting signal production section 540 first at step S961.

Then at step S962, it is decided by the dummy pixel light emitting signal production section 540 whether or not the temperature indicated by the acquired temperature is "20±2° C." Then, if it is decided that the acquired temperature is "20±2° C.," then a light emission signal for causing the dummy pixel circuits in the first light emission region 510 is supplied to the dummy pixel selector block 122 at step S963. It is to be noted that the light emission signals supplied to the dummy pixel circuits in the second light emission region 520 and the third light emission region 530 at step S963 are light emission signals for causing the dummy pixel circuits not to emit light, that is, light emission signals of the gradation value "0." Then, the production processing procedure of a light emission signal by the dummy pixel light emitting signal production section 540 is ended.

On the other hand, if it is decided at step S962 that the acquired temperature is not "20±2° C.," then it is decided at step S964 whether or not the acquired temperature is "30±2° C." Then, if it is decided that the acquired temperature is "30±2° C.," then alight emission signal for causing the dummy pixel circuits in the second light emission region 520 to emit light is supplied to the dummy pixel selector block 122 at step S965. It, is to be noted that the light emission signals supplied to the dummy pixel circuits in the first light emission region 510 and the third light emission region 530 at step S965 are light emission signals for causing the dummy pixel circuits not to emit light, that is, light emission signals of the gradation value "0." Then, the production processing procedure of a light emission signal by the dummy pixel light emitting signal production section 540 is ended.

On the other hand, if it is decided at step S964 that the acquired temperature is not "30±2° C.," then it is decided at step S966 whether or not the acquired temperature is "40±2° C." If it is decided that the acquired temperature is "40±2° C.," then a light emission signal for causing the dummy pixel circuits in the third light emission region 530 to emit light is supplied to the dummy pixel selector block 122 at step S967. It is to be noted that the light emission signals supplied to the dummy pixel circuits in the first light emission region 510 and the second light emission region 520 at step S967 are light emission signals for causing the dummy pixel circuits not to emit light, that is, light emission signals of the gradation value "0." Then, the production processing procedure of a light emission signal by the dummy pixel light emitting signal production section 540 is ended.

On the other hand, if it is decided at step S966 that the acquired temperature is not "40±2° C.," then a light emission signal of the gradation value "0" for causing all of the dummy circuits not to emit light is supplied to the dummy circuits at step S968. Then, the production processing procedure of a light emission signal by the dummy pixel light emitting signal production section 540 is ended.

In this manner, with the second embodiment of the present invention, a degradation characteristic for each temperature can be produced with a high degree of accuracy by using a dummy pixel circuit which is degraded only at a particular temperature.

3. Third Embodiment

In the second embodiment of the present invention described above, in order to calculate a degradation characteristic for each temperature, a dummy pixel circuit which emits light only at a particular temperature is used. In the second embodiment of the present invention, only when the ambient temperature of the dummy pixel circuit becomes the particular temperature, degradation of the same only at the particular temperature can be measured. In other words, in the second embodiment of the present invention, a difference appears between a temperature at which degradation can be measured frequently and another temperature at which degradation can be measured scarcely in response to the peripheral environment of the display apparatus 100. As a result, there is the possibility that the degradation characteristic regarding the temperature at which degradation can be measured scarcely may be inaccurate.

Thus, in the following description of a third embodiment of the present invention, an example is described wherein the temperature of a dummy pixel circuit is kept fixed at a particular temperature so that degradation of the dummy pixel circuit at the particular temperature is always measured.

Example of Configuration of Display Apparatus

Figure 32:
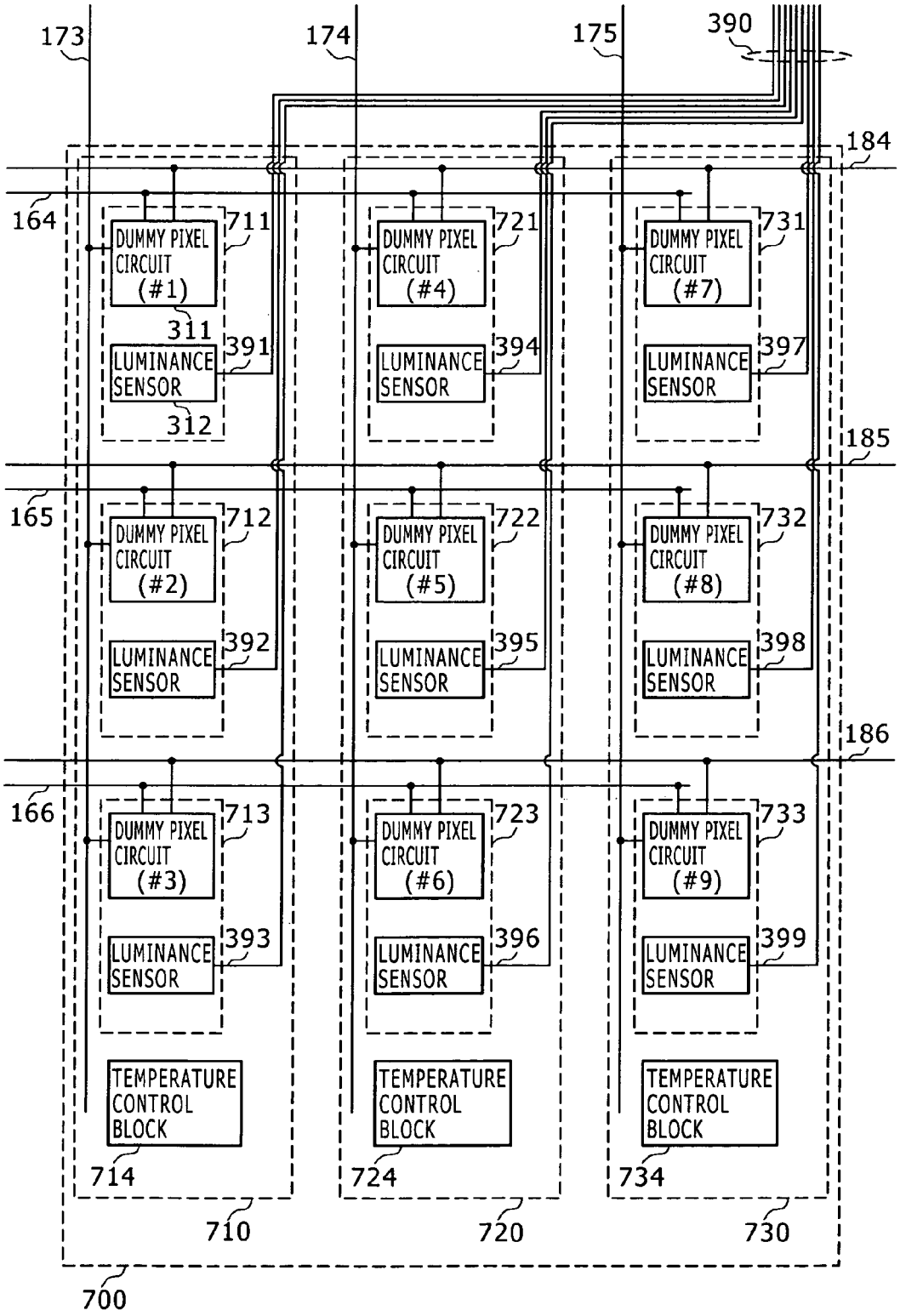
FIG. 32 is a block diagram showing an example of a configuration of a dummy pixel array section of a display apparatus according to a third embodiment of the present invention.

FIG. 32 is a block diagram showing an example of a configuration of a dummy pixel array section 700 in the third embodiment of the present invention. The dummy pixel array section 700 includes several common components to those of the dummy pixel array section 500 in the second embodiment of the present invention described hereinabove with reference to FIG. 25, and the following description of the dummy pixel array section 700 is given principally of differences from the dummy pixel array section 500. It is to be noted that, in FIG. 32, the dummy pixel circuits for the luminance detection units 711 to 713, 721 to 723 and 731 to 733 are identified by numbers #1 to #9 added annexed thereto.

It is to be noted that the configuration of the display apparatus 100 of the third embodiment of the present invention is similar to that of the display apparatus 100 of the second embodiment of the present invention except the dummy pixel light emitting signal production section 540 and the dummy pixel array section 500 in the display apparatus 100 of the second embodiment of the present invention. In the third embodiment of the present invention, since the dummy pixel circuits emit light with predetermined gradation values irrespective of the ambient temperature of the pixel circuits, the dummy pixel light emitting signal production section 150 described hereinabove with reference to FIG. 1 is provided in place of the dummy pixel light emitting signal production section 540. Further, the display apparatus 100 of the third embodiment of the present invention includes the dummy pixel array section 700 in place of the dummy pixel array section 300.

Referring to FIG. 32, the dummy pixel array section 700 includes nine luminance detection units, that is, luminance detection units 711 to 713, 721 to 723 and 731 to 733, similarly to the dummy pixel array section 500 in the second embodiment of the present invention described hereinabove with reference to FIG. 25. Further, the dummy pixel array section 700 includes three constant temperature regions, that is, a first constant temperature region 710, a second constant temperature region 720 and a third constant temperature region 730, in place of the three light emission regions shown in FIG. 25, that is, the first light emission region 510, second light emission region 520 and third light emission region 530.

The three constant temperature regions, that is, the first constant temperature region 710, second constant temperature region 720 and third constant temperature region 730, include temperature controlling blocks 714, 724 and 734 as temperature controlling elements for keeping the temperature fixed. The temperature controlling, blocks 714, 724 and 734 are hereinafter described with reference to FIG. 33.

The first constant temperature region 710 is a region in which the temperature is always kept at a particular temperature, that is, a first constant temperature and in which the luminance detection units which carry out measurement of degradation at this temperature, that is, the luminance detection units 711 to 713, are disposed. It is to be noted that, in the third embodiment of the present invention, it is assumed that the first constant temperature is "20° C." The dummy pixel circuits of the luminance detection units 711 to 713 disposed in the first constant temperature region 710 are always kept at the temperature of "20° C." and always emit light based on a predetermined gradation value. Then, the luminance regarding the light emission is measured by a luminance sensor.

The second constant temperature region 720 is a region in which the temperature is always kept at a particular temperature different from the first constant temperature, that is, at a second constant temperature and in which the luminance detection units which carry out measurement of degradation at this temperature, that is, the luminance detection units 721 to 723, are disposed. It is to be noted that, in the third embodiment of the present invention, it is assumed that the second constant temperature is "30° C." The dummy pixel circuits of the luminance detection units 721 to 723 disposed in the second constant temperature region 720 are always kept at the temperature of "30° C." and always emit light based on a predetermined gradation value. Then, the luminance regarding the light emission is measured by a luminance sensor.

The third constant temperature region 730 is a region in which the temperature is always kept at a particular temperature different from the first and second constant temperatures, that is, at a third constant temperature and in which the luminance detection units which carry out measurement of degradation at this temperature, that is, the luminance detection units 731 to 733, are disposed. It is to be noted that, in the third embodiment of the present invention, it is assumed that the third constant temperature is "40° C." The dummy pixel circuits of the luminance detection units 731 to 733 disposed in the third constant temperature region 730 are always kept at the temperature of "40° C." and always emit light based on a predetermined gradation value. Then, the luminance regarding the light emission is measured by a luminance sensor.

A dummy pixel circuit which always emits light at a particular temperature by keeping the temperature of the dummy pixel circuit fixed in this manner can be provided in the dummy pixel array section 700.

Figure 33A:
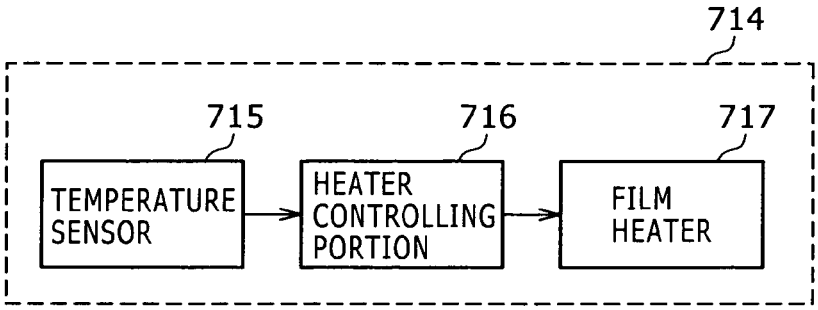
FIGS. 33A to 33C are a block diagram showing an example of a configuration of a temperature controlling block shown in FIG. 32 and a top plan view and a sectional view illustrating a positional relationship of a film heater to a dummy pixel circuit shown in FIG. 32, respectively.
Figure 33B:
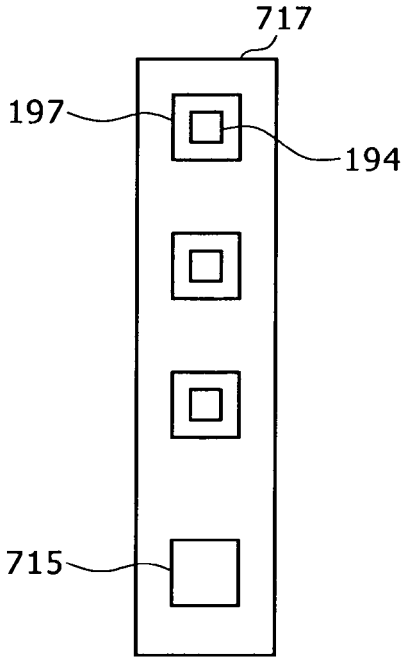
Figure 33C:
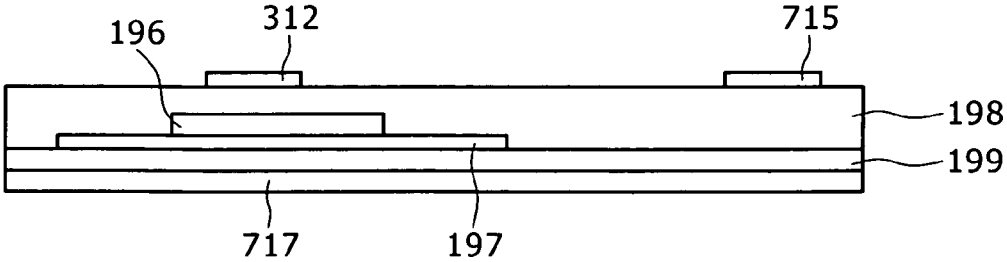

Example of Configuration of Temperature Controlling Block and Example of Disposition of Film Heater FIG. 33A is a block diagram showing an example of a configuration of the temperature controlling block 714 in the third embodiment of the present invention, and FIGS. 33B and 33C are a top plan view and a sectional view, respectively, illustrating a positional relationship of a film heater 717 to dummy pixel circuits. It is to be noted that temperature controlling blocks 724 and 734 shown in FIG. 32 are similar to the temperature controlling block 714, and therefore, the following description is given of the temperature controlling block 714 while description of the other temperature controlling blocks 724 and 734 is omitted herein.

FIG. 33A is a block diagram showing an example of a configuration of the temperature controlling block 714. Referring to FIG. 33A, the temperature controlling block 714 keeps the temperature in the first constant temperature region 710 fixed and includes a temperature sensor 715, a heater controlling portion 716 and a film heater 717.

The temperature sensor 715 measures the temperature in the first constant temperature region 710 and supplies the measured temperature to the heater controlling portion 716.

The heater controlling portion 716 controls power supply to the film heater 717 based on the temperature supplied thereto from the temperature sensor 715.

The film heater 717 generates, when power is supplied thereto, heat and supplies the heat to the first constant temperature region 710 to raise the temperature in the first constant temperature region 710.

FIG. 33B is a top plan view schematically illustrating a positional relationship among the film heater 717, TFT pixel circuits 197 indicative of dummy pixel circuits, the luminance sensor 194 and the temperature sensor 715.

FIG. 33C schematically shows a sectional configuration of the luminance sensor 312, dummy pixel circuit 311 and film heater 717. FIG. 33C particularly shows, as circuit components of the dummy pixel circuit 311, the light emitting element 196 and the TFT pixel circuit 197. Further, FIG. 33C shows the luminance sensor 312, resin 198, glass 199 and temperature sensor 715. For example, the TFT pixel circuit 197 is disposed on the glass 199, and the light emitting element 196 is disposed on the TFT pixel circuit 197. Further, the light emitting element 196 is covered with the resin 198, and the luminance sensor 312 and the temperature sensor 715 are disposed on the resin 198.

The temperature of the dummy pixel circuits can be kept fixed by disposing the film heater 717 adjacent the dummy pixel circuits as seen in FIGS. 33B and 33C.

Example of Luminance Measurement

Figure 34:
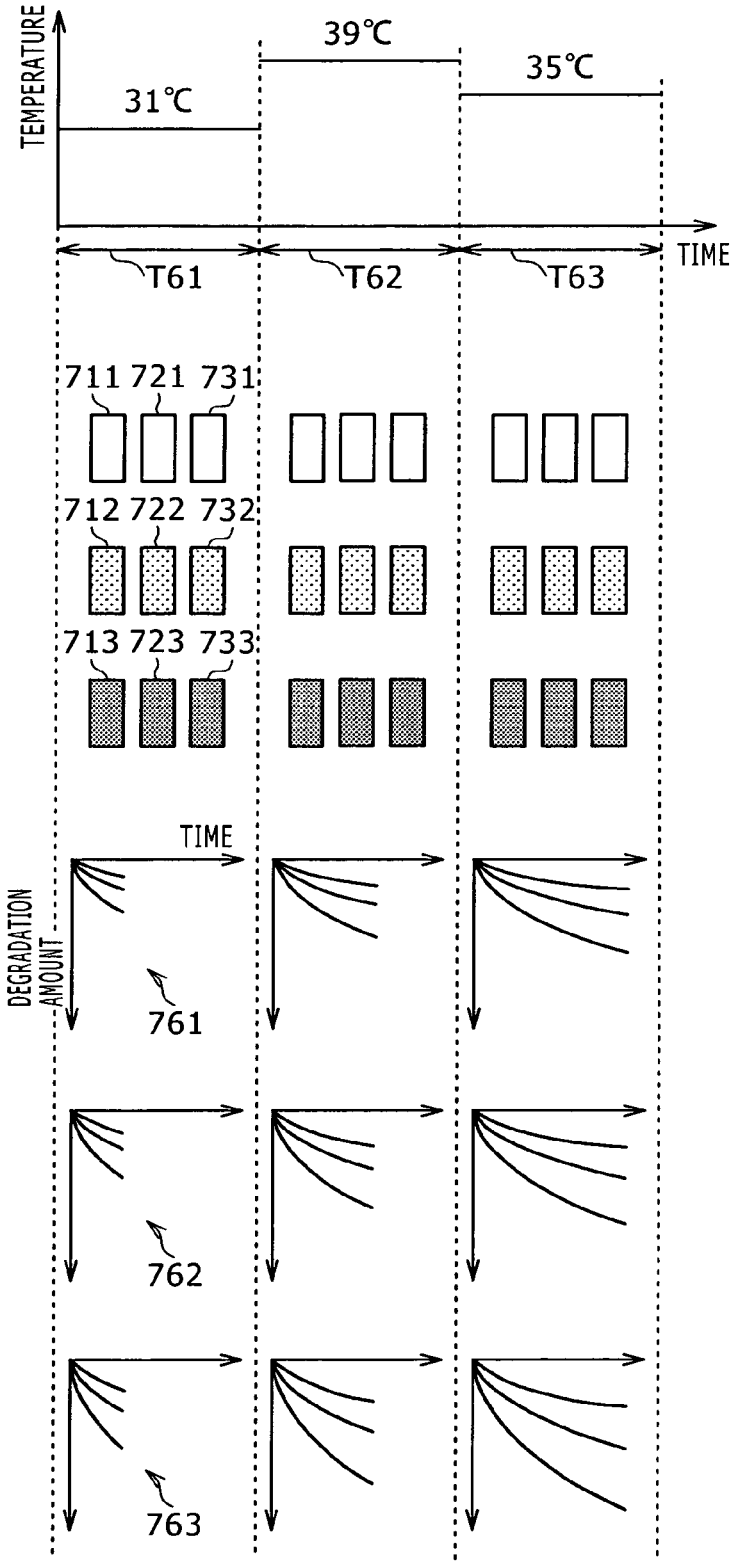
FIG. 34 is a diagrammatic view illustrating an example of luminance measurement by nine luminance sensors used in the display apparatus according to the third embodiment of the present invention.

FIG. 34 illustrates an example of luminance measurement by the nine luminance sensors in the third embodiment of the present invention.

Referring to FIG. 34, the axis of ordinate indicates the temperature and the axis of abscissa indicates the measurement period, and ambient temperatures within three successive measurement periods, that is, within measurement periods (1) T61 to (3) T63, are illustrated by graphs. Further, in FIG. 34, those dummy pixels which emit light within the three measurement periods are represented by rectangles indicative of the luminance detection units 711 to 713, 721 to 723 and 731 to 733 are shown. Further, in FIG. 34, graphs schematically illustrating the degradation amounts of the dummy pixel circuits within the measurement periods, that is, a 20° C. degradation characteristic 761, a 30° C. degradation characteristic 762 and a 40° C. degradation characteristic 763 are shown.

It is to be noted that it is assumed that, in FIG. 34, the ambient temperature of the pixel circuits within the measurement periods (1) T61 to (3) T63 is equal to the temperature within the measurement periods (1) T41 to (3) T43 illustrated in FIG. 27.

Further, it is to be noted that differences of the measurement periods (1) T61 to (3) T63 from the measurement periods (1) T41 to (3) T43 described hereinabove with reference to FIG. 27 are described with reference to FIG. 34.

The temperatures of the luminance detection units 711 to 713, 721 to 723 and 731 to 733 are kept fixed at predetermined temperatures, that is, at 20° C., 30° C. and 40° C., respectively. Therefore, different from the second embodiment of the present invention described hereinabove with reference to FIG. 27, there is no necessity to determine whether or not light should be emitted based on the ambient temperature of the dummy pixel circuits. Therefore, the nine luminance detection units in the third embodiment of the present invention emit light with predetermined gradation values (blank rectangles, light gray rectangles and deep gray rectangles) within the measurement periods (1) T61 to (3) T63, and degradation is calculated based on the light emission. It is to be noted that it is represented by addition of solid lines to the 20° C. degradation characteristic 761, 30° C. degradation characteristic 762 and 40° C. degradation characteristic 763 within the measurement periods that the degradation amounts of all luminance detection units are added within the measurement periods.

Since the temperature of a dummy pixel circuit is kept at a particular temperature in this manner, degradation of the dummy pixel circuit for each temperature can always be measured in all temperature conditions.

Example of Dummy Pixel Degradation Information

FIG. 35 illustrates an example of dummy pixel degradation information in the third embodiment of the present invention.

FIG. 35 particularly shows a table which schematically illustrates an example of dummy pixel degradation information retained in the dummy pixel degradation information retaining portion 570 at the end of the measurement period (3) T63 illustrated in FIG. 34. It is to be noted that, in FIG. 35, the intensity of the luminance, that is, dummy pixel luminance information, upon measurement as represented by a rate (%) to that of the dummy pixel circuits in their initial state is represented as dummy pixel degradation information.

A column 771 of FIG. 35 illustrates dummy pixel degradation information of the dummy pixel circuits regarding the first time measurement period, that is, the measurement period (1) T61. Meanwhile, another column 772 illustrates dummy pixel degradation information of the dummy pixel circuits regarding the second time measurement period, that is, the measurement period (2) T62. A further column 773 illustrates dummy pixel degradation information of the dummy pixel circuits regarding the third time measurement period, that is, the measurement period (3) T63.

As seen in the table of FIG. 35, the number of times of measurement of degradation of the dummy pixel circuits, that is, the number of pieces of the dummy pixel degradation information, is equal among them. On the other hand, in the second embodiment of the present invention described hereinabove with reference to FIG. 28, the number of times of measurement of degradation differs among different temperatures in response to the ambient temperature of the dummy pixel circuits.

Where the temperature of a dummy pixel circuit is kept fixed at a particular temperature, the numbers of times of measurement of degradation by the dummy pixel circuits can be made equal to each other.

Example of Degradation Characteristics at Plurality of Temperatures

Figure 36A:
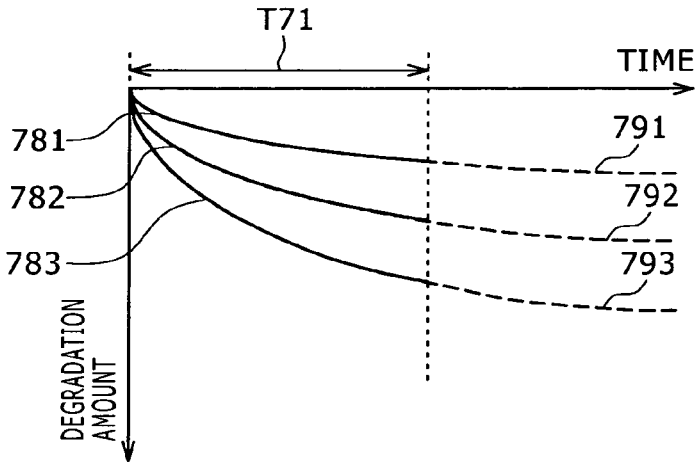
FIGS. 36A to 36C are diagrams schematically illustrating an example of degradation characteristics for individual temperatures produced by a degradation characteristic production portion of the display apparatus according to the third embodiment of the present invention.
Figure 36B:
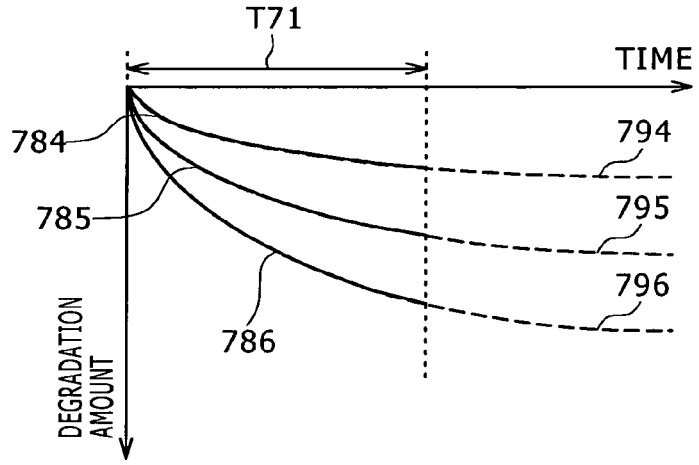
Figure 36C:
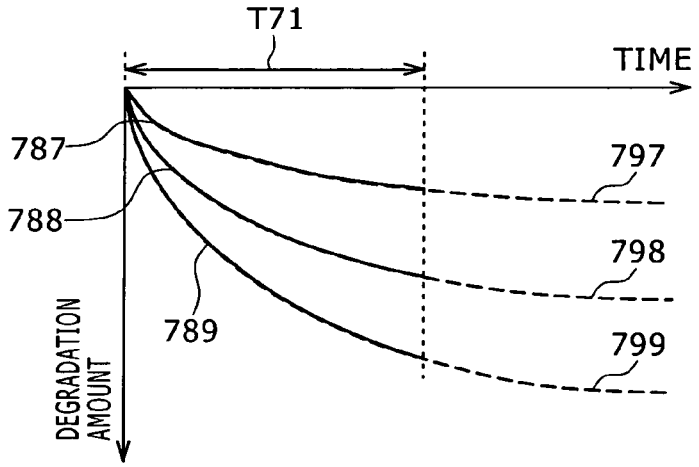

FIGS. 36A to 36C schematically illustrate an example of a degradation characteristic for each temperature produced by the degradation characteristic production portion 590 in the third embodiment of the present invention.

It is to be noted that, in FIGS. 36A to 36C, it is assumed that a degradation characteristic is produced based on the dummy pixel degradation information illustrated in FIG. 35 as an example.

FIG. 36A shows a graph schematically illustrating degradation characteristics in the temperature condition of "20° C." In this graph, degradation characteristics regarding degradation of the dummy pixel circuits #1 to #3 which emit light only at the first temperature of 20° C. are indicated by solid line curves, that is, by measurement degradation characteristics 781 to 783. Further, degradation characteristics calculated from the measurement degradation characteristics 781 to 783, that is, degradation characteristics 791 to 793, are indicated by broken line curves. FIG. 36A further illustrates a use period T71 within which the dummy circuits #1 to #3 are driven to emit light. It is to be noted that the use period T71 is a common period in FIGS. 36A to 36C which is the sum of the measurement periods (1) T71 to (3) T73.

FIG. 36B shows a graph schematically illustrating degradation characteristics in the temperature condition of "30° C." In this graph, degradation characteristics regarding degradation of the dummy pixel circuits #4 to #6 which emit light only at the second temperature of 30° C. are indicated by solid line curves, that is, by measurement degradation characteristics 784 to 786. Further, degradation characteristics calculated from the measurement degradation characteristics 784 to 786, that is, degradation characteristics 794 to 796, are indicated by broken line curves.

FIG. 36C shows a graph schematically illustrating degradation characteristics in the temperature condition of "40° C." In this graph, degradation characteristics regarding degradation of the dummy pixel circuits #7 to #9 which emit light only at the third temperature of 40° C. are indicated by solid line curves, that is, by measurement degradation characteristics 787 to 789. Further, degradation characteristics calculated from the measurement degradation characteristics 787 to 789, that is, degradation characteristics 797 to 799, are indicated by broken line curves.

In this manner, degradation characteristics in a plurality of temperature conditions are produced by the degradation characteristic production portion 590 based on measurement degradation characteristics whose periods of use are equal to each other.

In this manner, with the third embodiment of the present invention, a degradation characteristic for each temperature can be produced with a high degree of accuracy by keeping the temperature of a dummy pixel circuit fixed to a particular temperature.

It is to be noted that the display apparatus according to the first to third embodiments of the present invention can be applied to display apparatus having a shape of a flat panel for various electronic apparatus such as, for example, a digital camera, a notebook type personal computer, a portable telephone set and a video camera. Further, the display apparatus can be applied to display apparatus of electronic apparatus in various fields wherein an image signal inputted to or produced in the electronic apparatus is displayed as an image. Examples of an electronic apparatus to which such display apparatus are applied are described below.

4. Examples of Application of the Present Invention

Examples of Application to Electronic Apparatus

Figure 37:
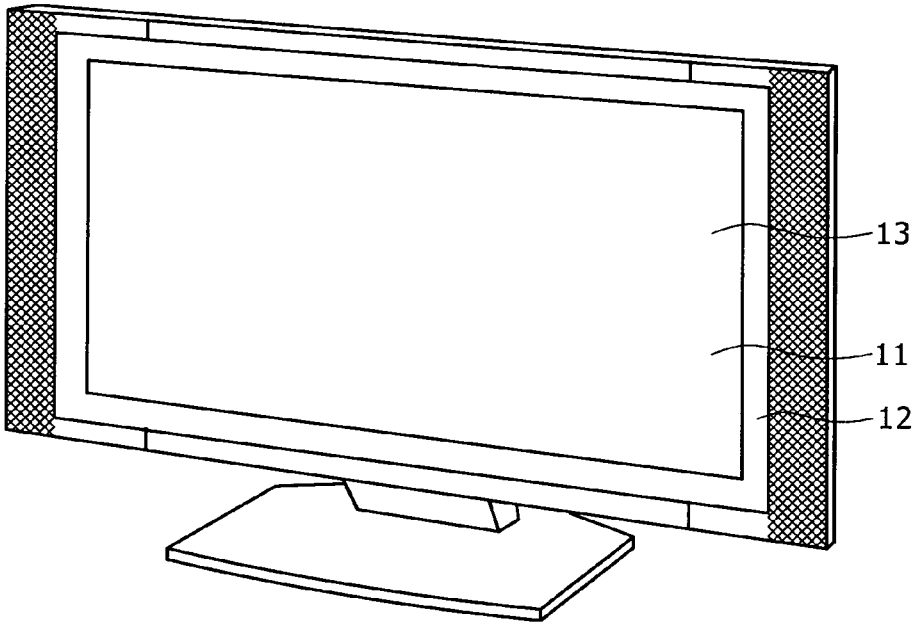
FIG. 37 is a perspective view showing an example of application of the embodiments of the present invention to a television set.

FIG. 37 illustrates an example of application of the embodiments of the present invention to a television set. Referring to FIG. 37, the television set shown is configured by applying any of the first to third embodiments of the present invention described above. The television set includes an image display screen 11 configured from a front panel 12, a glass filter 13 and so forth. The display apparatus 100 according to the embodiments of the present invention can be used as the image display screen 11.

Figure 38:
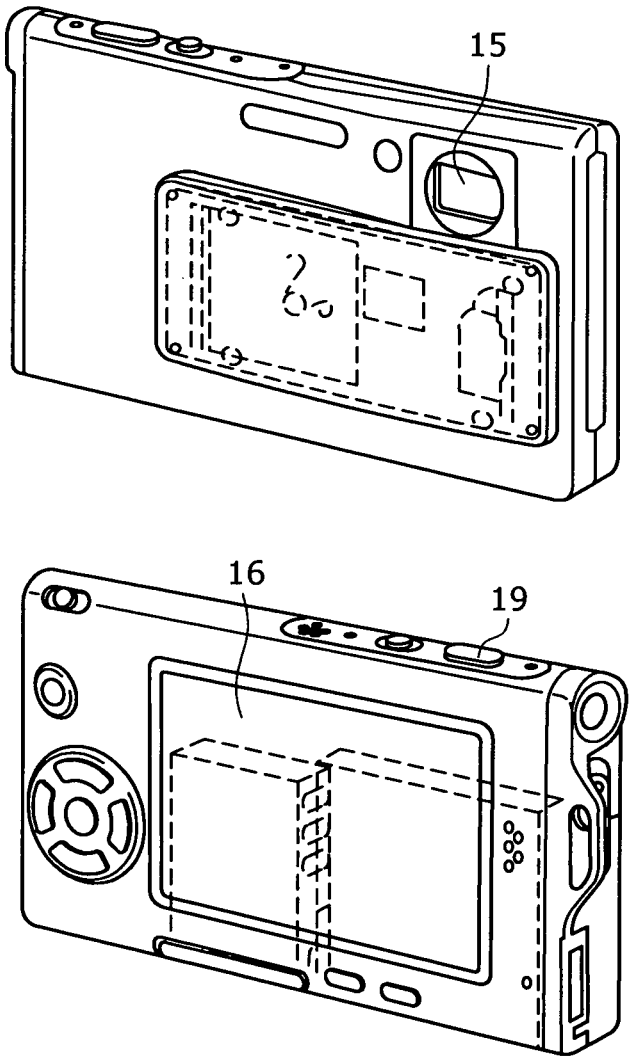
FIG. 38 is front and rear elevational views showing an example of application of the embodiments of the present invention to a digital still camera.

FIG. 38 illustrates an example of application of the embodiments of the present invention to a digital still camera. Referring to FIG. 38, the digital still camera shown is configured by applying any of the first to third embodiments of the present invention described above. Here, a front elevational view of the digital still camera is shown on the upper stage while a rear elevational view of the digital still camera is shown on the lower stage. The digital still camera includes an image pickup lens 15, a display section 16, a control switch, a menu switch, a shutter button 19 and so forth and is configured by applying the display apparatus 100 in the embodiments of the present invention to the display section 16.

Figure 39:
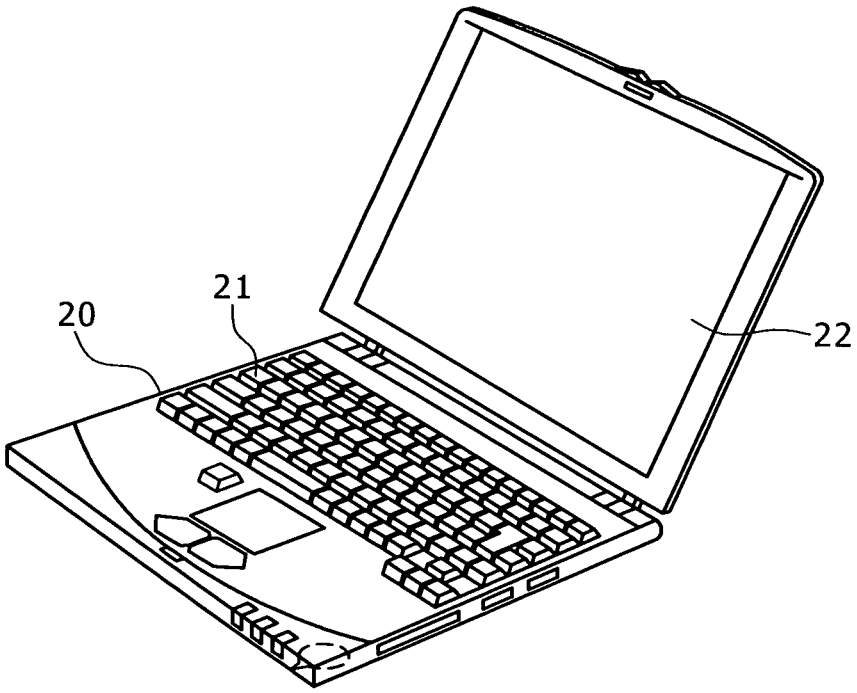
FIG. 39 is a perspective view showing an example of application of the embodiments of the present invention to a notebook type personal computer.

FIG. 39 illustrates an example of application of the embodiments of the present invention to a notebook type personal computer. Referring to FIG. 39, the notebook type personal computer shown is configured by applying any of the first to third embodiments of the present invention described above. The notebook type personal computer includes a keyboard 21 which is operated to input characters or the like on a main body 20 and further includes a display section 22 provided on a body cover for displaying an image. The notebook type personal computer is configured by applying the display apparatus 100 in the embodiments of the present invention to the display section 22.

Figure 40:
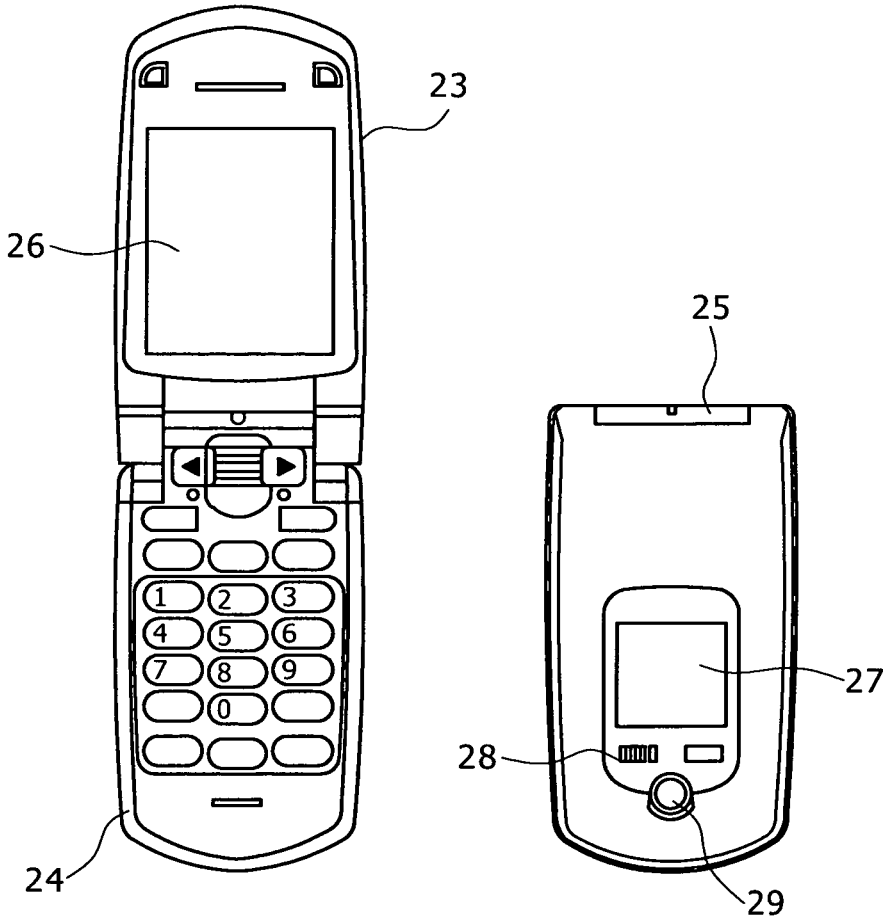
FIG. 40 is front elevational views showing an example of application of the embodiments of the present invention to a portable terminal apparatus in unfolded and folded states, respectively.

FIG. 40 illustrates an example of application of the embodiments of the present invention to a portable terminal apparatus. Referring to FIG. 40, the portable terminal apparatus shown is configured by applying any of the first to third embodiments of the present invention described above. In FIG. 40, the portable terminal apparatus in an unfolded state is shown on the left side, and the portable terminal apparatus in a folded state is shown on the right side. The portable terminal apparatus includes an upper side housing, 23, a lower side housing 24, a connection section 25 in the form of a hinge section, a display section 26, a sub display section 27, a picture light 28, a camera 29 and so forth. The portable terminal apparatus is configured by applying the display apparatus 100 in the embodiments of the present invention to the display section 26 or the sub display section 27.

Figure 41:
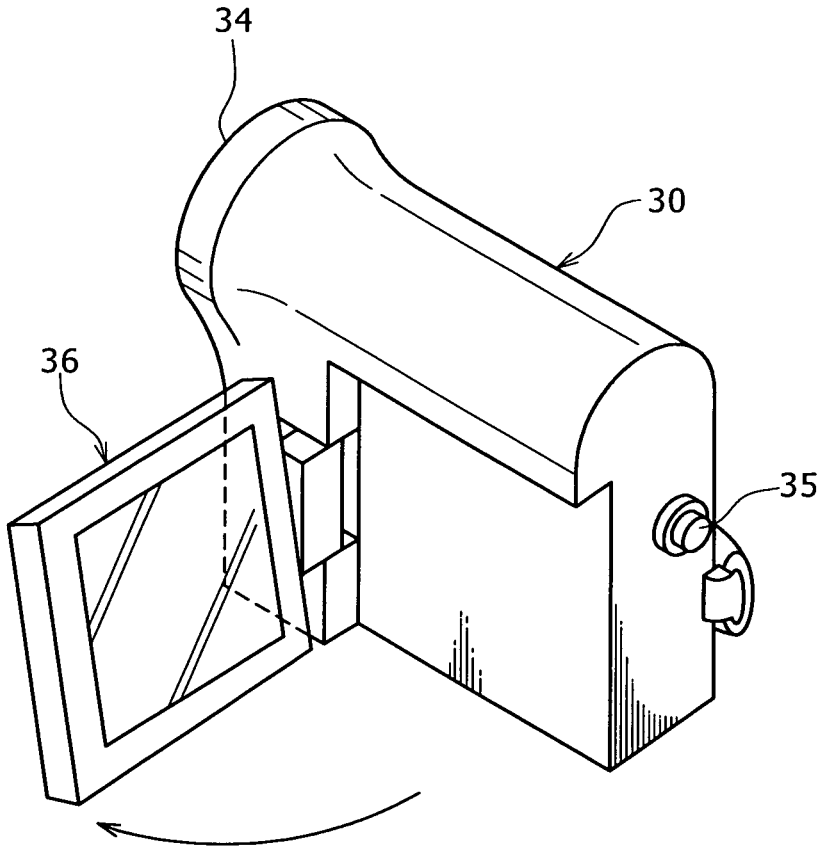
FIG. 41 is a perspective view showing an example of application of the embodiments of the present invention to a video camera.

FIG. 41 illustrates an example of application of the embodiments of the present invention to a video camera. Referring to FIG. 41, the video camera shown is configured by applying any of the first to third embodiments of the present invention described above. The video camera includes a main body section 30, a lens 34 for image pickup of an image pickup object provided on a face of the main body section 30 directed forwardly, a start/stop switch 35 for image pickup, a monitor 36 and so forth. The video camera is configured by applying the display apparatus 100 in the embodiments of the present invention to the monitor 36.

In this manner, with the embodiments of the present invention, correction of ghosting can be carried out with a high degree of accuracy by measuring the luminance of a dummy pixel circuit and producing a degradation characteristic for each temperature.

It is to be noted that the embodiments of the present invention represent examples for carrying out the present invention, and matters in the embodiments of the present invention and features of the present invention defined in the claims have a corresponding relationship to each other. Similarly, the features defined in the claims and matters in the embodiments of the present invention to which the same terms as those of the features are applied have a corresponding relationship to each other. However, the present invention is not limited to the embodiments but can be carried out in various modified forms without departing from the spirit and scope of the present invention.

Further, the processing procedures described hereinabove in connection with the embodiments of the present invention may be grasped as a method which has a series of such procedures or may be grasped as a program for causing a computer to execute the series or procedures or a recording medium in or on which the program is stored. The recording medium may be, for example, a CD (Compact Disc), an MD (Mini Disc), a DVD (Digital Versatile Disc), a memory card, a blue ray disc (Blu-ray Disc (registered trademark) or the like.

The present application contains subject matter related to that disclosed in Japanese Priority Patent Application JP 2010-076649 filed in the Japan Patent Office on Mar. 30, 2010, the entire content of which is hereby incorporated by reference.

It should be understood by those skilled in the art that various modifications, combinations, sub-combinations and alternations may occur depending on design requirements and other factors insofar as they are within the scope of the appended claims or the equivalent thereof.

What is claimed is:

1. A signal processing apparatus, comprising:

a luminance degradation information production section, containing an updating portion and a retaining portion, adapted to produce and successively update luminance degradation information regarding degradation of a luminance of light from a light emitting element in a pixel circuit in accordance with a temperature condition upon emission based on an ambient temperature of the pixel circuit and a luminance value, which degrades in response to elapsed time, of a particular light emitting element which is driven to emit light with a particular gradation value;

a luminance degradation value calculation section adapted to calculate a luminance degradation value regarding degradation of the luminance for each pixel circuit based on a luminance characteristic indicative of a characteristic of a correlation between an image signal supplied to the pixel circuit which is in a predetermined state and the luminance of light emitted from the pixel circuit in response to the image signal and the luminance degradation information produced by said luminance degradation information production section; and a correction section adapted to correct the gradation value of the image signal to be inputted to the pixel circuit based on the luminance degradation value; and wherein said luminance degradation information production section includes a luminance degradation characteristic production section adapted to produce a luminance degradation characteristic regarding degradation of the luminance of the pixel circuit at a particular temperature based on a measurement temperature when the luminance value is measured and the luminance value; and an addition section adapted to successively add a new degradation amount regarding the degradation of the luminance of the pixel circuit to the luminance degradation information based on the ambient temperature, the luminance degradation characteristic, luminance degradation information produced with regard to the pixel circuit before the correction and the gradation value of the image signal inputted to the pixel circuit to produce new luminance degradation information.

2. The signal processing apparatus according to claim 1, wherein said luminance degradation characteristic production section produces the luminance degradation characteristic in a temperature condition different from the measurement temperature based on the measurement temperature when the luminance value is measured and the luminance value.

3. The signal processing apparatus according to claim 1, further comprising:

an image signal supplying section adapted to supply an image signal to said particular light emitting element in response to the measurement temperature;

said luminance degradation characteristic production section producing the luminance degradation characteristic of the pixel circuit at the particular temperature based on a luminance value, which degrades in response to the elapsed time, of said particular light emitting element when the measurement temperature becomes the particular temperature.

4. The signal processing apparatus according to claim 1, wherein said luminance degradation characteristic production section produces the luminance degradation characteristic of the pixel circuit at the particular temperature based on the luminance value, which degrades in response to the elapsed time, of said particular light emitting element in a state in which the ambient temperature of said particular light emitting element is the particular temperature.

5. The signal processing apparatus according to claim 1, wherein the predetermined state is a state in which the pixel circuit suffers from no degradation of the luminance.

6. A display apparatus, comprising:

a signal processing circuit adapted to correct a gradation value of an image signal;

a plurality of pixel circuits each including a light emitting element which emits light, when driving current according to the image signal is supplied thereto, with a luminance corresponding to the driving current; and a particular pixel circuit including a particular light emitting element which emits light in response to a light emission signal of a particular gradation value, said signal processing circuit including a luminance degradation information production section, containing an updating portion and a retaining portion, adapted to produce and successively update luminance degradation information regarding degradation of a luminance of light from the light emitting element in each of the pixel circuits in accordance with a temperature condition upon emission based on an ambient temperature of the pixel circuit and a luminance value, which degrades in response to elapsed time, of the particular light emitting element of said particular pixel circuit, a luminance degradation value calculation section adapted to calculate a luminance degradation value regarding degradation of the luminance for each of the pixel circuits based on a luminance characteristic indicative of a characteristic of a correlation between the image signal supplied to the pixel circuit which is in a predetermined state and the luminance of light emitted from the pixel circuit in response to the image signal and the luminance degradation information produced by said luminance degradation information production section, and a correction section adapted to correct the gradation value of the image signal to be inputted to the pixel circuit based on the luminance degradation value; and wherein said luminance degradation information production section includes a luminance degradation characteristic production section adapted to produce a luminance degradation characteristic regarding degradation of the luminance of the pixel circuit at a particular temperature based on a measurement temperature when the luminance value is measured and the luminance value; and an addition section adapted to successively add a new degradation amount regarding the degradation of the luminance of the pixel circuit to the luminance degradation information based on the ambient temperature, the luminance degradation characteristic, luminance degradation information produced with regard to the pixel circuit before the correction and the gradation value of the image signal inputted to the pixel circuit to produce new luminance degradation information.

7. An electronic apparatus, comprising:

a signal processing circuit adapted to correct a gradation value of an image signal;

a plurality of pixel circuits each including a light emitting element which emits light, when driving current according to the image signal is supplied thereto, with a luminance corresponding to the driving current; and a particular pixel circuit including a light emitting element which emits light in response to a light emission signal of a particular gradation value, said signal processing circuit including a luminance degradation information production section, containing an updating portion and a retaining portion, adapted to produce and successively update luminance degradation information regarding degradation of a luminance of light from the light emitting element in each of the pixel circuits in accordance with a temperature condition upon emission based on an ambient temperature of the pixel circuit and a luminance value, which degrades in response to elapsed time, of the light emitting element of said particular pixel circuit, a luminance degradation value calculation section adapted to calculate a luminance degradation value regarding degradation of the luminance for each of the pixel circuits based on a luminance characteristic indicative of a characteristic of a correlation between the image signal supplied to the pixel circuit which is in a predetermined state and the luminance of light emitted from the pixel circuit in response to the image signal and the luminance degradation information produced by said luminance degradation information production section, and a correction section adapted to correct the gradation value of the image signal to be inputted to the pixel circuit based on the luminance degradation value; and wherein said luminance degradation information production section includes a luminance degradation characteristic production section adapted to produce a luminance degradation characteristic regarding degradation of the luminance of the pixel circuit at a particular temperature based on a measurement temperature when the luminance value is measured and the luminance value; and an addition section adapted to successively add a new degradation amount regarding the degradation of the luminance of the pixel circuit to the luminance degradation information based on the ambient temperature, the luminance degradation characteristic, luminance degradation information produced with regard to the pixel circuit before the correction and the gradation value of the image signal inputted to the pixel circuit to produce new luminance degradation information.

8. A signal processing method, comprising the steps of:

producing and successively updating luminance degradation information regarding degradation of a luminance of light from a light emitting element in a pixel circuit in accordance with a temperature condition upon emission based on an ambient temperature of the pixel circuit and a luminance value, which degrades in response to elapsed time, of a particular light emitting element which is driven to emit light with a particular gradation value;

calculating a luminance degradation value regarding degradation of the luminance for each pixel circuit based on a luminance characteristic indicative of a characteristic of a correlation between an image signal supplied to the pixel circuit which is in a predetermined state and the luminance of light emitted from the pixel circuit in response to the image signal and the luminance degradation information produced by the luminance degradation information production step;

correcting the gradation value of the image signal to be inputted to the pixel circuit based on the luminance degradation value;

producing a luminance degradation characteristic regarding degradation of the luminance of the pixel circuit at a particular temperature based on a measurement temperature when the luminance value is measured and the luminance value; and adapting to successively add a new degradation amount regarding the degradation of the luminance of the pixel circuit to the luminance degradation information based on the ambient temperature, the luminance degradation characteristic, luminance degradation information produced with regard to the pixel circuit before the correction and the gradation value of the image signal inputted to the pixel circuit to produce new luminance degradation information.

9. A non-transitory computer readable medium storing a program, the program being executable by a processor to cause operations comprising:

producing and successively updating luminance degradation information regarding degradation of a luminance of light from a light emitting element in a pixel circuit in accordance with a temperature condition upon emission based on an ambient temperature of the pixel circuit and a luminance value, which degrades in response to elapsed time, of a particular light emitting element which is driven to emit light with a particular gradation value;

calculating a luminance degradation value regarding degradation of the luminance for each pixel circuit based on a luminance characteristic indicative of a characteristic of a correlation between an image signal supplied to the pixel circuit which is in a predetermined state and the luminance of light emitted from the pixel circuit in response to the image signal and the luminance degradation information produced by the luminance degradation information production step; and correcting the gradation value of the image signal to be inputted to the pixel circuit based on the luminance degradation value;

producing a luminance degradation characteristic regarding degradation of the luminance of the pixel circuit at a particular temperature based on a measurement temperature when the luminance value is measured and the luminance value; and adapting to successively add a new degradation amount regarding the degradation of the luminance of the pixel circuit to the luminance degradation information based on the ambient temperature, the luminance degradation characteristic, luminance degradation information produced with regard to the pixel circuit before the correction and the gradation value of the image signal inputted to the pixel circuit to produce new luminance degradation information.

10. A signal processing apparatus, comprising:

luminance degradation information production means for producing and successively updating luminance degradation information regarding degradation of a luminance of light from a light emitting element in a pixel circuit in accordance with a temperature condition upon emission based on an ambient temperature of the pixel circuit and a luminance value, which degrades in response to elapsed time, of a particular light emitting element which is driven to emit light with a particular gradation value;

luminance degradation value calculation means for calculating a luminance degradation value regarding degradation of the luminance for each pixel circuit based on a luminance characteristic indicative of a characteristic of a correlation between an image signal supplied to the pixel circuit which is in a predetermined state and the luminance of light emitted from the pixel circuit in response to the image signal and the luminance degradation information produced by said luminance degradation information production means; and correction means for correcting the gradation value of the image signal to be inputted to the pixel circuit based on the luminance degradation value; and wherein said luminance degradation information production section includes:

a luminance degradation characteristic production section adapted to produce a luminance degradation characteristic regarding degradation of the luminance of the pixel circuit at a particular temperature based on a measurement temperature when the luminance value is measured and the luminance value; and an addition section adapted to successively add a new degradation amount regarding the degradation of the luminance of the pixel circuit to the luminance degradation information based on the ambient temperature, the luminance degradation characteristic, luminance degradation information produced with regard to the pixel circuit before the correction and the gradation value of the image signal inputted to the pixel circuit to produce new luminance degradation information.

11. The display apparatus according to claim 6, wherein said luminance degradation characteristic production section produces the luminance degradation characteristic in a temperature condition different from the measurement temperature based on the measurement temperature when the luminance value is measured and the luminance value.

12. The display apparatus according to claim 6, further comprising:

an image signal supplying section adapted to supply an image signal to said particular light emitting element in response to the measurement temperature;

said luminance degradation characteristic production section producing the luminance degradation characteristic of the pixel circuit at the particular temperature based on a luminance value, which degrades in response to the elapsed time, of said particular light emitting element when the measurement temperature becomes the particular temperature.

13. The display apparatus according to claim 6, wherein said luminance degradation characteristic production section produces the luminance degradation characteristic of the pixel circuit at the particular temperature based on the luminance value, which degrades in response to the elapsed time, of said particular light emitting element in a state in which the ambient temperature of said particular light emitting element is the particular temperature.

14. The display apparatus according to claim 6, wherein the predetermined state is a state in which the pixel circuit suffers from no degradation of the luminance.

15. The electronic apparatus according to claim 7, wherein said luminance degradation characteristic production section produces the luminance degradation characteristic in a temperature condition different from the measurement temperature based on the measurement temperature when the luminance value is measured and the luminance value.

16. The electronic apparatus according to claim 7, further comprising:

an image signal supplying section adapted to supply an image signal to said particular light emitting element in response to the measurement temperature;

said luminance degradation characteristic production section producing the luminance degradation characteristic of the pixel circuit at the particular temperature based on a luminance value, which degrades in response to the elapsed time, of said particular light emitting element when the measurement temperature becomes the particular temperature.

17. The electronic apparatus according to claim 7, wherein said luminance degradation characteristic production section produces the luminance degradation characteristic of the pixel circuit at the particular temperature based on the luminance value, which degrades in response to the elapsed time, of said particular light emitting element in a state in which the ambient temperature of said particular light emitting element is the particular temperature.

* * * * *